US011883714B2

(12) United States Patent
Tholkes et al.

(10) Patent No.: US 11,883,714 B2
(45) Date of Patent: Jan. 30, 2024

(54) UPPER BODY GAIT ERGOMETER AND GAIT TRAINER

(71) Applicant: ALT INNOVATIONS LLC, Waconia, MN (US)

(72) Inventors: Alan Tholkes, Waconia, MN (US); Duwayne Dandurand, Jordan, MN (US); Nathaniel Hallée, Eden Prairie, MN (US)

(73) Assignee: ALT INNOVATIONS LLC, Waconia, MN (US)

( * ) Notice: Subject to any disclaimer, the term of this patent is extended or adjusted under 35 U.S.C. 154(b) by 110 days.

(21) Appl. No.: 17/646,134

(22) Filed: Dec. 27, 2021

(65) Prior Publication Data

US 2022/0203158 A1 Jun. 30, 2022

Related U.S. Application Data

(60) Provisional application No. 63/130,568, filed on Dec. 24, 2020.

(51) Int. Cl.
*A63B 22/00* (2006.01)

(52) U.S. Cl.
CPC ..... *A63B 22/0056* (2013.01); *A63B 22/0046* (2013.01); *A63B 2022/0053* (2013.01);
(Continued)

(58) Field of Classification Search
CPC ..... A63B 22/0056; A63B 22/0046; A63B 2022/0053; A63B 2208/0204;
(Continued)

(56) References Cited

U.S. PATENT DOCUMENTS 5,207,622 A * 5/1993 Wilkinson ..... A63B 22/0012 482/54
5,242,179 A 9/1993 Beddome et al.
(Continued)

FOREIGN PATENT DOCUMENTS

AU 2014361932 B 1/2019
CA 2938531 A1 6/2015
(Continued)

OTHER PUBLICATIONS

U.S. Appl. No. 17/105,843, filed Nov. 27, 2020, Alt Innovations LLC.
(Continued)

*Primary Examiner* — Garrett K Atkinson
(74) *Attorney, Agent, or Firm* — Craige Thompson; Thompson Patent Law; Timothy D. Snowden

(57) ABSTRACT

Apparatus and associated methods may relate a to natural gait upper body ergometer and gait therapy (UBEGT) device having a support frame within which is suspended rotationally coordinated left and right natural gait modules (NGMs). A position of each NGM may be defined by corresponding left and right pivot arms which are rotatably coupled to a left and right side of the support frame, respectively, and wherein each gait training module is provided with a corresponding foot support and knee support. The UBEGT may be provided with an upper body ergometer (UBE) rotatably coupled to a front of the support frame and configured to rotate a shaft rotatably connected to the left and right pivot arms when a hand crank is rotated.

6 Claims, 61 Drawing Sheets

(52) U.S. Cl.
CPC ..... *A63B 2208/0204* (2013.01); *A63B 2208/0228* (2013.01)

(58) Field of Classification Search
CPC ..... A63B 2208/0228; A63B 23/035; A63B 21/00178; A63B 22/001; A63B 22/0664; A63B 69/0057; A63B 21/00181; A63B 21/4009; A63B 21/4015; A63B 21/4011; A63B 21/4033; A63B 23/03541; A63B 23/03575; A63B 69/0064; A63B 22/14; A63B 22/203; A63B 22/16; A63B 2208/0233; A63B 2209/10; A63B 2022/067; A63B 2022/0094; A63B 21/225; A63B 2225/093; A63B 21/0058; A63B 2022/0092; A63B 21/4039; A61G 5/14; A61H 1/0262; A61H 2201/163; A61H 2201/1635; A61H 2201/1269; A61H 2201/1621; A61H 3/008; A61H 2201/1642; A61H 2201/1676
See application file for complete search history.

(56) References Cited

U.S. PATENT DOCUMENTS 5,792,027 A * 8/1998 Gvoich ..... A63B 21/4047 482/52
6,045,488 A * 4/2000 Eschenbach ..... A63B 22/0023 482/52
6,390,954 B1 * 5/2002 Lee ..... A63B 22/001 482/52
6,440,046 B1 * 8/2002 Tholkes ..... A61H 1/0237 482/142
6,689,075 B2 2/2004 Gary
6,770,040 B2 8/2004 Perner et al.
6,821,233 B1 11/2004 Colombo et al.
7,137,927 B2 * 11/2006 Maresh ..... A63B 22/0007 482/52
7,163,492 B1 1/2007 Sotiriades
7,494,448 B2 * 2/2009 Eschenbach ..... A63B 22/0664 482/52
7,507,185 B2 * 3/2009 Eschenbach ..... A63B 22/001 482/52
7,601,104 B2 10/2009 Agrawal et al.
7,611,446 B2 * 11/2009 Chuang ..... A63B 22/001 482/52
7,794,362 B2 * 9/2010 Miller ..... A63B 22/0017 482/52
7,833,133 B2 * 11/2010 Stewart ..... A63B 22/0664 482/52
7,833,134 B2 11/2010 Gordon
7,938,756 B2 5/2011 Rodetsky et al.
7,993,247 B1 * 8/2011 Eschenbach ..... A63B 22/0664 482/52
8,105,213 B2 * 1/2012 Stewart ..... A63B 23/0429 482/52
8,177,688 B2 5/2012 Burnfield et al.
8,303,470 B2 * 11/2012 Stewart ..... A63B 22/001 482/52
8,454,541 B2 6/2013 Olsen
8,562,491 B2 * 10/2013 Merli ..... A63B 22/06 482/52
8,771,208 B2 7/2014 Agrawal et al.
9,017,225 B2 * 4/2015 Huang ..... A63B 23/03583 482/80
9,044,639 B2 * 6/2015 Chia ..... A63B 22/0605
9,050,485 B2 * 6/2015 Huang ..... A63B 22/203
9,050,498 B2 * 6/2015 Lu ..... A63B 21/154
9,138,614 B2 * 9/2015 Lu ..... A63B 22/0664
9,161,872 B2 10/2015 Lee et al.
9,248,071 B1 * 2/2016 Benda ..... A63B 71/0009
9,616,282 B2 * 4/2017 Tholkes ..... A63B 22/0005
10,086,227 B2 * 10/2018 Merli ..... A63B 22/0605
10,315,067 B2 * 6/2019 Tholkes ..... A61N 1/0484
10,758,774 B2 * 9/2020 Tholkes ..... A63B 22/001
10,881,572 B2 * 1/2021 Tholkes ..... A61H 3/00
11,083,924 B2 * 8/2021 Borisoff ..... A63B 23/03575
2002/0026130 A1 2/2002 Gary
2004/0097330 A1 5/2004 Reggie et al.
2004/0102291 A1 5/2004 Eschenbach
2004/0116839 A1 6/2004 Sarkodie-Gyan
2004/0224825 A1 * 11/2004 Giannelli ..... A63B 22/0023 482/52
2005/0101448 A1 5/2005 He et al.
2005/0202939 A1 * 9/2005 Lull ..... A63B 22/001 482/57
2006/0097557 A1 5/2006 Tholkes et al.
2006/0100065 A1 * 5/2006 Maresh ..... A63B 22/0056 482/52
2007/0099764 A1 * 5/2007 Eschenbach ..... A63B 22/001 482/52
2007/0161463 A1 * 7/2007 Eschenbach ..... A63B 22/001 482/52
2007/0179561 A1 8/2007 Embrey et al.
2008/0045385 A1 * 2/2008 Eschenbach ..... A63B 22/0664 482/52
2008/0051258 A1 2/2008 Schmehl et al.
2008/0161164 A1 * 7/2008 Stewart ..... A63B 22/0017 482/52
2008/0255488 A1 10/2008 Agrawal et al.
2008/0261778 A1 * 10/2008 Chuang ..... A63B 22/001 482/52
2008/0287265 A1 * 11/2008 Giannelli ..... A63B 22/001 482/52
2008/0312050 A1 * 12/2008 Chuang ..... A63B 22/0664 482/70
2009/0005222 A1 * 1/2009 Liao ..... A63B 22/001 482/52
2009/0011910 A1 * 1/2009 Lai ..... A63B 22/0664 482/131
2009/0075786 A1 * 3/2009 Merli ..... A63B 22/001 482/63
2009/0105049 A1 * 4/2009 Miller ..... A63B 22/0017 482/52
2009/0298653 A1 12/2009 Rodetsky et al.
2010/0121232 A1 5/2010 Sankai
2010/0222716 A1 9/2010 Olsen
2010/0248903 A1 9/2010 Cardile
2010/0270771 A1 10/2010 Kobayashi et al.
2010/0285929 A1 11/2010 Bayerlein et al.
2010/0298102 A1 11/2010 Bosecker et al.
2011/0028277 A1 * 2/2011 Merli ..... A63B 23/03575 482/63
2011/0071442 A1 3/2011 Park et al.
2011/0086742 A1 4/2011 Burnfield et al.
2011/0201978 A1 8/2011 Jeon et al.
2011/0205067 A1 8/2011 Konishi et al.
2012/0004581 A1 1/2012 Dinon
2012/0253242 A1 10/2012 Lee et al.
2013/0053218 A1 * 2/2013 Barker ..... G16H 20/30 482/4
2013/0226048 A1 8/2013 Unluhisarcikli et al.
2013/0274640 A1 10/2013 Butters et al.
2014/0051552 A1 * 2/2014 Habing ..... A63B 22/0664 482/52
2014/0194256 A1 * 7/2014 Huang ..... A63B 23/03591 482/52
2014/0243157 A1 * 8/2014 Huang ..... A63B 22/203 482/52
2015/0141207 A1 * 5/2015 Eschenbach ..... A63B 22/001 482/52
2015/0165265 A1 * 6/2015 Tholkes ..... A61H 1/0262 482/57
2015/0246260 A1 * 9/2015 Giannelli ..... A63B 23/0476 482/8

(56) References Cited

U.S. PATENT DOCUMENTS

| | | | | |
|---|---|---|---|---|
| 2017/0136295 | A1* | 5/2017 | Tholkes | A61B 5/112 |
| 2019/0231630 | A1* | 8/2019 | Tholkes | A61H 1/0266 |

FOREIGN PATENT DOCUMENTS

| | | | |
|---|---|---|---|
| EP | 3079642 | A1 | 10/2016 |
| WO | 2015088668 | A1 | 6/2015 |
| WO | 2018032007 | A1 | 2/2018 |

OTHER PUBLICATIONS

Examination Report in Related Australian Application No. 2014361932, 3 pages, dated Aug. 16, 2018.
Extended European Search Report in related Europe Application No. 14869433.4-1658 / 3079642, PCT/US2014063487, dated Sep. 22, 2017; 8 pages.
International Preliminary Report on Patentability in related International Application No. PCT/US2017/046788, dated Feb. 21, 2019, 6 pages.
International Search Report in related International Application No. PCT/US17/46788; dated Nov. 9, 2017; 3 pages.
Written Opinion of the International Searching Authority in related International Application No. PCT/US17146788; dated Nov. 9, 2017; 4 pages.
Aretech, ZeroG helps improve patent outcomes through early and intense rehabilitation, ZeroG Gait & Balance System, retrieved from the internet, <https://www.aretechllc.com/>.
BCIT, AAPLEwalk™: BCIT designs exercise machine for people with disabilities, BCIT Rehabilitation Engineering Design Lab (REDLab), Feb. 5, 2020, retrieved from the internet, <https://commons.bcit.ca/news/2020/02/bcit-aaplewalk/>.
Biodex, NxStep Unweighing Sytem, Biodex Medical Systems, retrieved from the internet, <https://www.biodex.com/physical-medicine/products/pbws/nxstep>.
Cyberdyne, HAL for Well-Being, Cyberdyne Inc., retrieved from the internet, <https://www.cyberdyne.jp/english/products/fl05.html>.
Easystand, Why Stand?, easystand.com, retrieved from the internet, <https://easystand.com/>.
Exoskeleton Report, Exoskeleton Catalog, exoskeletonreport.com, retrieved from the internet, <https://exoskeletonreport.com/product-category/exoskeleton-catalog/>.
Exoskeleton Report, What is an exoskeleton?, Exoskeleton Report LLC, retrieved from the internet, <https://exoskeletonreport.com/what-is-an-exoskeleton/>.
Indego, Powering People Forward, Parker Hannifin Corporation, retrieved from the internet, <https://www.indego.com/indego/us/en/home>.
Lokomat, Intensive Rehabilitation, Hocoma DIH Medical, retrieved from the internet, <https://www.hocoma.com/us/solutions/lokomat/>.
Meywalk, Meywalk 2000 Basic System, adaptive Mall, retrieved from the internet, <https://www.adaptivemall.com/meywalk-2000-basic-system.html>.
PhysioGait, PhysioGait Dynamic Unweighting Sytem, HealthCare International, retrieved from the internet, <http://www.hcifitness.com/Physiogait?gclid=EAIaIQobChMI7-bj3-rk-AIVIQ6tBh1QqAMfEAAYASAAEgK5pvD_BWE>.
Potts, L, Introduction to the E-Pacer, Rifton, retrieved from the internet, <https://www.rifton.com/resources/webinars/2018/e-pacer-inservice>.
Rewalk, More than Walking, ReWalk Robotics, retrieved from the internet, <https://rewalk.com/>.
Sportsart, Icare: Intelligently Controlled Assistive Rehabilitation Elliptical, retreived from the internet, https://www.gosportsart.com/product/icare/.
SuitX, Phoenix Receives FDA Approval, SuitX, rerieved from the internet, <https://www.suitx.com/phoenix-medical-exoskeleton>.
Tram, Three powerful functions in one device, Community Products, LLC dba Rifton Equipment, retrieved from the internet, <https://www.rifton.com/products/lift-and-transfer-devices/rifton-tram>.

* cited by examiner

1901

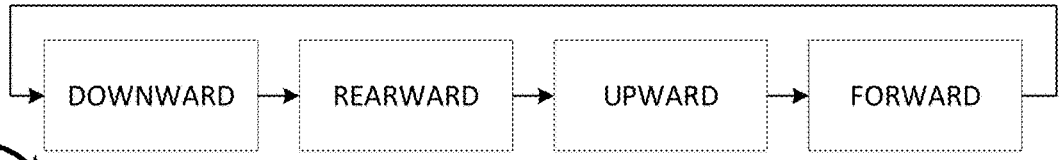

1902

| | | | | |
|---|---|---|---|---|
| **Pivot Arm** | 270° (downward) | 180° (rearward) | 90° (upward) | 0° (forward) |
| **Rocker Arm** | Max neg slope | Rear extent, neg slope | Max pos slope | Horizontal |
| **Lower Arm** | Vertical | Pos slope | Max pos slope | Slight pos slope |
| **Foot Rest** | Lower extent, Horizontal | Rear extent, neg slope | Upper extent, neg slope | Forward extent, slight neg slope |

NOTE:
* Angles and rocker arm and foot rest slopes relative to +X axis (towards front of UBEGT).
* Upper arm and lower arm slopes relative to +Y axis.

1903

OPPOSITE LEG:

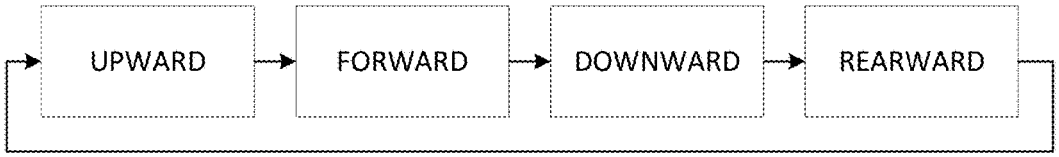

FIG. 19B

EXEMPLARY UBEGT DEPLOYMENT

5400

EXEMPLARY DASHBOARD

5405

UPPER BODY GAIT ERGOMETER AND GAIT TRAINER

CROSS-REFERENCE TO RELATED APPLICATIONS

This application claims the benefit of U.S. Application Ser. No. 63/130,568, titled "UPPER BODY GAIT ERGOMETER AND GAIT TRAINER," filed by Alan Tholkes, et al., on Dec. 24, 2020.

This application incorporates the entire contents of the foregoing application(s) herein by reference.

The subject matter of this application may have common inventorship with and/or may be related to the subject matter of the following: U.S. application Ser. No. 14/529,568, titled "Multi-Modal Gait-Based Non-Invasive Therapy Platform," filed by Tholkes, et al., on Oct. 31, 2014; U.S. application Ser. No. 15/358,613, titled "Natural Assist Simulated Gait Adjustment Therapy System," filed by Tholkes, et al., on Nov. 22, 2016; PCT Application Serial No. PCT/US14/63487, titled "Multi-Modal Gait-Based Non-Invasive Therapy Platform," filed by Tholkes, et al., on Oct. 31, 2014; U.S. application Ser. No. 16/381,800, titled "Natural Assist Simulated Gait Adjustment Therapy System," filed by Tholkes, et al., on Apr. 11, 2019; U.S. application Ser. No. 17/105,843, titled "Natural Assist Simulated Gait Adjustment Therapy System," filed by Tholkes, et al., on Nov. 27, 2020; PCT Application Serial No. PCT/US17/46788, titled "Natural Assist Simulated Gait Adjustment Therapy System," filed by Tholkes, et al., on Aug. 14, 2017; U.S. application Ser. No. 16/153,393, titled "Natural Assist Simulated Gait Adjustment Therapy System," filed by Tholkes, et al., on Oct. 5, 2018; U.S. application Ser. No. 17/105,843, titled "Natural Assist Simulated Gait Adjustment Therapy System," filed by Tholkes, et al., on Nov. 27, 2020; U.S. Application Ser. No. 61/915,834, titled "Natural-Gait Therapy Device," filed by Tholkes, et al., on Dec. 13, 2013; U.S. Application Ser. No. 62/374,383, titled "Natural Assist Simulated Gait Therapy Adjustment System," filed by Tholkes, et al., on Aug. 12, 2016; and U.S. Application Ser. No. 62/569,378, titled "Natural Assist Simulated Gait Therapy Adjustment System," filed by Tholkes, et al., on Oct. 6, 2017.

This application incorporates the entire contents of the foregoing application(s) herein by reference.

TECHNICAL FIELD

Various embodiments relate generally to natural gait therapy.

BACKGROUND

In the US alone, there are approximately 2.3 million individuals with Multiple Sclerosis, and over 10,000 new cases per year. Similarly, 6.8 million US residents have suffered a stroke, with over 700,000 new cases per year. In the US there are approximately 1 million people with Parkinson's Disease, with over 50,000 new cases per year. Approximately 275,000 people in the use suffer from spinal cord injuries with over 12,000 new cases per year. Many of these individuals lose their mobility due to disease or injury.

One of the largest segments of individuals who are mobility impaired are seniors. In the US, there are over 10 million seniors who are mobility impaired because of aging, and the influx of older individuals is growing rapidly. The number of people worldwide is considerably larger yet.

Individuals who are paralyzed and use a wheelchair may not be able to stand or walk without assistance. individuals who can walk with an assistive device such as a walker or cane may have limited strength and may be in danger of falling without assistance. Studies have confirmed many health benefits related to standing and walking. Such benefits include, by way of example and not limitation: improved muscle strength and balance, improved cardiovascular and pulmonary function, increased bone density, improved blood pressure, improved blood sugar levels, improved blood lipid profile, reduced dementia risk, improved mental health, improved joint function, improved range of motion, better maintained body weight, lowered risk of obesity, and various combinations thereof. When individuals stop or greatly reduce their standing and walking because of physical limitations their health can be adversely impacted. Lack of mobility is the cause of many health problems and loss of independence. To enjoy the health benefits of walking, it is recommended that individuals should regularly walk daily.

SUMMARY

Apparatus and associated methods may relate a to natural gait upper body ergometer and gait therapy (UBEGT) device having a support frame within which is suspended rotationally coordinated left and right natural gait modules (NGMs). A position of each NGM may be defined by corresponding left and right pivot arms which are rotatably coupled to a left and right side of the support frame, respectively, and wherein each gait training module is provided with a corresponding foot support and knee support. The UBEGT may be provided with an upper body ergometer (UBE) rotatably coupled to a front of the support frame and configured to rotate a shaft rotatably connected to the left and right pivot arms when a hand crank is rotated.

The UBEGT may be provided with an abdominal support and a releasable back support. The UBEGT may be provided with a walk control module provided with a boarding mode and a walking mode, wherein in a boarding mode, the walk control module (1) co-aligns the left and right pivot arms such that the corresponding knee supports and foot supports are aligned adjacent to one another, respectively, (2) decouples the UBE from the NGMs, and (3) locks the NGMs substantially motionless, and wherein in a walking mode the walk control module (1) rotates the pivot arms 180° relative to one another, (2) unlocks the NGMs, and (3) releasably couples the ergometer to the NGMs. Each gait training module includes an upper arm rotatably connected at a proximal end to the support frame, and a lower arm connected at a proximal end to a distal end of the upper arm by a pivot joint, wherein a corresponding foot support is coupled to a distal end of the lower arm in a static orientation relative to the lower arm, and wherein the pivot joint interacts with the proximal end of the lower arm to limit rotation of a longitudinal axis of the lower arm between a first angle and a second angle relative to a longitudinal axis of the upper arm. The first angle may be zero.

The rear support module may include a lifting member, a lifting actuator, a rotating lifting shaft, and a lifting strap. The lifting shaft may laterally traverse the front of the support frame and may be releasably and rotationally coupled to the support frame. The lifting member may be coupled at a proximal end to the lifting shaft and extend therefrom toward a rear of the support frame. Two ends of the lifting strap may releasably couple to a distal end of the lifting member, such that when the lifting actuator causes the lifting shaft to rotate in a first rotational direction, the lifting member rotates upwards and toward the front of the support frame, translating the lift strap from a sitting position rearward of the support frame into a standing position within the support frame and above the sitting position. The rear support module may include a back support element rotatably coupled to a side of the support frame and extending rearward therefrom, The rear support module may further include an actuation element configured to, when activated, rotate the back support element towards the support frame.

The UBEGT may be provided with a transport mode. In a transport mode, the UBE may rotates downwards to be substantially contained within the support frame.

A gait-therapy system may include a display element, a processor, and a UBEGT provided with at least one angular position sensor. The processor may be configured to (1) select a predetermined image from a finite number of images representing sequential stages in a complete gait cycle, the predetermined image corresponding to a current angular position signal received from the rotation sensor, and (2) to display the selected predetermined image on the display element. The gait-therapy system may further include a functional electrical stimulation module configured to activate at least one electrode at the predetermined angular position signal. The predetermined image may represent activation of the at least one electrode to the user.

The gait therapy system may be provided with at least one activity sensor. The processor may be configured to monitor an output signal of the at least one activity sensor and determine a therapy score as a function of the output signal. The processor may further be configured to transmit the score to a remote device via the communication module. The processor may be configured to receive at least one user profile and an associated therapy score from a remote device via the communication module and to generate a representation of the at least one profile and the associated therapy score on the display element simultaneously with the therapy score determined by the processor.

The details of various embodiments are set forth in the accompanying drawings and the description below. Other features and advantages will be apparent from the description and drawings, and from the claims.

BRIEF DESCRIPTION OF THE DRAWINGS

FIG. 10A is a first sitting step and FIGS. 10B-10C depict a second standing step from rear-right and front-right perspectives, respectively.

FIG. 19B depicts timing of the exemplary linkage assembly of FIG. 19A in an exemplary complete natural gait cycle.

Appendix A depicts exemplary perspective views of various embodiments of a UBEGT in a deployed standing mode.

Appendix B depicts various screens of an exemplary user interface app in an exemplary sequential order.

Appendix C depicts various screens of an exemplary therapist interface app in an exemplary sequential order.

Appendix D depicts various screens of an exemplary administrator interface app in an exemplary sequential order.

Appendix E depicts exemplary app screen sequences and corresponding exemplary data sources.

The entire contents of Appendices A, B, C, D, and E are incorporated herein be reference.

Like reference symbols in the various drawings indicate like elements.

DETAILED DESCRIPTION OF ILLUSTRATIVE EMBODIMENTS

Physically challenged individuals would benefit from a convenient, compact, cost effective, easy to use, and safe device which they can use in their home independently to help them to stand and walk. Such individuals would benefit from a device that can adapt to their physical situation, collect important therapy data, and communicate with their health care professional from home. Further, it is physically and economically advantageous to prevent costly medical problems by proper physical activity, to help people age in place, and avoid costly institutional care.

To aid understanding, this document is organized as follows. First, to help introduce discussion of various embodiments, an exemplary upper body ergometer and gait training (UBEGT) system is introduced with reference to FIG. 1. Second, various embodiments of exemplary UBEGT and modules thereof are presented in relation to FIGS. 2A-47C. Third, with reference to FIGS. 48-49, exemplary circuits and use environments are introduced. Fourth, exemplary methods and associated graphical user interfaces are discussed with reference to FIGS. 50-58. Finally, the document discusses further embodiments, exemplary applications and aspects relating to UBEGTs.

Figure 1:
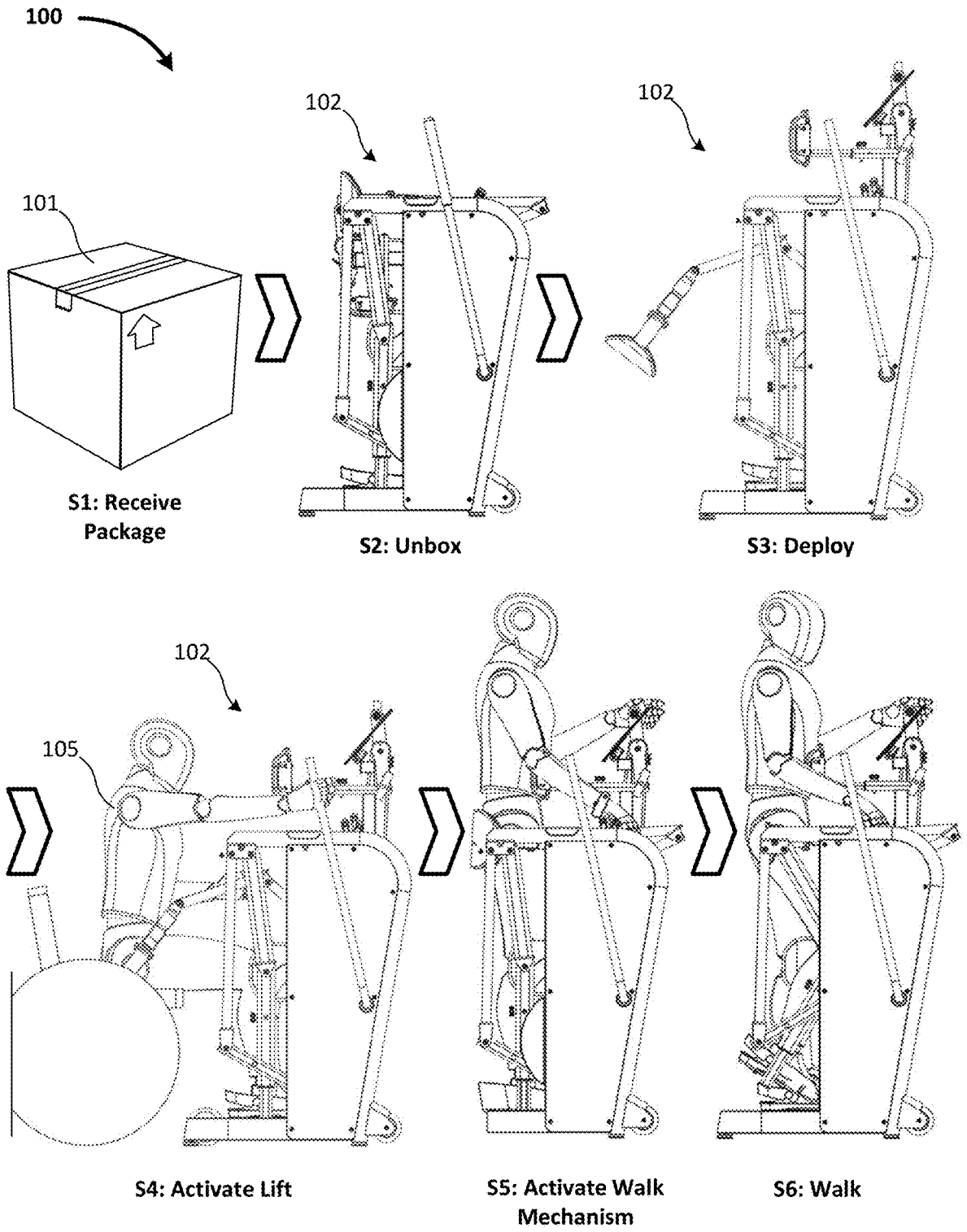
FIG. 1 depicts an exemplary upper body ergometer and gait trainer (UBEGT) employed in an illustrative use-case scenario.

FIG. 1 depicts an exemplary upper body ergometer and gait trainer (UBEGT) employed in an illustrative use-case scenario. In an exemplary first step S1, a recipient may, for example, receive a package 101 containing the exemplary UBEGT in a transport mode. The recipient may, for example, unbox the package 101 in a second step S2 to reveal the UBEGT 102 in a transport mode. The recipient may, for example, assemble a lift module pump handle onto the UBEGT 102, or the lift module pump handle may be shipped pre-assembled in a transport mode. In a third step S3, the recipient may transition the UBEGT 102 into a deployed mode. By way of example and not limitation, the recipient may rotate an upper body ergometer (UBE) upwards out of a cavity defined by a support frame of the UBEGT 102 and into a vertical position. A abdominal module and an interface and control module may, as depicted, be attached to the UBE and be deployed simultaneously therewith. A lifting module may be lowered, as depicted, into a sitting position configured to be positioned under the buttocks of a user. In a fourth step S4, a patient, such as the depicted patient 105 in a wheelchair, may engage their feet and knees in appropriate positions within the UBEGT 102, position the lifting strap under their buttocks, actuate the lift module pump handle, and thus activate the lift module of the UBEGT 102. A walk control module of the UBEGT 102 may, for example, be in a standing mode. In a standing mode, the walk control module may releasably secure left and right natural gait modules (NGMs), including corresponding attached knee and foot supports, in alignment with each other. The walk control module may also releasably secure the left and right NGMs in a predetermined fixed position. Accordingly, a wheelchair bound patient 105 may, for example, advantageously lift themselves from a wheelchair and into a standing position against an abdominal module of the UBEGT 102, even if the patient 105 is not capable of standing unassisted.

In a fifth step S5, the patient 105 may stand within the cavity defined by the support frame of the UBEGT 102. The patient 105 may stand supported, as depicted, by a six-point support system of the UBEGT 102. In the depicted embodiment, the six-point support system supports each of the patient's feet and knees, as well as the patient's buttocks and abdomen. In step S5, the patient may transition a walk control mechanism of the UBEGT 102 from a standing mode to a walking mode and may operate the UBE to drive the left and right natural gait modules. Accordingly, in sixth step S6, the patient 105 may advantageously move, as depicted, in a cyclical natural gait motion (e.g., walking) by operating the left and right NGMs. The patient 105 may, for example, advantageously simulate a natural gait motion by driving the UBE with their upper body (e.g., hands and arms), even if they are incapable of independently moving their feet and/or legs.

In various embodiments, a UBEGT may advantageously provide complete support for a patient in a compact, space-saving frame. A UBEGT may, for example, be advantageously placed in a collapsed transport mode. In the transport mode, for example, various modules and/or elements may be folded within a predetermined three-dimensional space. The predetermined three-dimensional space may, for example, be defined by a support frame of the UBEGT. In a transport mode, the dimensions of the UBEGT may, for example, be advantageously configured to be within a predetermined dimension and/or combination of dimensions (e.g., length, width, height, or combinations thereof) suitable for shipment by one or more preferred carriers.

Figures 2A, 2B, 2C:
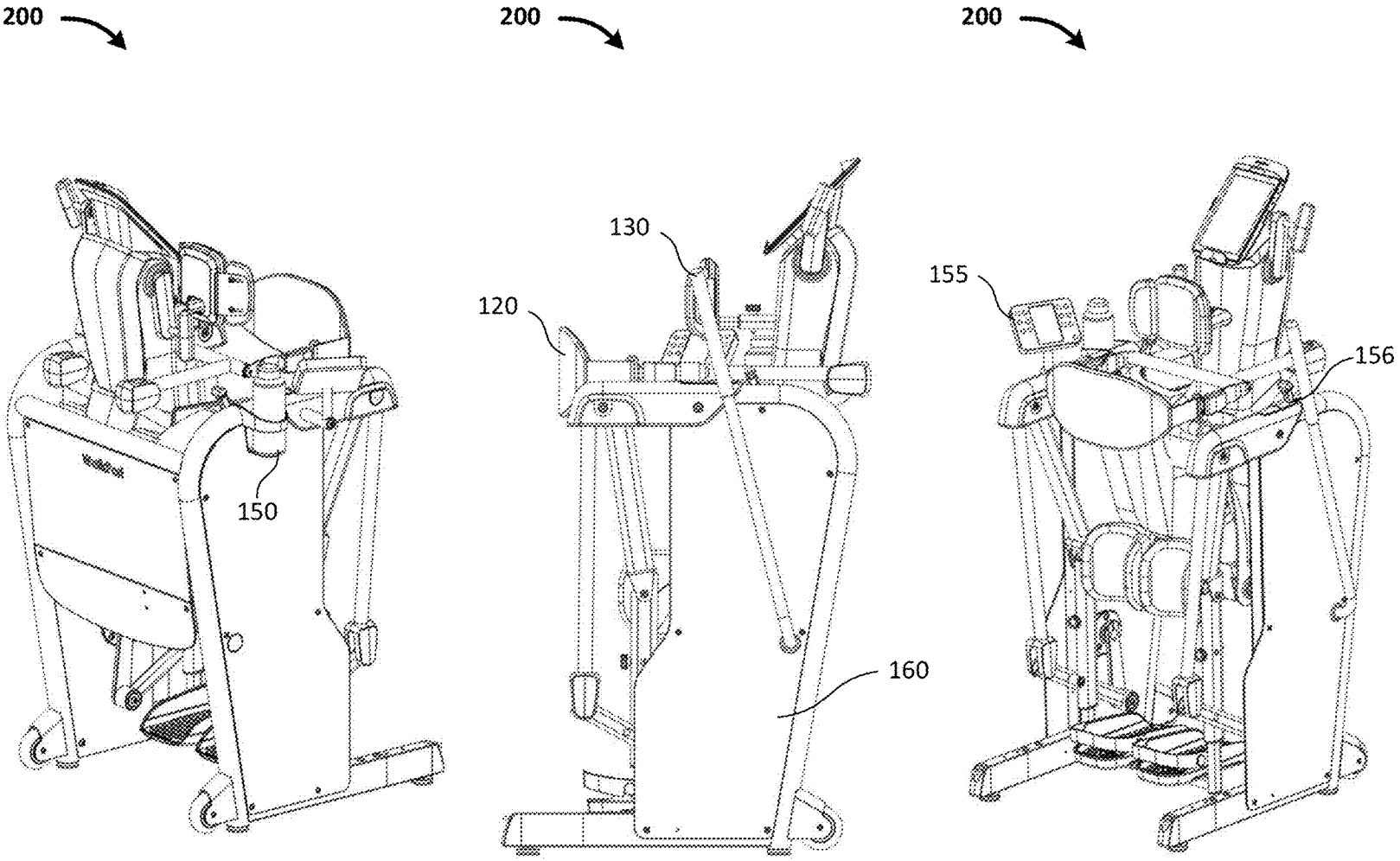
FIG. 2A, FIG. 2B, and FIC. 2C shows an exemplary UBEGT from a front-left perspective, right side perspective, and rear-right perspective, respectively.

FIG. 2A, FIG. 2B, and FIC. 2C shows an exemplary UBEGT from a front-left perspective, right side perspective, and rear-right perspective, respectively. As depicted, the UBEGT 200 is in a deployed mode and is provided with protective and/or aesthetic panels 160. The UBEGT 200 is provided with a manual lift module which may be actuated by lift module pump handle 130. Actuation of pump handle 130 such as, for example, by repetitive pumping, may raise lift strap 120 from a sitting position to the depicted standing position.

UBEGT 200, as depicted, is provided with various modules including, for example, cup holder 150, monitor 155, and left and right sensor panels 156. The sensor panels 156 may, for example, be connected to circuitry and be configured to transduce one or more biometric signals (e.g., heat, pressure). The associated circuitry may, for example, advantageously determine therefrom one or more physiological values such as, by way of example and not limitation, heart rate and/or temperature.

Figures 3A, 3B, 3C:
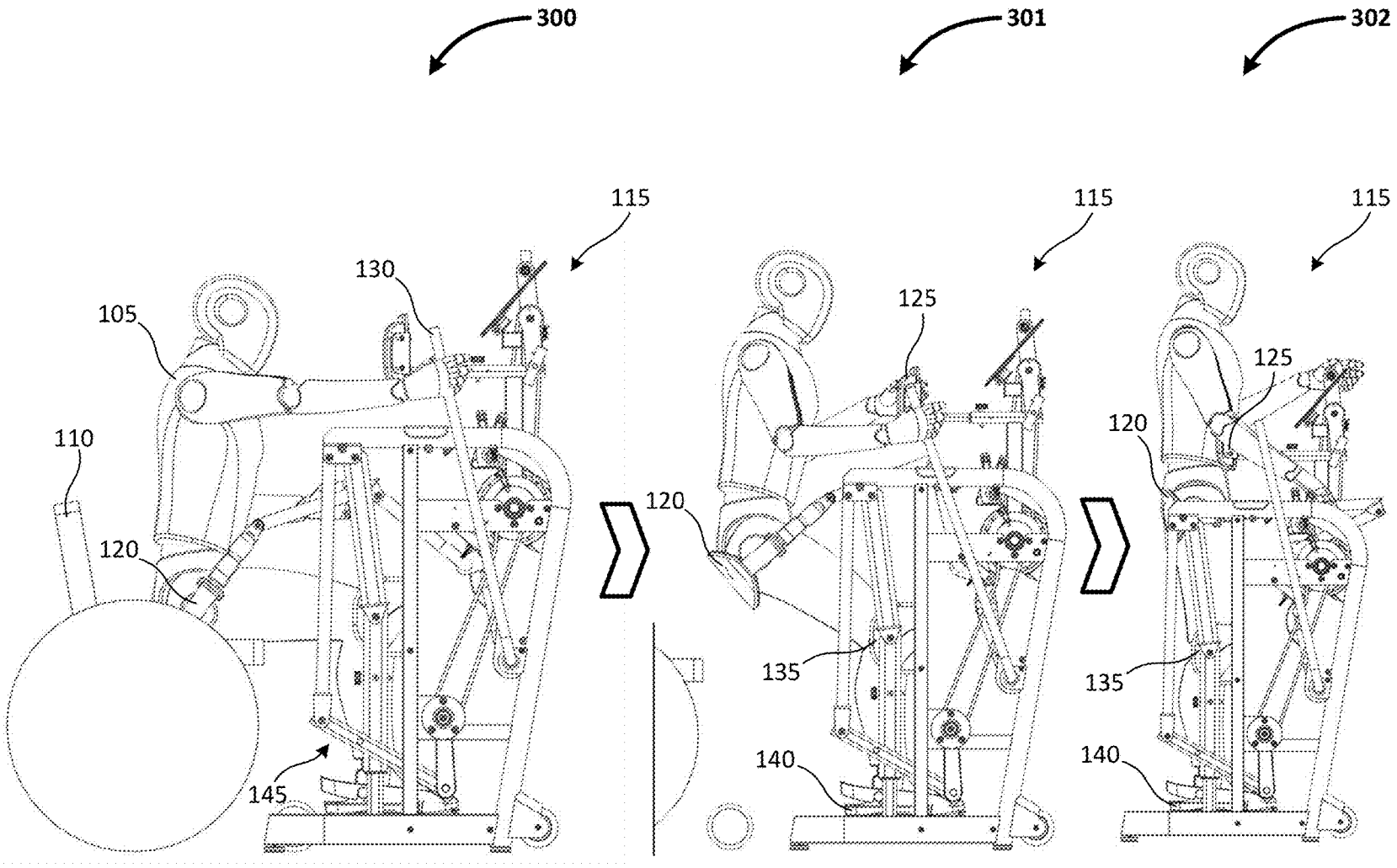
FIG. 3A, FIG. 3B, and FIG. 3C illustrate sequential steps (position, lift, stand, respectively) an exemplary UBEGT equipped with an exemplary lifting module in an exemplary use-case scenario lifting a wheelchair-bound user to a standing position.
Figures 4A, 4B, 4C:
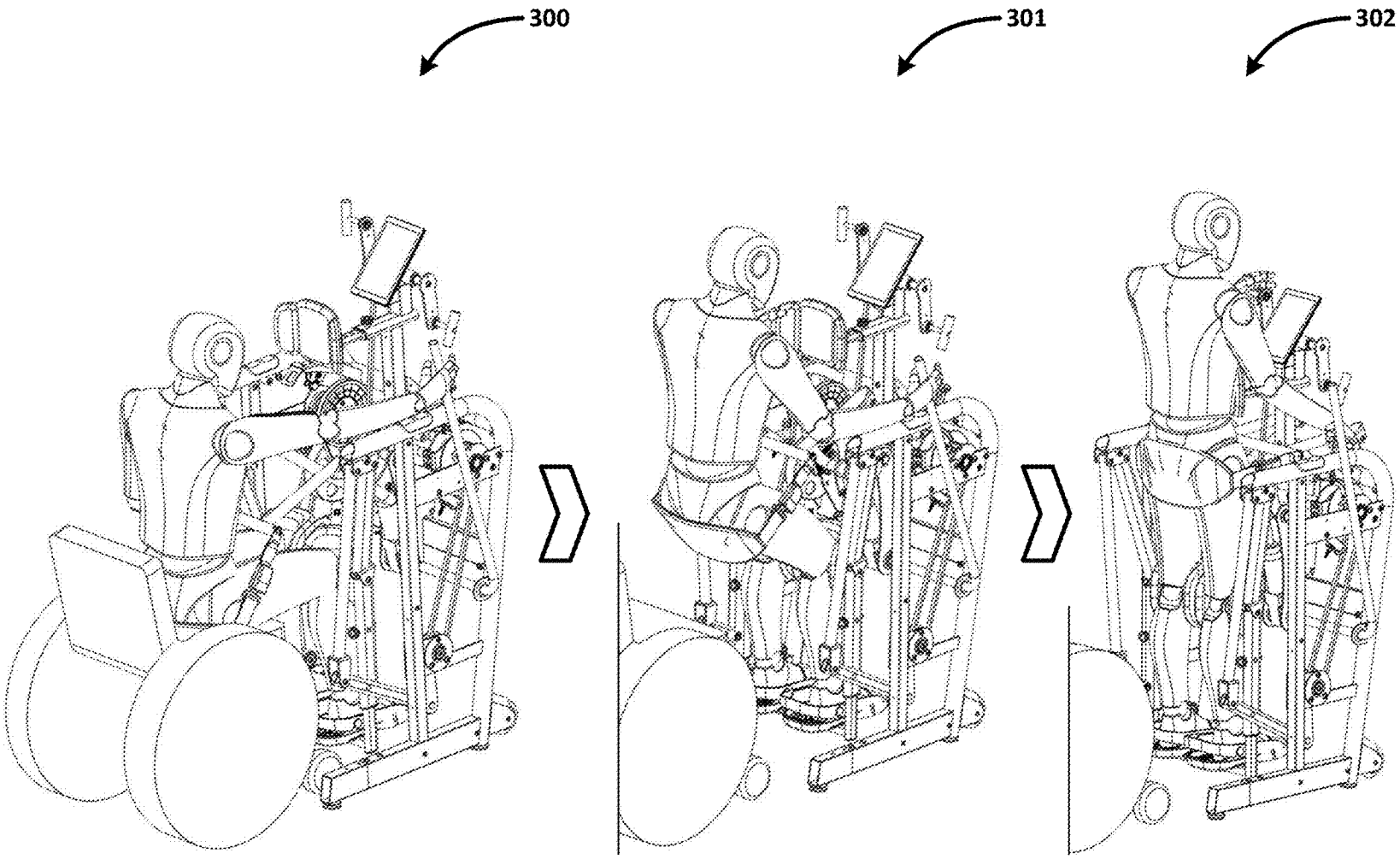
FIG. 4A, FIG. 4B, and FIG. 4C shows the sequential steps of FIGS. 3A-3C from a rear-right perspective.

FIG. 3A, FIG. 3B, and FIG. 3C illustrate sequential steps (position, lift, stand, respectively) an exemplary UBEGT equipped with an exemplary lifting module in an exemplary use-case scenario lifting a wheelchair-bound user to a standing position. FIG. 4A, FIG. 4B, and FIG. 4C shows the sequential steps of FIGS. 3A-3C from a rear-right perspective. In a first phase 300, a UBEGT 115 is in a deployed mode and a lift module is lowered into a sitting mode such that a lift strap 120 is lowered to a wheelchair seat height. The patient 105 in a wheelchair 110 orients themselves in a rear of the UBEGT 115. The patient 105 positions their feet in foot supports 140 and their knees in knee supports 135 (e.g., knee pads, as depicted) of NGMs 145. A walk control module may be, for example, in a standing mode such that the NGMs 145 are co-aligned and releasably locked into a predetermined position. The predetermined position may, for example, be configured to place the foot supports at a lowest position in a gait cycle. The patient 105 further positions a lift strap 120 underneath their buttocks and releasably secures it to mating elements of the lift module.

In a second phase 301, the patient 105 activates lift module pump handle 130 (e.g., by a repetitive pumping motion) to actuate the lift module. The lift module is configured to raise the lifting strap 120 upwards and translate it forwards into the UBEGT 115. As the lifting strap 120 moves (e.g., in a convex arc) upwards and inwards, the patient 105 is thereby lifted. The feet supports 140 and the knee supports 135 retains the patient's lower body in place as the user's upper body is urged towards vertical alignment with their lower legs by the lift strap 120.

In a third phase 302, the lift strap 120 is in a standing position such that the patient 105 is supported in a standing position. The patient's upper body may be substantially vertically aligned, as depicted, with the patient's lower body. The patient is supported from behind by the lift strap 120 and from the front by a abdominal module 125. Accordingly, the patient 105 is supported in at least 6 points: left and right foot supports 140, left and right knee supports 135, lift strap 120, and abdominal module 125. Once in a standing position, the user may operate a walk control module to transition the NGMs 145 from the locked standing mode to a moveable walking mode. Once the walk control module is in a walking mode, the patient 105 may, for example, operate a UBE of the UBEGT 115 to initiate a predetermined cyclical gaited motion of the left and right NGMs 145. Accordingly, a user may advantageously independently position themselves in and operate an exercise and/or therapy device (e.g., a UBEGT), regardless of lower body paralysis.

Figures 5A, 5B, 5C:
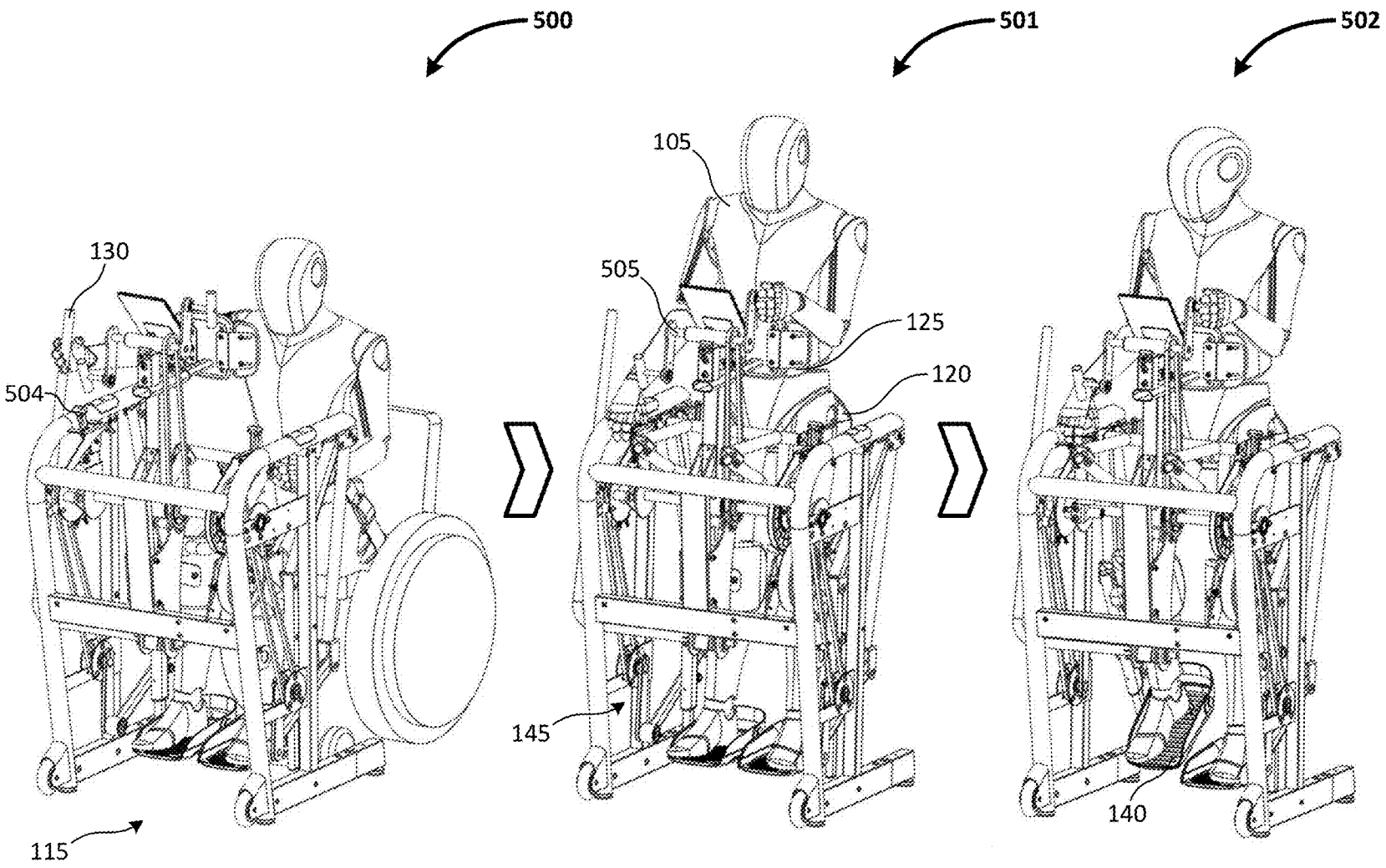
FIG. 5A, FIG. 5B, FIG. 5C illustrate sequential steps (sitting, standing, walking, respectively) an exemplary UBEGT equipped with an exemplary lifting module and walk control module in an exemplary use-case scenario transitioning a sitting user (FIG. 5A) to a standing position (FIG. 5B) and employing an ergometer to initiate gait-training (FIG. 5C).

FIG. 5A, FIG. 5B, FIG. 5C illustrate sequential steps (sitting, standing, walking, respectively) an exemplary UBEGT equipped with an exemplary lifting module and walk control module in an exemplary use-case scenario transitioning a sitting user (FIG. 5A) to a standing position (FIG. 5B) and employing an ergometer to initiate gait-training (FIG. 5C). In a sitting phase 500, a wheelchair-bound patient 105 positions themselves behind the UBEGT 115 as discussed in relation to FIGS. 3A-4C. The patient 105 activates lift pump handle 130 to operate a lift module and raise them into a standing position.

In a standing phase 501, the patient 105 is standing on foot supports 140 of NGMs 145, and is supported by the corresponding knee supports, as well as the lift strap 120 and abdominal module 125. The patient 105 operates a stand-to-walk lever 504 of the walk control module, which may transition the NGMs from the locked standing mode to an unlocked walking mode. The patient 105 operates UBE 505, such as by rotating the depicted handles, to operate a drive module. The drive module may impart a cyclical gaited motion to the left and right NGMs 145. By way of example and not limitation, the walk control module may cause the walk drive modules to differentially rotate until they are at a predetermined (e.g., 180-degree) phase offset relative to each other in the predetermined gait cycle. Once the left and right NGMs 145 are at a predetermined relative phase offset, the walk control module may synchronize them by, for example, locking them into a relative position relative to one another.

In a walking phase 502, the walk control module has fully transitioned the NGMs 145 from the standing mode to the phase-offset walking mode. The patient 105 may, for example, move their feet and legs to directly operate the NGMs 145 and/or may operate UBE 505 to continue to operate the drive module and, thereby, the NGMs 145. Accordingly, patients of various abilities may, for example, advantageously engage and operate a UBEGT. Patients of varying disability levels may, for example, advantageously independently engage in exercise and/or therapy.

Figures 6A, 6B, 6C:
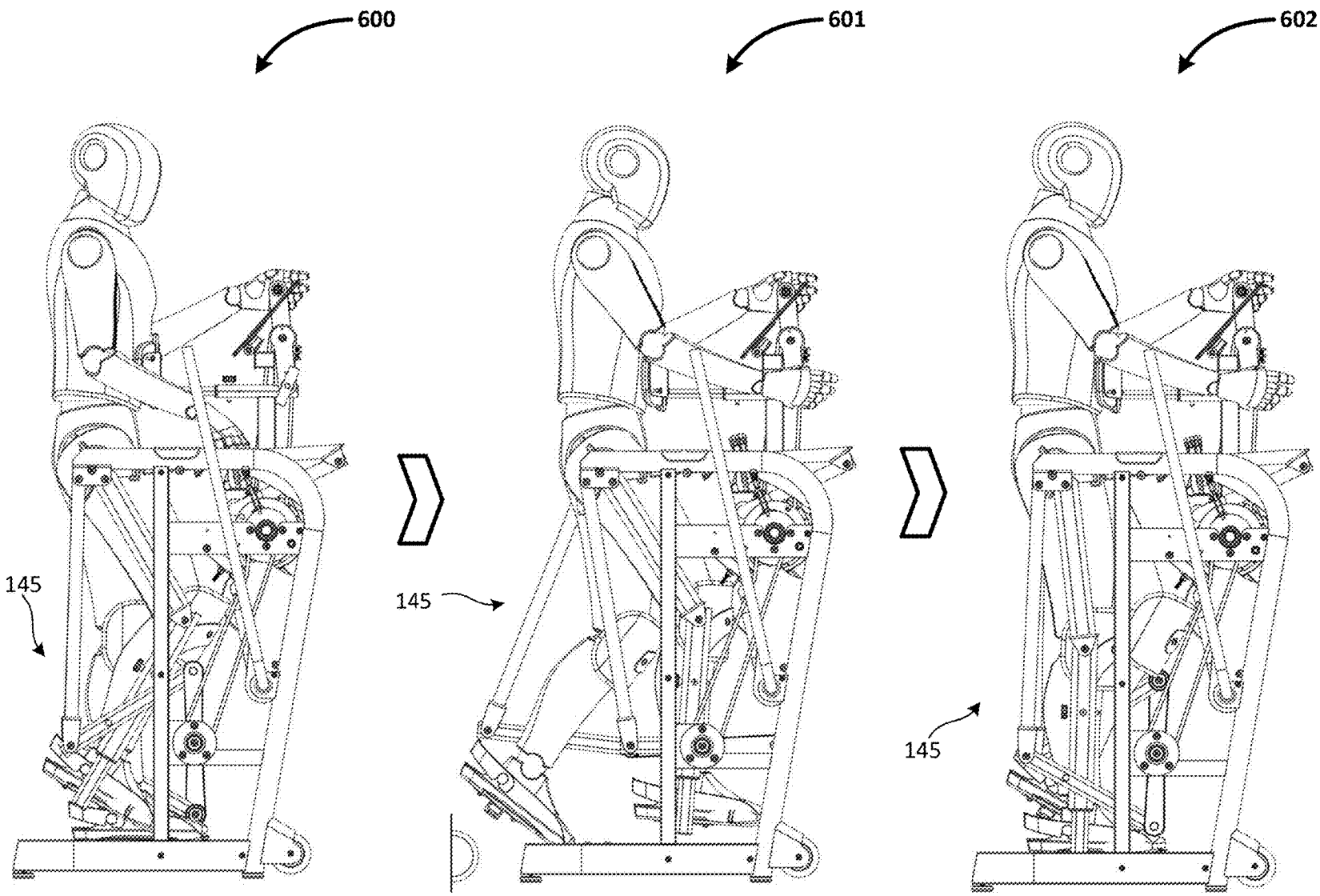
FIG. 6A, FIG. 6B, and FIG. 6C illustrate sequential motion in a gait-training cycle of the exemplary UBEGT depicted in FIGS. 3A-4C.
Figures 7A, 7B, 7C:
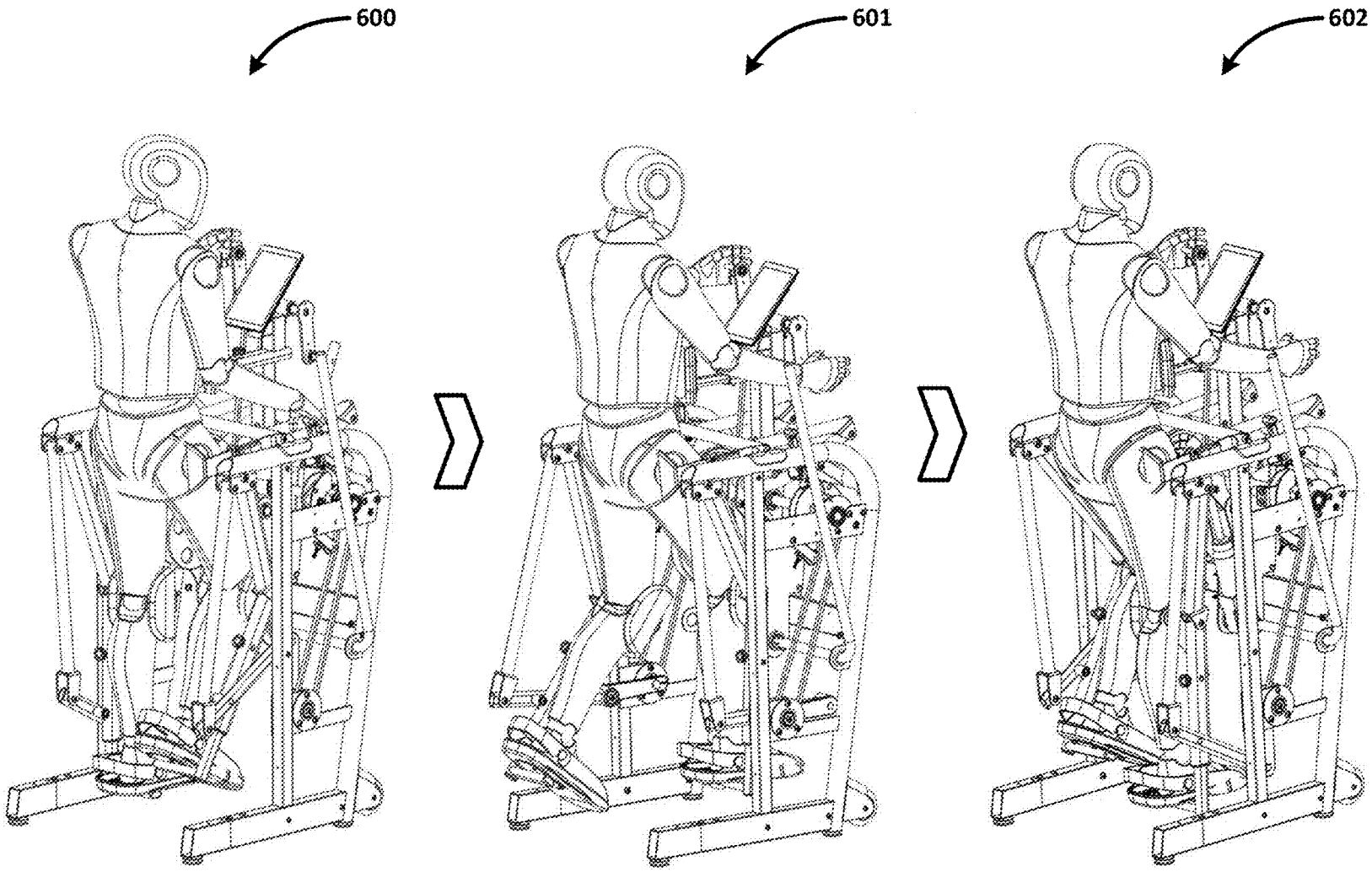
FIG. 7A, FIG. 7B, and FIG. 7C illustrate the sequential motion of FIGS. 6A-6C from a right-rear perspective.

FIG. 6A, FIG. 6B, and FIG. 6C illustrate sequential motion in a gait-training cycle of the exemplary UBEGT depicted in FIGS. 3A-4C. FIG. 7A, FIG. 7B, and FIG. 7C illustrate the sequential motion of FIGS. 6A-6C from a right-rear perspective. As depicted, in a first phase 600 (which may, for example, be an initial phase or may be subsequent to an initial phase) of a predetermined gait cycle, the left NGM 145 is in a substantially vertical position, which may correspond to a loading response (foot flat) phase of the patient's left foot. The right NGM 145 is in an angled configuration which may correspond to a toe-off phase of the patient's right foot.

In a second phase 601, the left NGM 145 is positioned substantially at a rear extent, which may correspond to a terminal stance phase of the left leg. The right NGM 145 is positioned substantially at a forward extent, which may correspond to tibial vertical phase of the right foot as it prepares to enter a terminal swing phase. In a third phase 602, the left NGM 145 is positioned such that the left knee support is forward of the right knee support and the left foot support is rearward and pivoted toe down relative to the right foot support. The configuration of the left NGM 145 may correspond to an initial swing phase of the left foot prior to the left foot passing the right foot. The right NGM 145 is in a substantially vertical position which may correspond to mid-stance phase of the right foot. Accordingly, various embodiments may advantageously simulate a natural bipedal gait cycle.

Figures 8A, 8B, 8C:
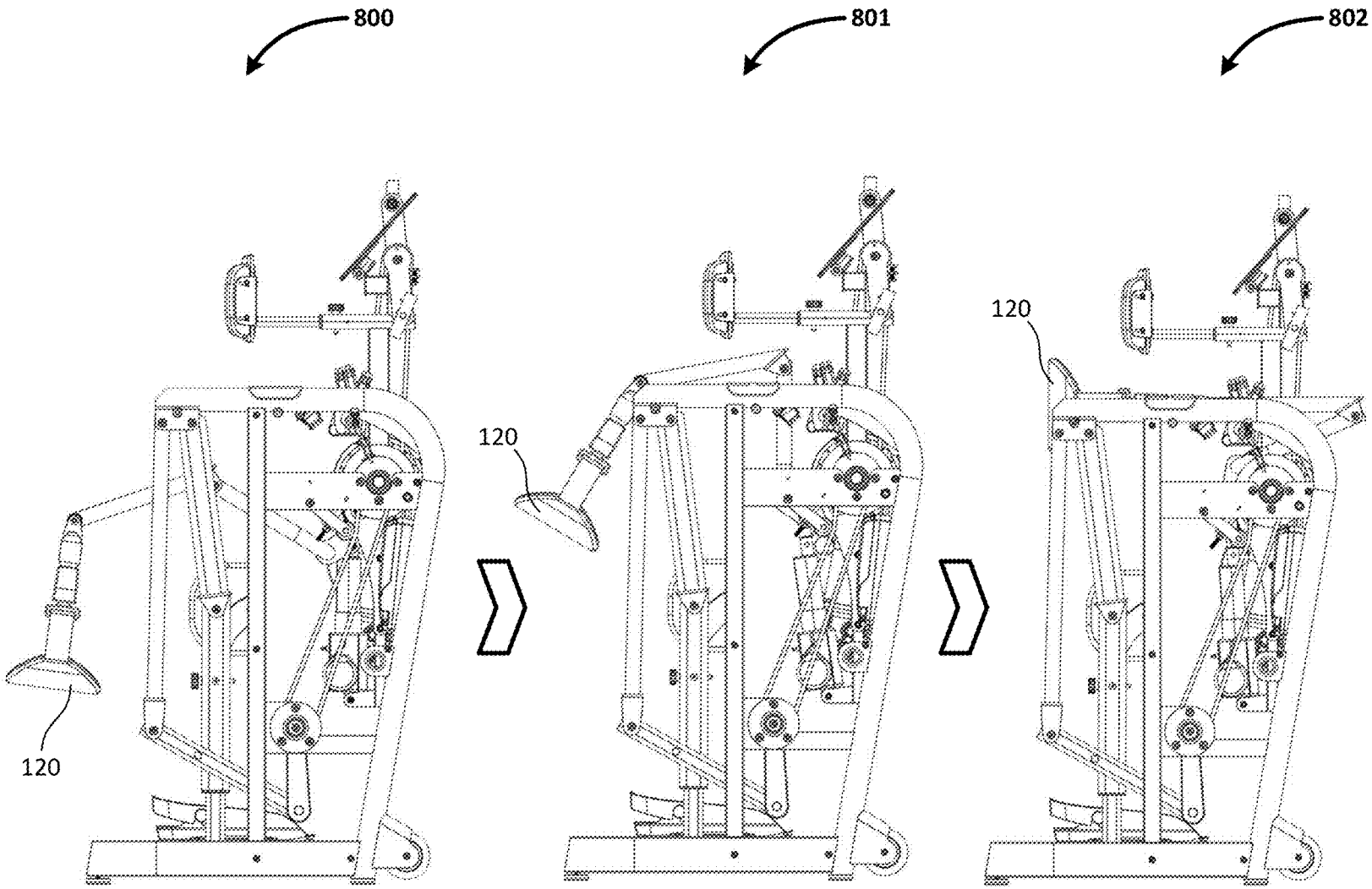
FIG. 8A, FIG. 8B, and FIG. 8C illustrate an exemplary UBEGT equipped with an exemplary electric lift module in sequential steps of sitting (FIG. 8A), lifting (FIG. 8B), and standing (FIG. 8C).
Figure 8F:
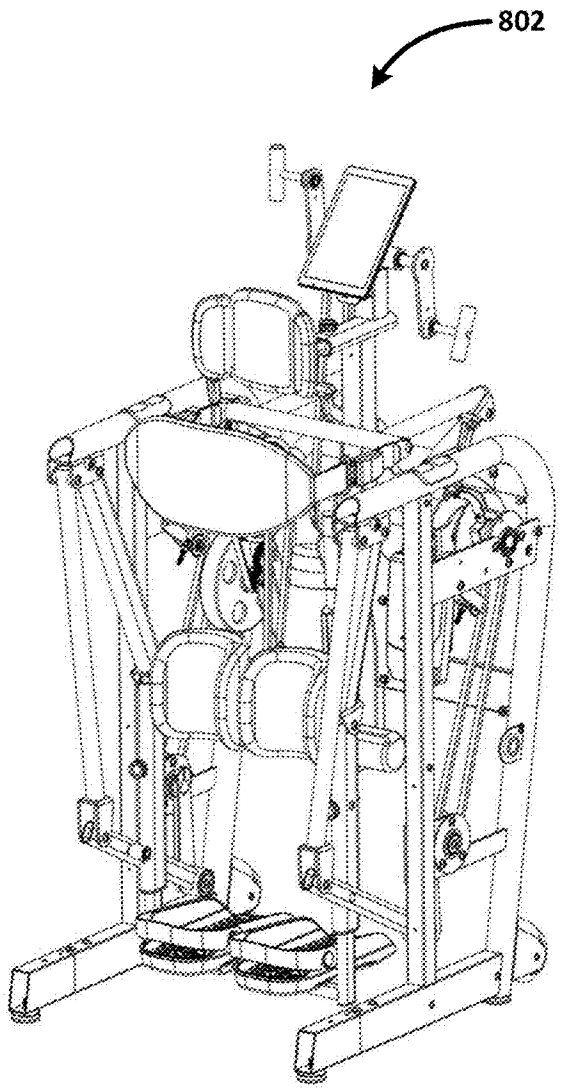
FIG. 8D, FIG. 8E, and FIG. 8F illustrate the sequential steps of FIGS. 8A-8C from a right-rear perspective.
Figure 8E:
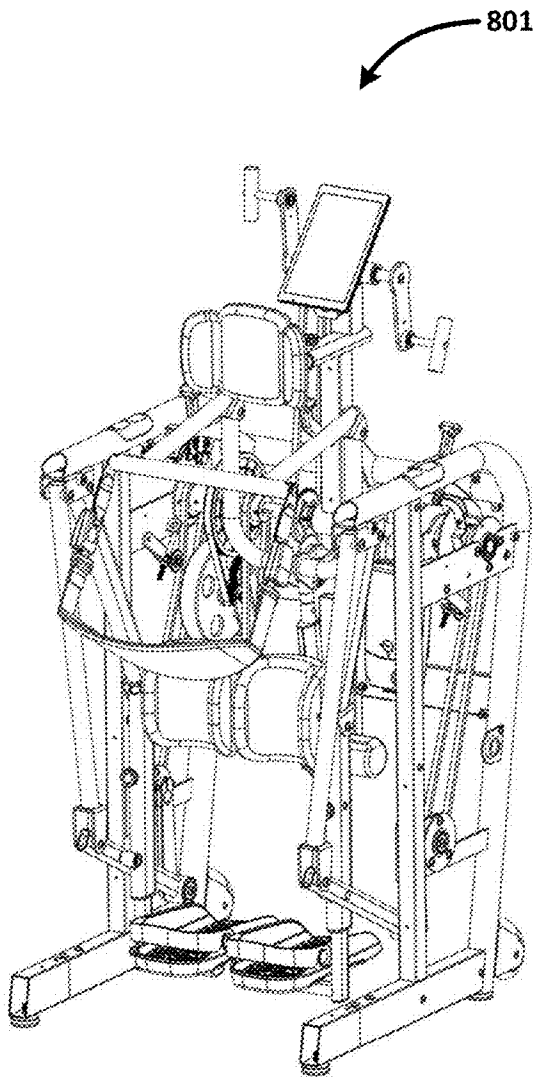
Figure 8D:
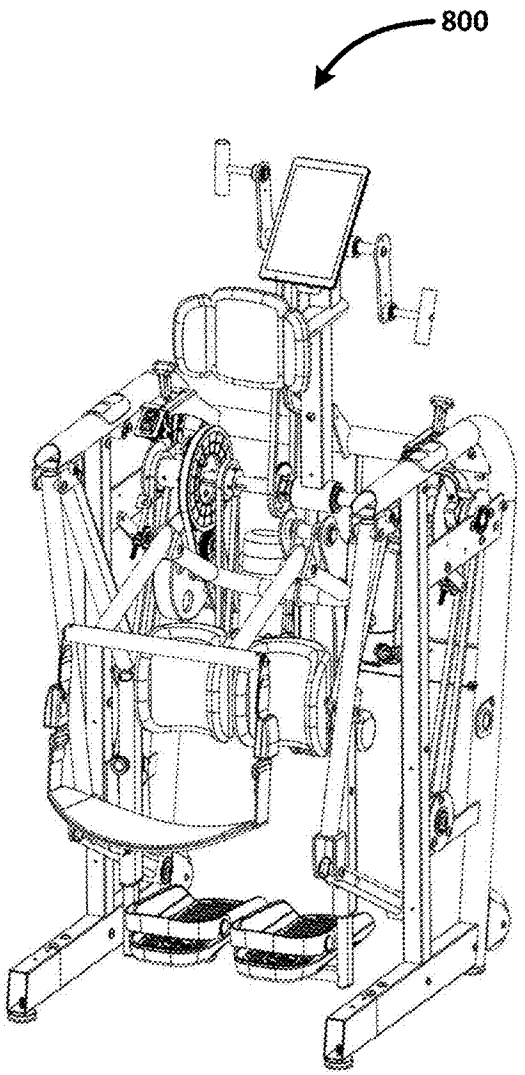
Figure 8H:
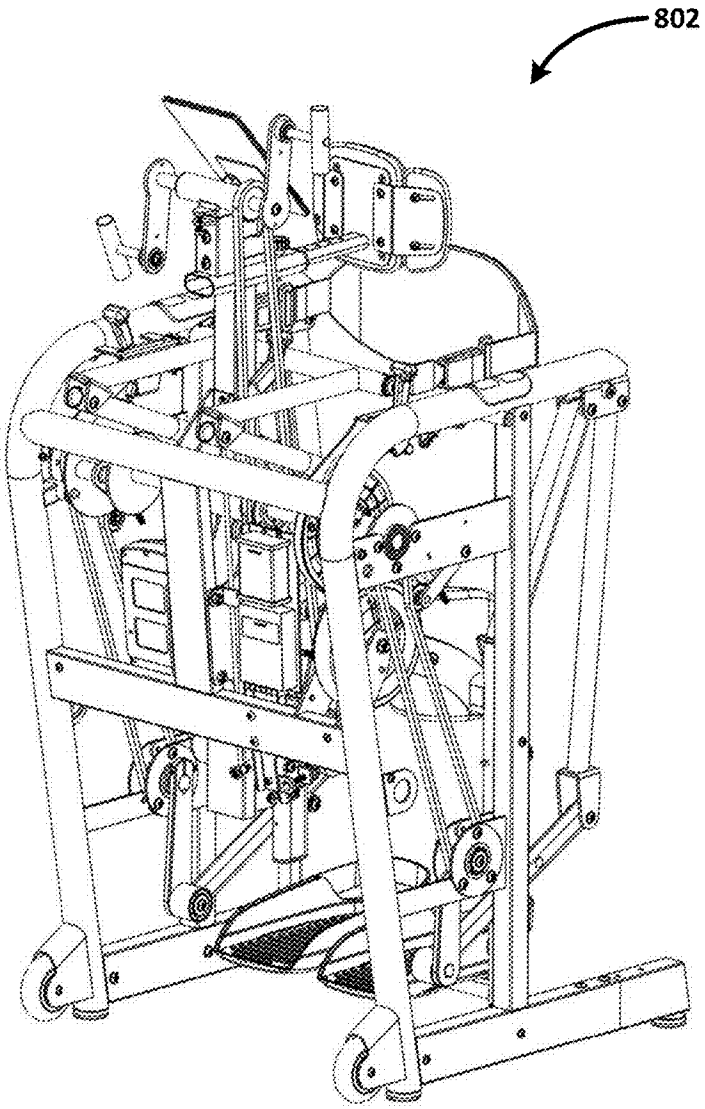
FIG. 8G depicts the first sequential step (FIG. 8A) from a front-right perspective and FIG. 8H depicts the last sequential step (FIG. 8C) from a front-left perspective.
Figure 8G:
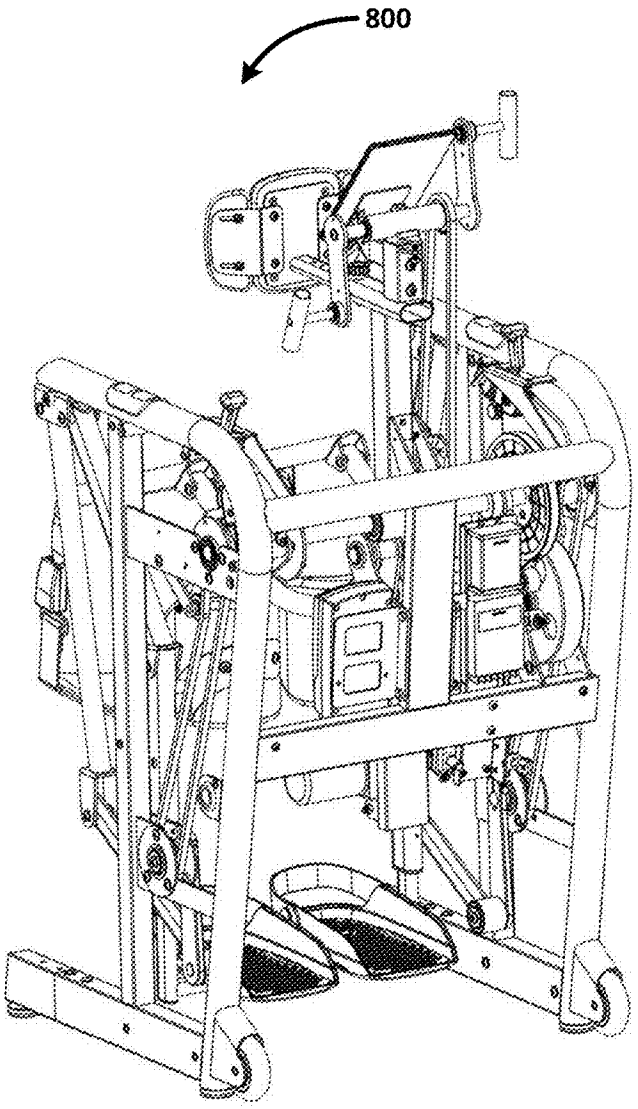

FIG. 8A, FIG. 8B, and FIG. 8C illustrate an exemplary UBEGT equipped with an exemplary electric lift module in sequential steps of sitting (FIG. 8A), lifting (FIG. 8B), and standing (FIG. 8C). FIG. 8D, FIG. 8E, and FIG. 8F illustrate the sequential steps of FIGS. 8A-8C from a right-rear perspective. FIG. 8G depicts the first sequential step (FIG. 8A) from a front-right perspective and FIG. 8H depicts the last sequential step (FIG. 8C) from a front-left perspective. The lift strap begins in a sitting position 800. As a lift unit is activate, the lift strap 120 is raised upwards and brought inwards through an intermediate position 801 and from thence to a standing position 802.

As depicted, in a standing position the rear strap is below a abdominal module and within a footprint of the support frame of the UBEGT. Accordingly, various embodiments may advantageously raise a patient from a sitting to a standing position. Various embodiments may advantageously support a patient in a standing position such that the user is supported with a center of gravity continually within a footprint of the UBEGT.

Figures 9A, 9B:
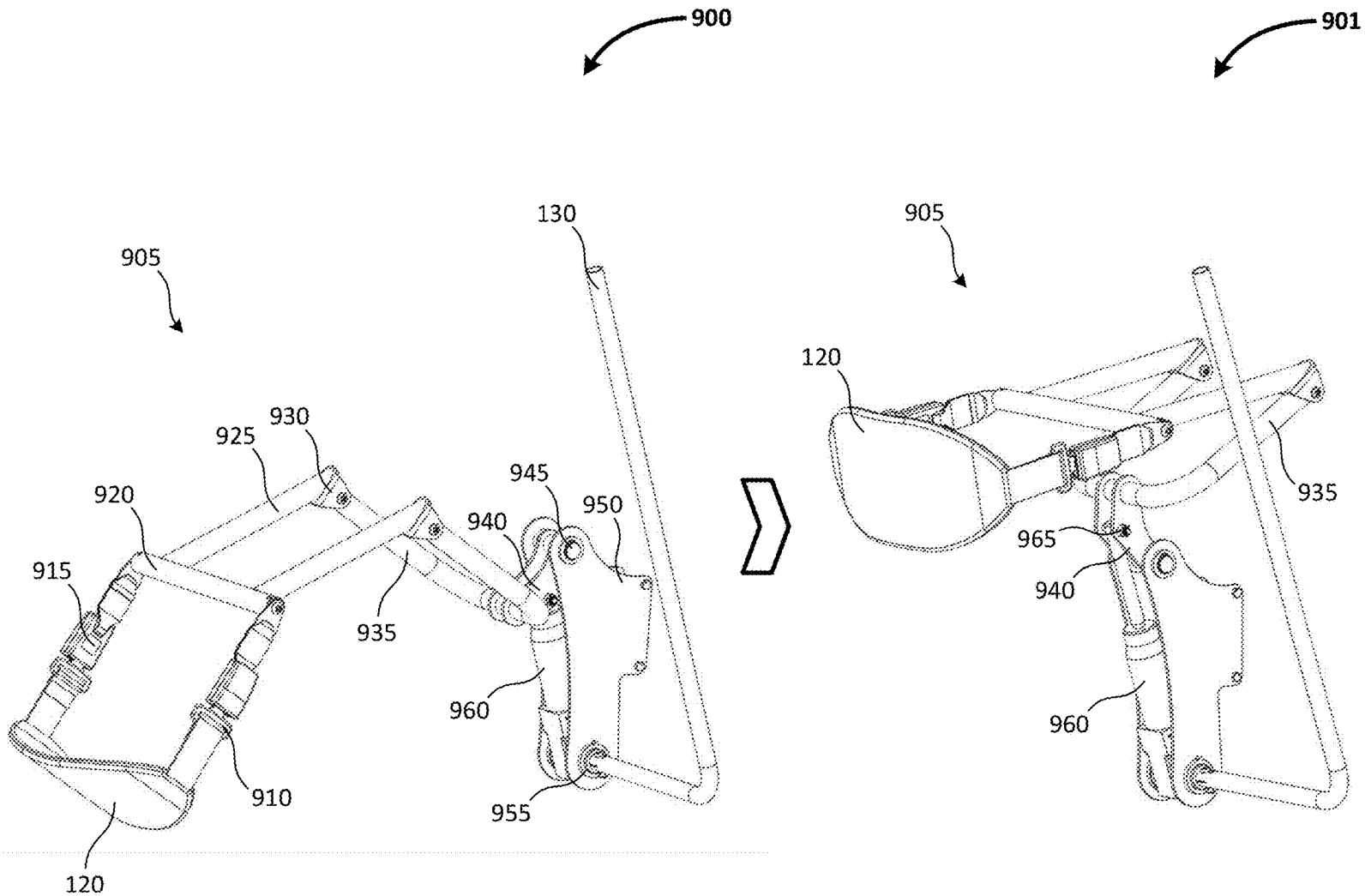
FIG. 9A and FIG. 9B depict sequential steps (sitting and standing, respectively) of an exemplary manual hydraulic lift module in an isolated view.

FIG. 9A and FIG. 9B depict sequential steps (sitting and standing, respectively) of an exemplary manual hydraulic lift module in an isolated view. The lift module 905 may be coupled to a UBEGT by bracket 950. The bracket is provided with a first, lower pivot joint 955 and a second, upper pivot joint 945. A proximal end of a hydraulic actuator 960 is rotatably coupled to the lower pivot joint 955. A distal end of the hydraulic actuator 960 is rotatably coupled to the rocker element 940 at pivot joint 965. Rocker element 940 is rotatably coupled at a proximal end to the bracket 950 via the upper pivot joint 945. In the depicted implementation, rocker element 940 is fixedly coupled at a distal end to lifting yoke 935. Lifting yoke 935 may be unitarily formed into the depicted U-shape. First and second ends are rotatably coupled by first and second pivot brackets 930 to corresponding lifting arms 925 which are connected by cross-piece 920. First and second coupling elements 915 (e.g., buckle receptacles, as depicted) are coupled to a first and second end of cross-piece 920. Coupling elements 915 releasably couple to third and fourth coupling elements 910 (e.g., buckle inserts). Coupling elements 910 are coupled to lifting strap 120.

When pump handle 130 is operated (e.g., in a repetitive pumping motion) when the lift module is in a sitting configuration 900, the hydraulic actuator 960 extends along a longitudinal axis, as depicted in standing configuration 901. Axial extension of the hydraulic actuator 960 causes the rocker element 940 to rotate upwards around upper pivot joint 945 of the bracket 950. As the rocker element 940 rotates upwards, the distal end of the rocker element 940 defines an arc about pivot joint 945. Accordingly, the lifting yoke 935 likewise moves in an arc about pivot joint 945. During a first portion of the arc, as the lifting yoke rotates clockwise (when viewed from the left side, as depicted), the lifting arms 925 rotate on pivot brackets 930 relative to the lifting yoke 935. At a predetermined angle of the lifting arms 925 to the yoke 935, flats of the pivot brackets 930 engage yoke 935 such that the pivot brackets 930 restrain further rotation of the lifting arms 925 relative to the yoke 935.

As depicted, the lifting yoke is coupled to the rocker element 940 at a predetermined angle thereto. The predetermined angle, together with the length of the yoke 935 and/or dimensions of the various elements, is configured to initially impart to the lifting strap a predominantly lifting motion, followed by a lifting and forward (inward towards the front of the UBEGT) motion, followed by a predominantly forward motion (e.g., bringing the now standing or nearly standing patient against an abdominal module and safely within the support frame of the UBEGT. Furthermore, as seen in FIG. 9B, the acute angle at pivot brackets 930 between the yoke 935 and the lifting arms 925 puts force applied against the lifting strap 120 into near alignment with the arms of the lifting yoke 935. Accordingly, the acute angle may reduce the lever arm available to amplify the force applied against the lifting strap 120. Therefore, the configuration may advantageously reduce the forces on the various elements and joints including, for example, pivot joints 965, 955, and 945, bracket 950, and hydraulic actuator 960. Accordingly, the predetermined angle may advantageously increase safety and/or reduce costs.

Figure 10B:
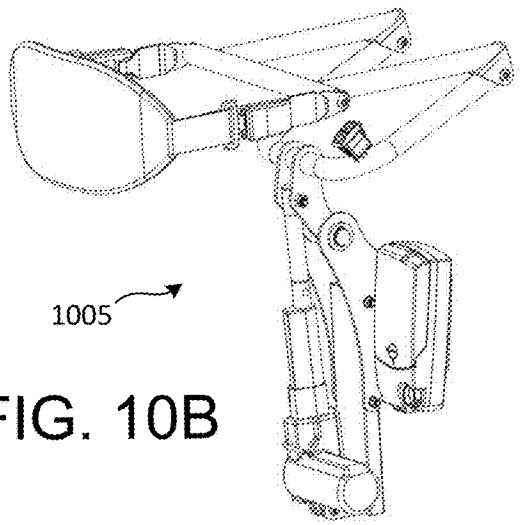
FIG. 10A, FIG. 10B, and FIG. 10C depict sequential steps of an exemplary electric lift module in an isolated view, where
Figure 10C:
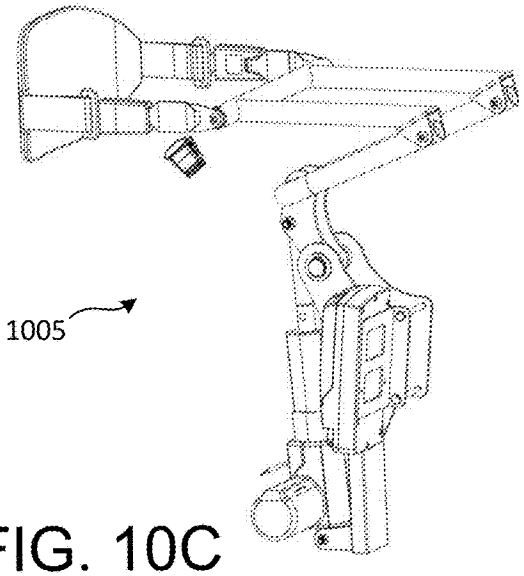
Figure 10A:
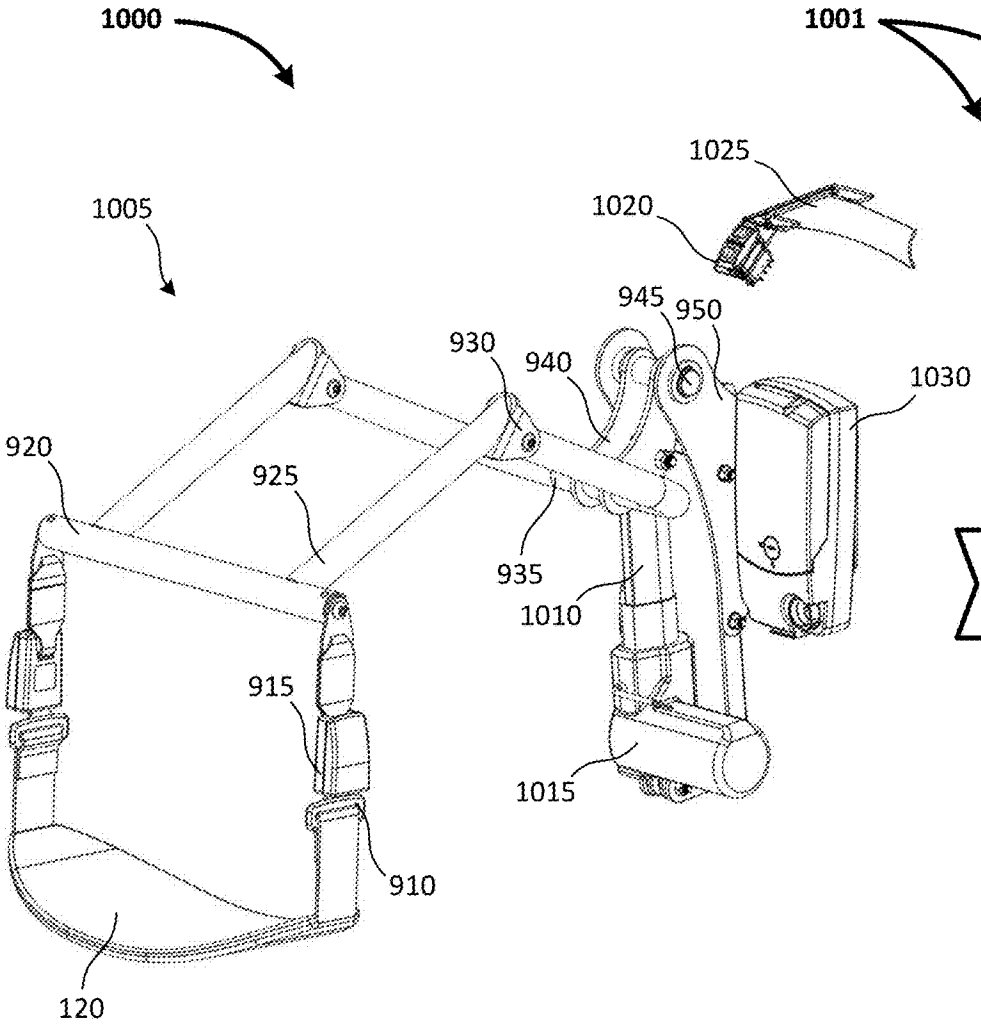
Figures 11A, 11B, 11C, 11D:
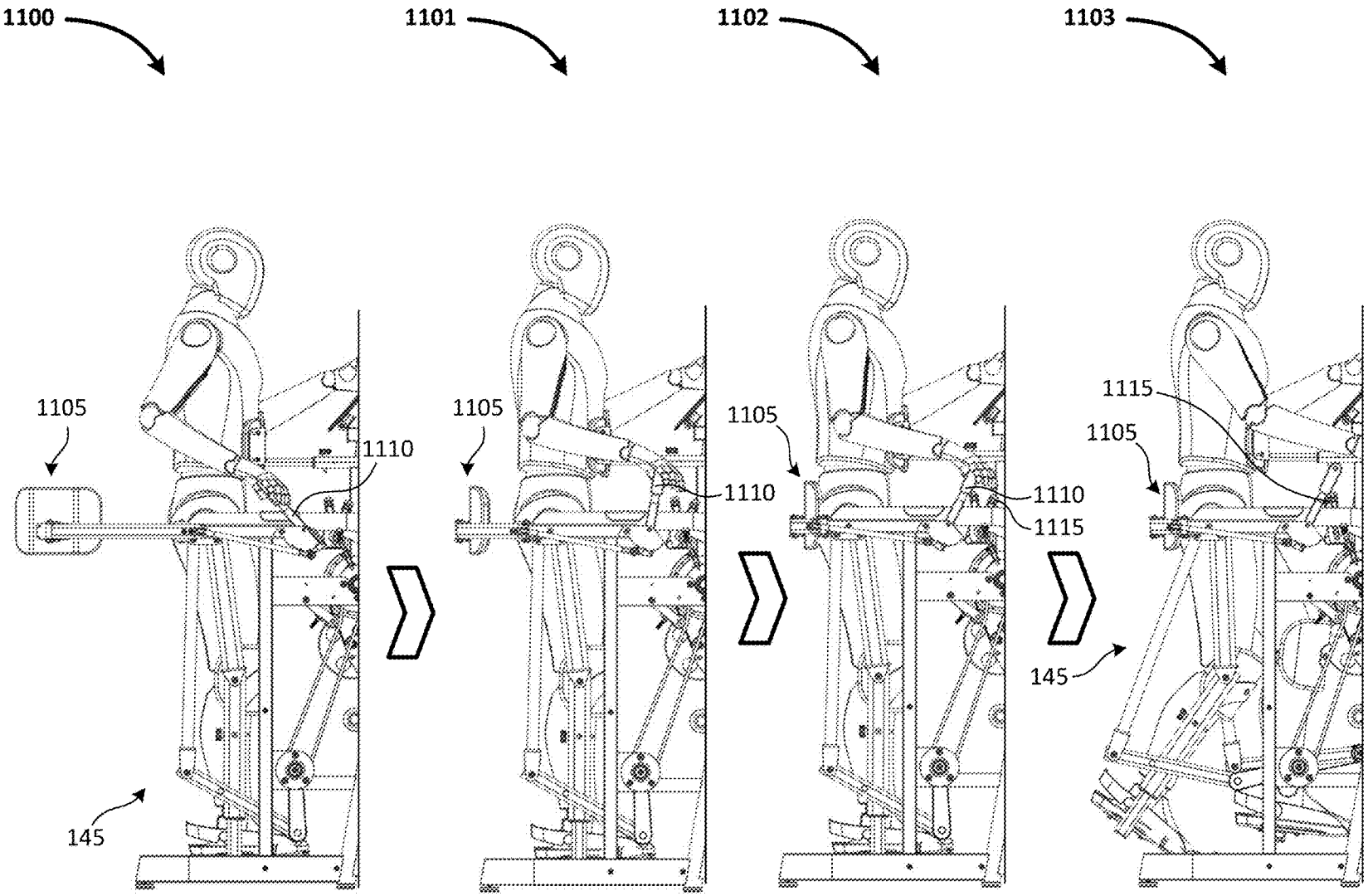
FIG. 11A, FIG. 11B, FIG. 11C, and FIG. 11D depict sequential steps of an exemplary rotatable back support module.
Figure 12A:
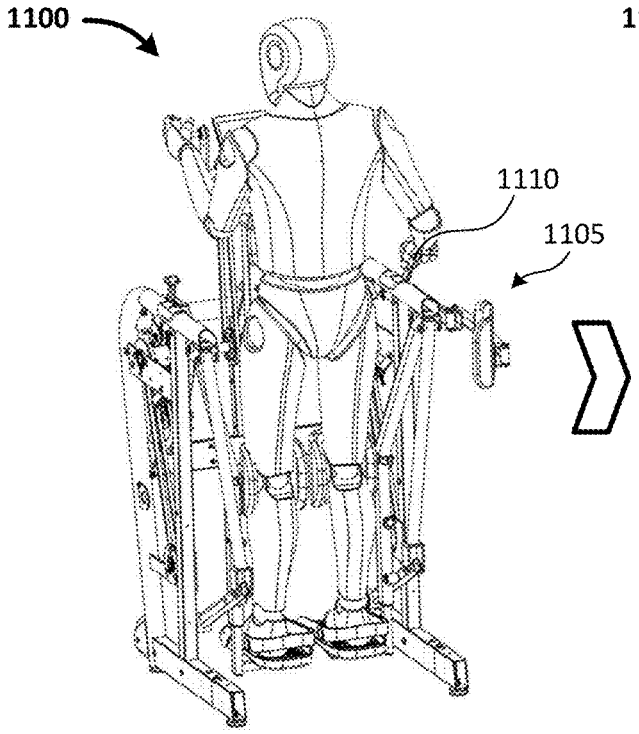
FIG. 12A, FIG. 12B, FIG. 12C, and FIG. 12D depict the sequential steps of FIGS. 11A-11D from a rear-left perspective.
Figure 12B:
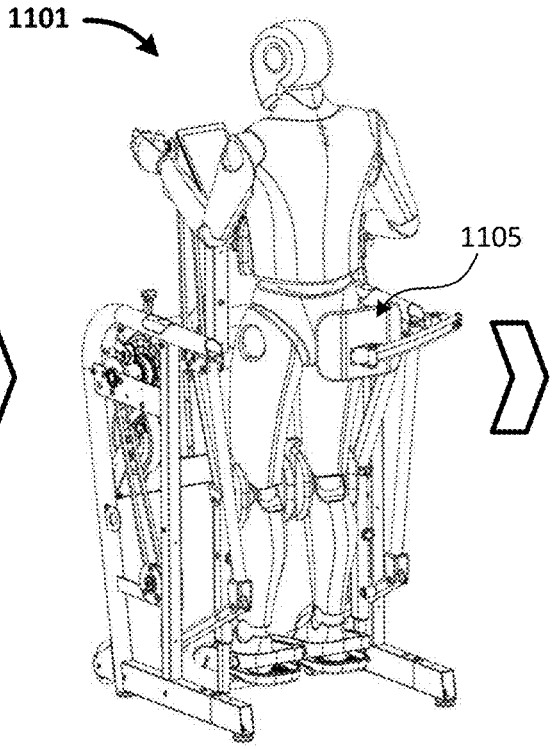
Figure 12C:
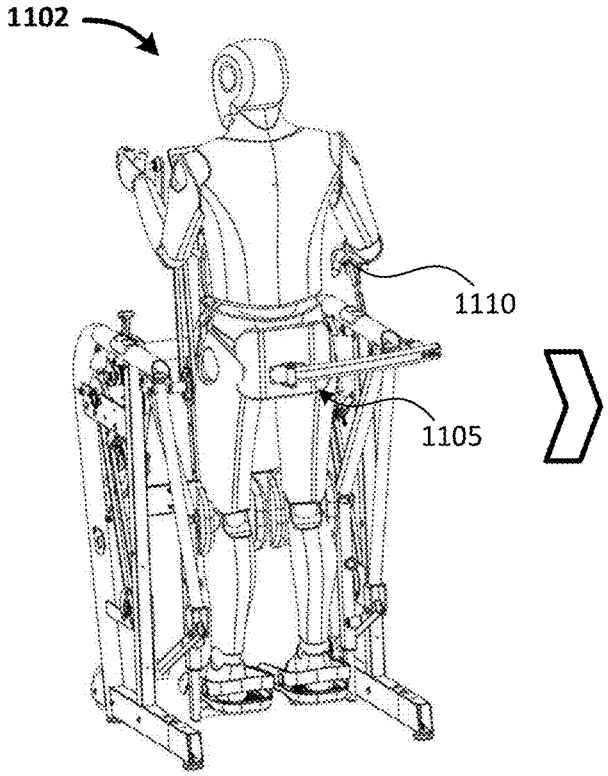
Figure 12D:
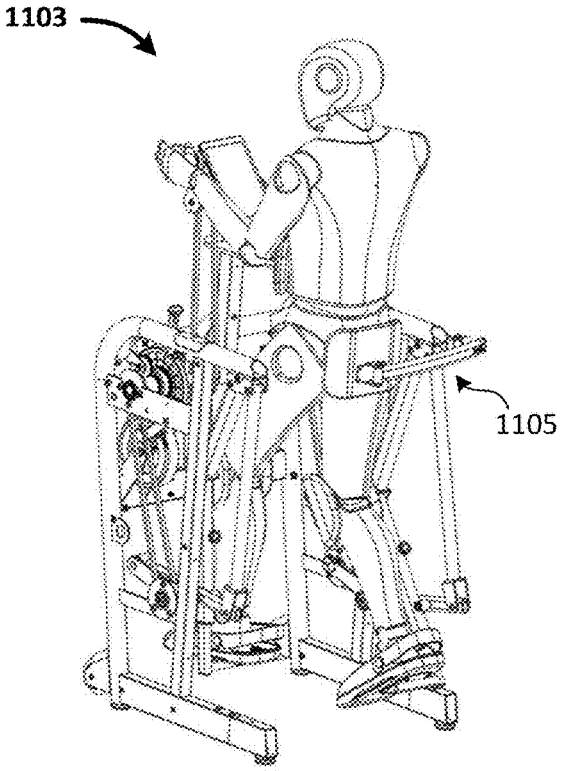

FIG. 10A, FIG. 10B, and FIG. 10C depict sequential steps of an exemplary electric lift module in an isolated view, where FIG. 10A is a first sitting step and FIGS. 10B-10C depict a second standing step from rear-right and front-right perspectives, respectively. The manual hydraulic actuator 960 and associated pump handle 130 of lift module 905 is replaced by a linear actuator 1010. Linear actuator 1010 is driven by powered actuator 1015 (e.g., a rotary electric motor which may drive linear actuator 1010 by, for example, a worm gear configuration, a rack and pinion configuration, and/or hydraulic fluid). The powered actuator 1015 is controlled by control circuit 1030. Control circuit 1030 is activated by operation of input element 1020 by a user. The input element 1020 may, for example, be a bi-directional switch unit configured to command the circuit to operate the actuator 1015 in a first and second direction. A first direction may correspond to extension of the linear actuator 1010 and a second direction may correspond to retraction of the linear actuator 1010. The input element 1020 is mounted on bracket 1025, which may be coupled to a UBEGT. Accordingly, in various embodiments, a user may advantageously operate the power lift module 1005 to lift themselves from a sitting position behind a UBEGT into a standing position within a UBEGT.

FIG. 11A, FIG. 11B, FIG. 11C, and FIG. 11D depict sequential steps of an exemplary rotatable back support module. FIG. 12A, FIG. 12B, FIG. 12C, and FIG. 12D depict the sequential steps of FIGS. 11A-11D from a rear-left perspective. A UBEGT is provided with a rotatable back support module (RBSM 1105). The rotatable back support module may, by way of example and not limitation, be releasably coupled to the support frame of the UBEGT additionally to or in place of a lift module. The patient 105 begins in a first step 1100 by stepping into the left and right NGMs 145 and against a abdominal module. The patient 105 subsequently operates in step 1101 a support activation element 1110 (e.g., a lever connected and configured to extend a rigid linkage to cause a back support to rotate about a pivot point). As the user completes an engaging operation of the support activation element 1110 (e.g., by pushing the depicted lever to a maximum forward position) in a third step 1102, the RBSM 1105 engages with the rear of a user to support the user against the abdominal module. The patient 105 then operates an activation element (e.g., a lever) of the walk control module to transition the NGMs 145 from the standing mode to the walking mode and begins operating the NGMs 145 in a cyclical gaited motion.

Figure 13A:
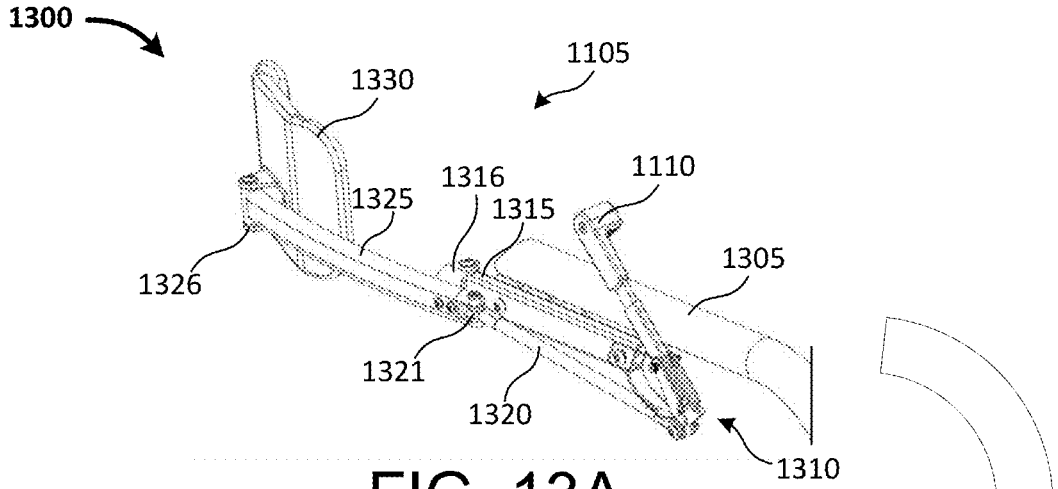
FIG. 13A, FIG. 13B, and FIG. 13C depict sequential steps of an exemplary rotatable back support module in an isolated view.
Figure 13B:
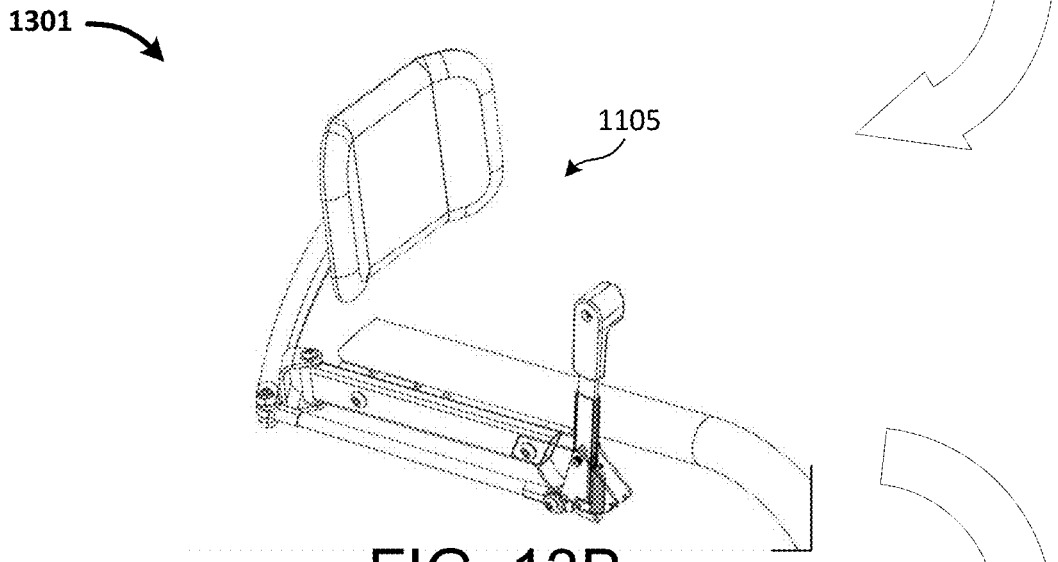
Figure 13C:
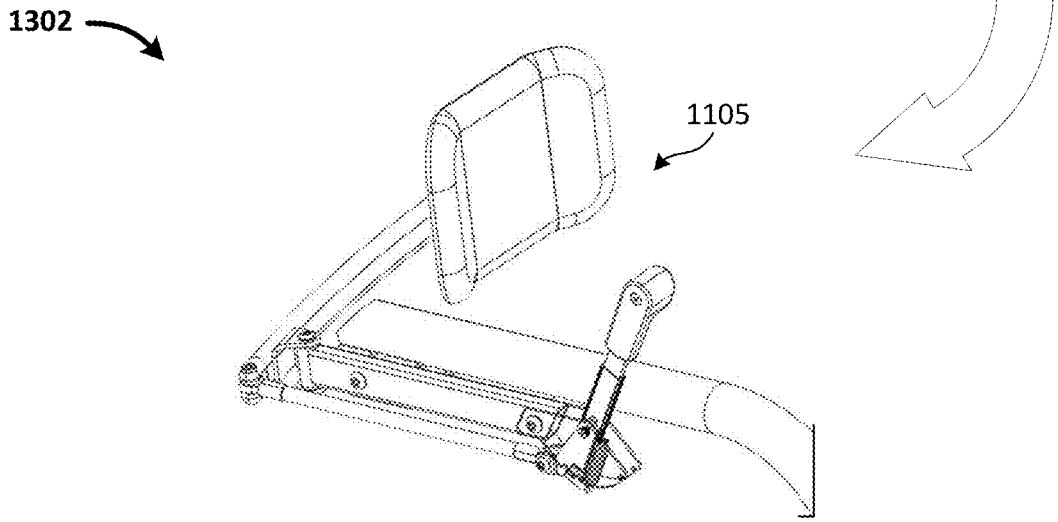

FIG. 13A, FIG. 13B, and FIG. 13C depict sequential steps of an exemplary rotatable back support module in an isolated view. The rotatable back support module (RBSM) is releasably coupled to an upper left end of the rear support frame 1305 by frame element 1315. The support activation element 1110 is a hand grip linked to and configured to operate an adjustable spring-loaded locking actuation mechanism 1310. As the support activation element 1110 is operated forward, the actuation mechanism 1310 urges a rigid linking element 1320 rearward. The linking element 1320 is rotatably connected to the support arm 1325 by a pivot joint 1321. The support arm 1325 is rotatably connected to the frame element 1315 by a pivot joint 1316.

As the linking element 1320 is urged rearwards, the linking element 1320 urges a proximal end of the support arm 1325 rearward via the pivot joint 1321. The support element is thereby constrained to rotate around the pivot joint 1316, causing a distal end of the support arm 1325 to describe an arc from a disengaged position as shown in a disengaged configuration 1300, inwards through a transition position shown in a transition configuration 1301, and to an engaged position shown in an engaged configuration 1302. The support arm 1325 is coupled to a back-support pad 1330 at a distal end via a pivot joint 1326. The pivot joint 1326 is configured to allow lateral rotation of the support pad 1330 relative to the distal end of the support arm 1325. Accordingly, a patient may, for example, advantageously step into the UBEGT, operate the support activation element 1110, and rotate the support pad 1330 into place against their buttocks. The support pad may, for example, rotate laterally with the motion of the patient. Accordingly, the support pad may advantageously provide support of a patient with maximal comfort and/or freedom of motion. In various embodiments, the RBSM may be removably installed on a UBEGT in concert with or in place of a lift module. The RBSM may, for example, advantageously allow a mobile user (e.g., able to walk but needing support during exercise) to engage and operate a UBEGT without assistance. Accordingly, a user may, for example, advantageously enjoy therapy and/or exercise safely, securely, and without assistance.

Figure 14B:
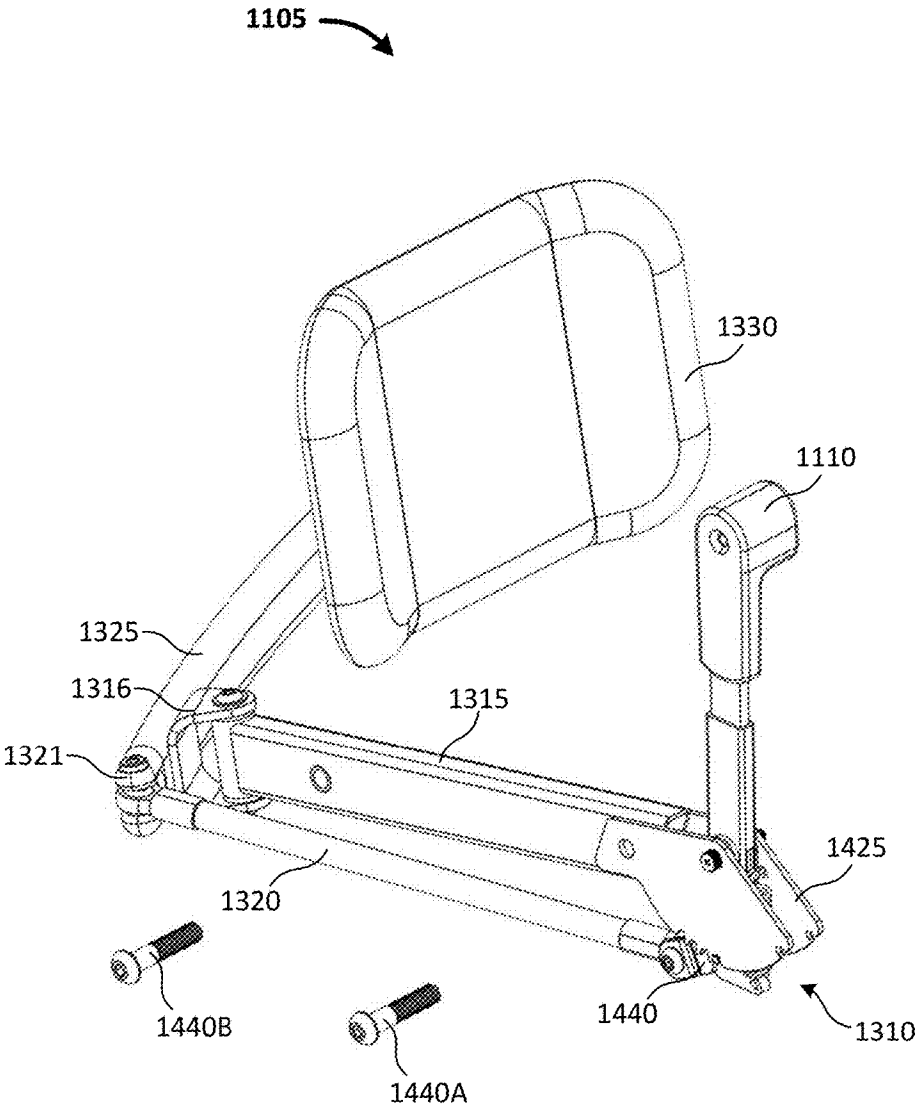
FIG. 14B depicts a closeup view of the exemplary rotatable back support module in preparation for fastening to a UBEGT support frame.
Figure 14A:
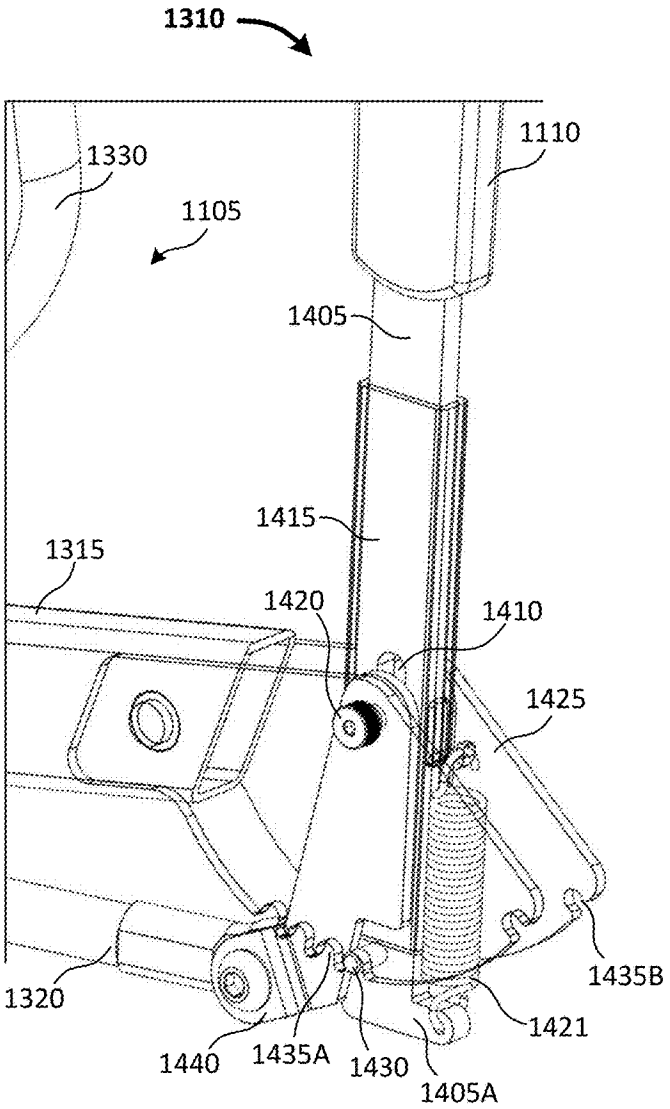
FIG. 14A depicts a closeup view of an actuation mechanism of the exemplary rotatable back support module.

FIG. 14A depicts a closeup view of an actuation mechanism of the exemplary rotatable back support module. In a closeup view of actuation mechanism 1310, the RBSM is releasably secured ('locked') in a first of four engaged configurations such that the support pad 1330 is in an engaged position. Operation of the actuation mechanism 1310 may be performed by a user gripping the support activation element 1110. Support activation element 1110 is coupled to a shaft element 1405. The shaft element 1405 is slidingly engaged within an inner channel of an outer shaft element 1415. The outer shaft element is depicted as transparent, thereby allowing visualization of normally hidden inner features. The outer shaft element is rotatably coupled to a bracket 1425 about a pivot joint 1420. The bracket 1425 includes matching left and right bracket plates coupled to inner and outer side surfaces of the frame element 1315.

The shaft element 1405 is slidingly and rotatably coupled to the bracket 1425 via the pivot joint 1420 and within the outer shaft element 1415. The pivot joint 1420 is provided with a pin element (e.g., a pin and/or bolt, as depicted) which passes through the outer shaft element 1415 and through the slot 1410 of the shaft element 1405. At a distal end of the shaft element 1405, a retaining element 1430 extends laterally from the shaft element 1405. The bracket 1425 is provided with a plurality of engagement retaining features 1435A configured to receive the retaining element 1430 in one of a plurality of features corresponding to an engaged position of the RBSM 1105. A distal end of the shaft element 1405 extends below the bracket 1425. A spring receiving element 1405A extends forward from the distal end of the shaft element 1405. A spring element 1421 (e.g., an extension spring) couples to the spring receiving element 1405A and to a distal end (e.g., via a hook extending therefrom, as depicted) of the outer shaft element 1415. The spring element 1421 urges the shaft element 1405 proximally (upwards, as depicted). Accordingly, the retaining element 1430 is thus urged into releasable engagement within one of the retaining features 1435A. In various embodiments, the retaining element 1430 may extend from both sides of the shaft element 1405 and the retaining features 1435A may be provided in both left and right bracket plates of the bracket 1425.

To operate the actuation mechanism, a user may urge the support activation element 1110 in a distal direction (e.g., downwards, as depicted), causing the shaft element 1405 to slide downwards within and relative to the outer shaft element 1415. The shaft element 1405 accordingly releases the retaining element 1430 from the engaged one of the retaining features 1435A. The user may then urge the support activation element 1110 forwards or backwards, causing the shaft element 1405 to rotate about the pivot joint 1420 and causing the distal end of the shaft element 1405 to rotate rearwards or forwards, respectively, in response. Once the user ceases urging the support activation element 1110 downwards, the spring element 1421 urges the shaft element 1405 proximally (e.g., upwards, as depicted) such that the retaining element 1430 contacts a bottom arcuate surface of the of the bracket 1425. Once the retaining element 1430 is aligned with one of the engagement retaining features 1435A, or with a disengagement retaining feature 1435B, the spring element 1421 accordingly causes the retaining element to be urged into releasable engagement within the appropriate retaining feature 1435A or 1435B.

The disengagement retaining feature 1435B corresponds with a disengaged position of the pad 1330 in a disengaged configuration of the RBSM 1105. Accordingly, a user may advantageously releasably operate the support activation element 1110 to transition the RBSM 1105 between one of a plurality of engaged configurations and/or a disengaged configuration. In various embodiments, for example, a mobile user may advantageously step into left and right NGMs 145 and operate the support activation element 1110 to transition the RBSM 1105 from a disengaged configuration to one of the plurality of engaged configurations. The user may select one of the engaged configurations (e.g., determined by location of engagement retaining features 1435A) appropriate for the user's size, body shape, and/or comfort. Accordingly, the user may, for example, advantageously engage the RBSM 1105 in a desired position and configuration to support the user during exercise and/or therapy.

In various embodiments, the actuation mechanism 1310 may be configured such that a forward force (toward the front of a UBEGT on which the RBSM is mounted) on the support activation element 1110 causes the retaining element 1430 to automatically disengage from a current retaining feature 1435A and to move into and engage in a subsequent retaining feature. The actuation mechanism 1310 may, for example, allow a user to push forward on the support activation element 1110 and thereby "lever themselves forwards." Accordingly, in various embodiments, the actuating mechanism may advantageously allow a user to use leverage to force themselves up into a desired standing position. The actuating mechanism may be configured (e.g., by a shape of the retaining features 1435A) to prevent reverse motion (e.g., automatic progression of the retaining element 1430 into an adjacent retaining feature 1435A corresponding to a less supportive and/or less engaged position of the back-support pad 1330 without downward motion on the support activation element 1110 exceeding a predetermined force threshold (e.g., as determined by a spring factor, K, of the spring element 1421).

Rearward motion of the retaining element 1430 causes the retaining element to urge a pivot bracket 1440 rearwards. Pivot bracket 1440 is connected at a proximal (e.g., forward) end of the rigid linking element 1320. Accordingly, as the pivot bracket 1440 is urged rearwards, it correspondingly urges rigid linking element 1320 rearwards, as described in relation to FIGS. 13A-13C.

FIG. 14B depicts a closeup view of the exemplary rotatable back support module in preparation for fastening to a UBEGT support frame. The RBSM 1105 may be coupled to a support frame of a UBEGT by fastening the frame element 1315 and bracket 1425 thereto via first mounting coupler 1440A and second mounting coupler 1440B. As depicted, the mounting couplers 1440A-B may, by way of example and not limitation, be a screw or bolt. In various embodiments, the mounting couplers may be removable or permanent (e.g., adhesive, welding, rivets, pins, or other suitable fastener).

In various embodiments, the RBSM 1105 may advantageously be employed by users who can stand and walk but need help holding their position. Such users may, for example, use a cane or walker but may have very limited hand function and may need to use a rear support to help them stand straighter. Such users may, for example, advantageously push the lever forward and allow the ratchetting mechanism to self-lock in the desired position. By pushing forward, the use may advantageously apply rear pressure to help straighten their body. The release mechanism may advantageously allow them to simply push down on the handle to release without requiring hand and finger dexterity.

Figure 15B:
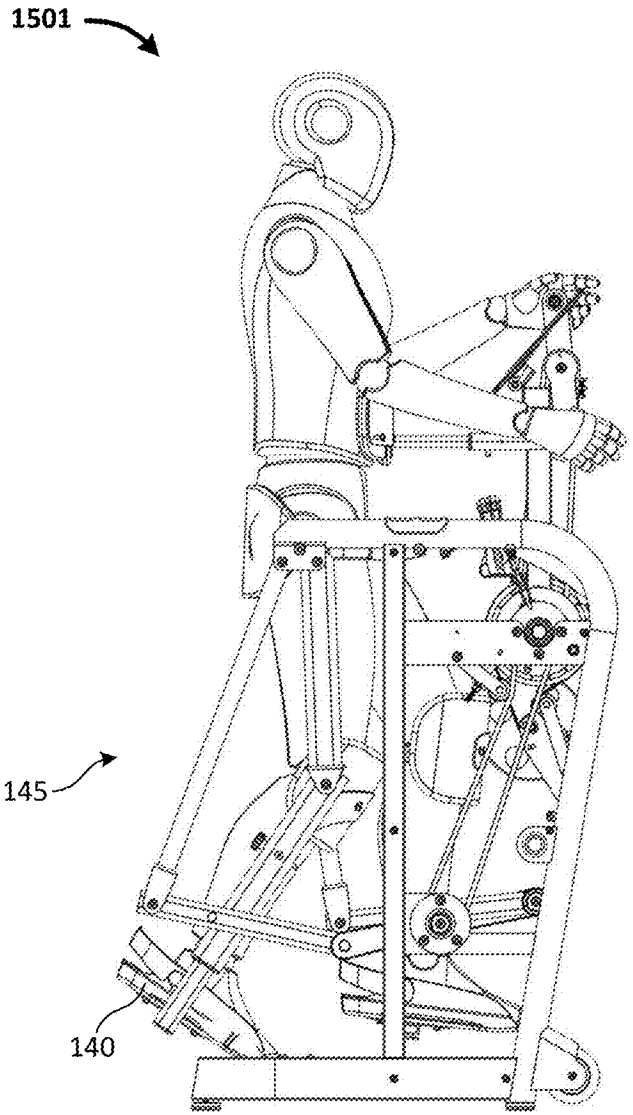
FIG. 15A and FIG. 15B depict sequential steps of an exemplary upper body ergometer (UBE) employed to engage left and right gait therapy modules and simulate a natural gait in an exemplary use-case scenario.
Figure 15A:
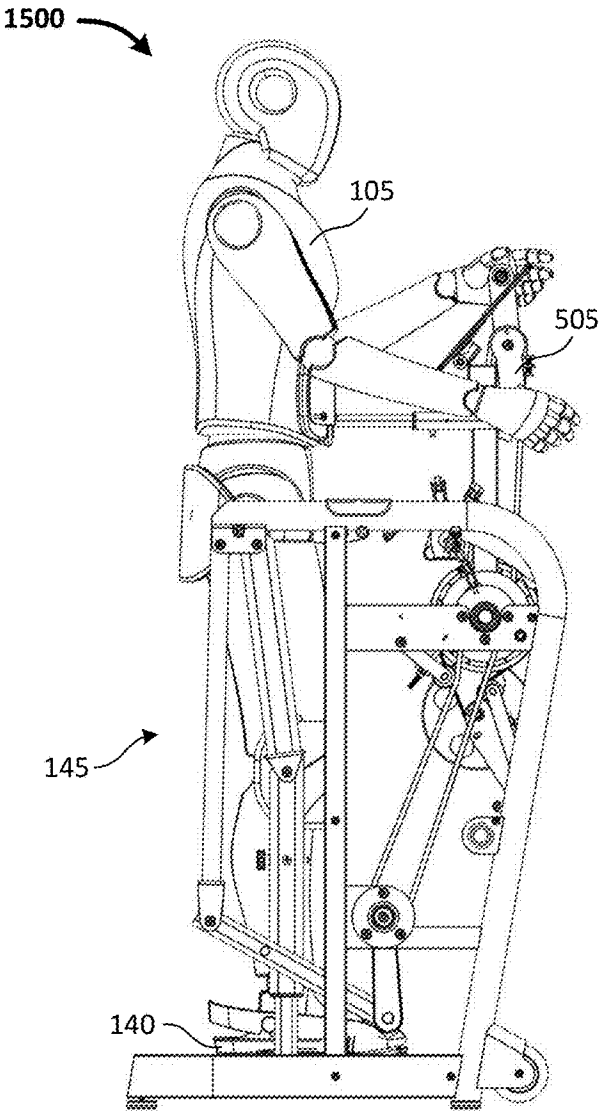
Figure 16B:
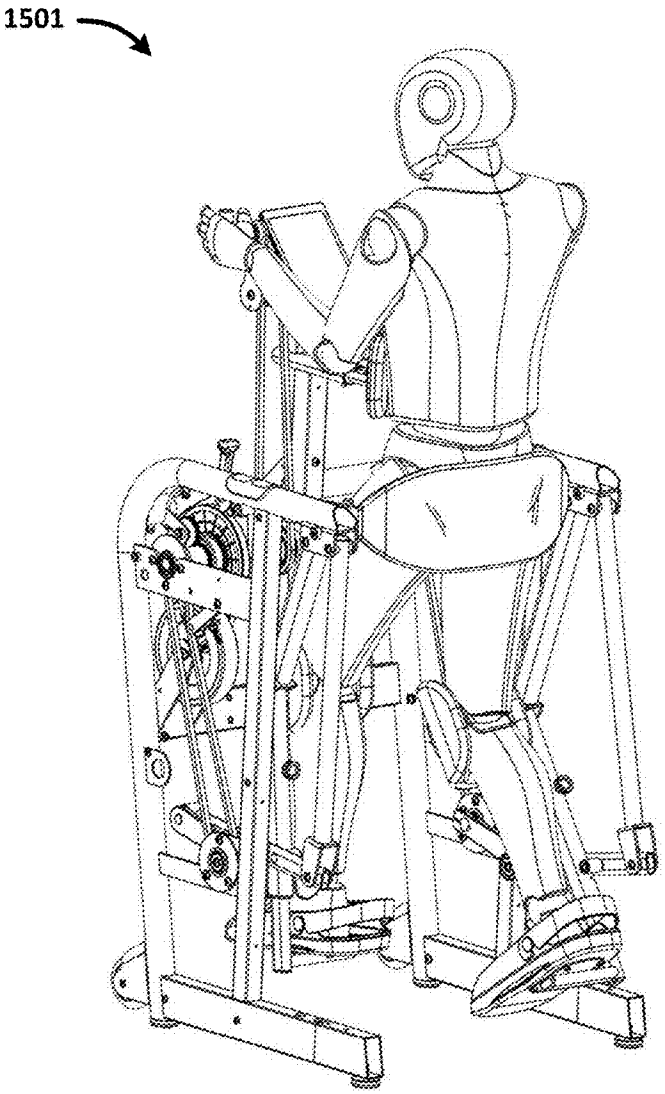
FIG. 16A and FIG. 16B depict the sequential steps of FIGS. 15A-B from a rear-left perspective.
Figure 16A:
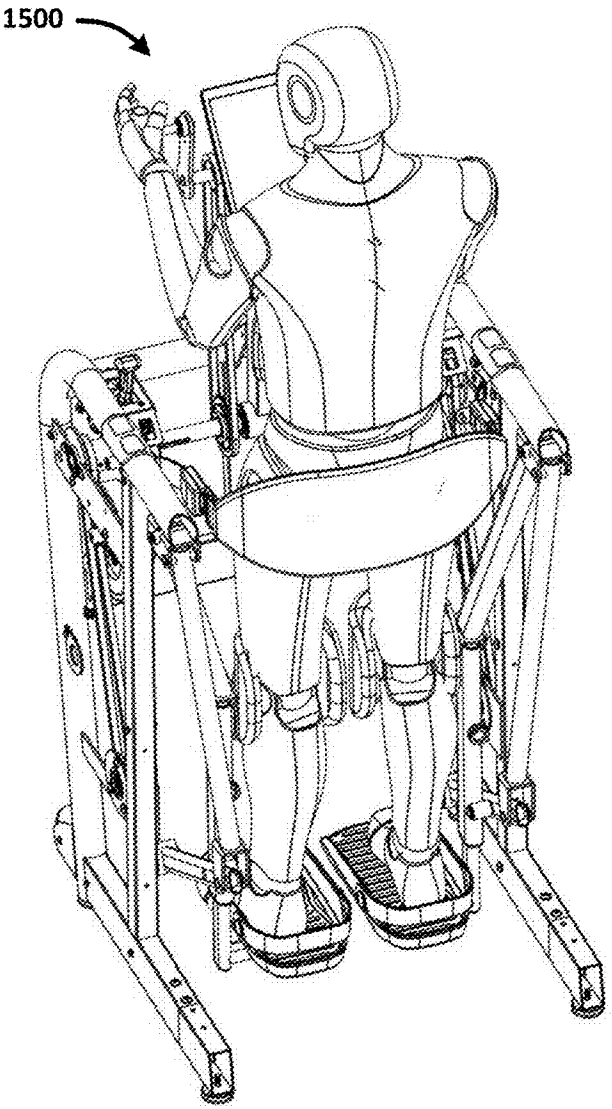

FIG. 15A and FIG. 15B depict sequential steps of an exemplary upper body ergometer (UBE) employed to engage left and right gait therapy modules and simulate a natural gait in an exemplary use-case scenario. FIG. 16A and FIG. 16B depict the sequential steps of FIGS. 15A-B from a rear-left perspective. In a first position 1500, the patient 105 is positioned within the support frame of the UBEGT, standing on the foot supports 140 corresponding to the respective NGMs 145 and supported by the NGMs 145, the abdominal module (e.g., 125), and the lift strap (e.g., 120). The NGMs 145 are in a standing position, but a walk control module has been placed into a walking mode. The patient 105 engages rotating handles of the UBE 505. Accordingly, in second position 1501 the patient 105 continues to operate the UBE 505, and the walk control module has completed transition into the walking mode. The UBE 505 operates a walk drive module to operate the NGMs 145 in a cyclical gait motion. Accordingly, the patient 105 may, for example, advantageously operate the UBE 505 with their upper body to move their lower body in a cyclical gaited motion regardless of a level of ability of the patient to move their lower body independently.

Figure 17A:
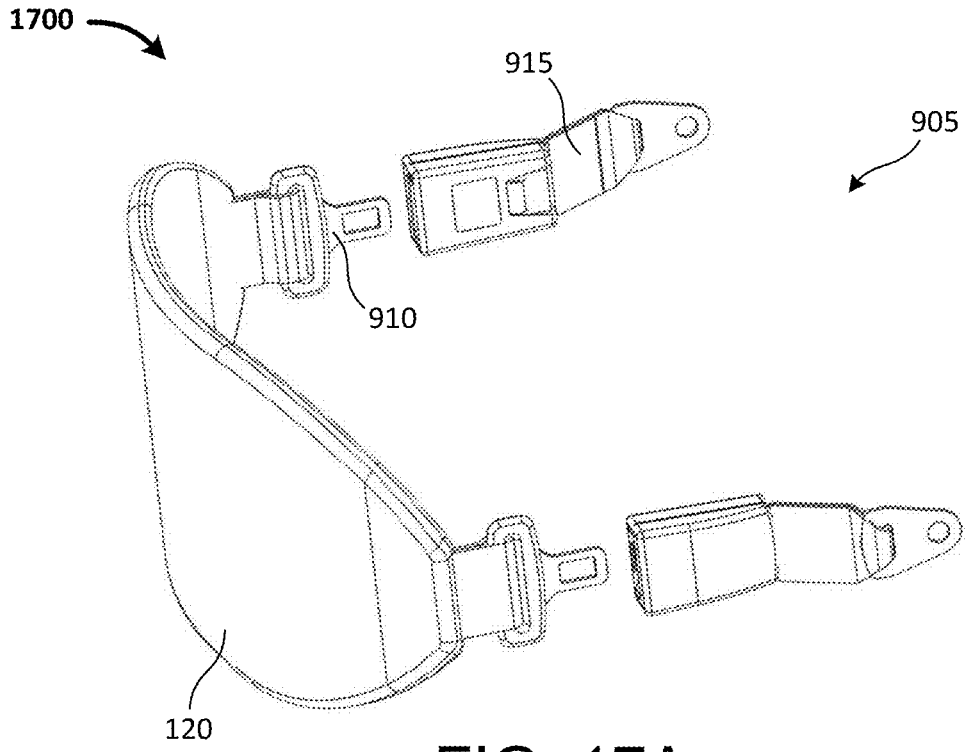
FIG. 17A and FIG. 17B depict sequential steps of fastening an exemplary rear lift strap assembly shown in an isolated view.
Figure 17B:
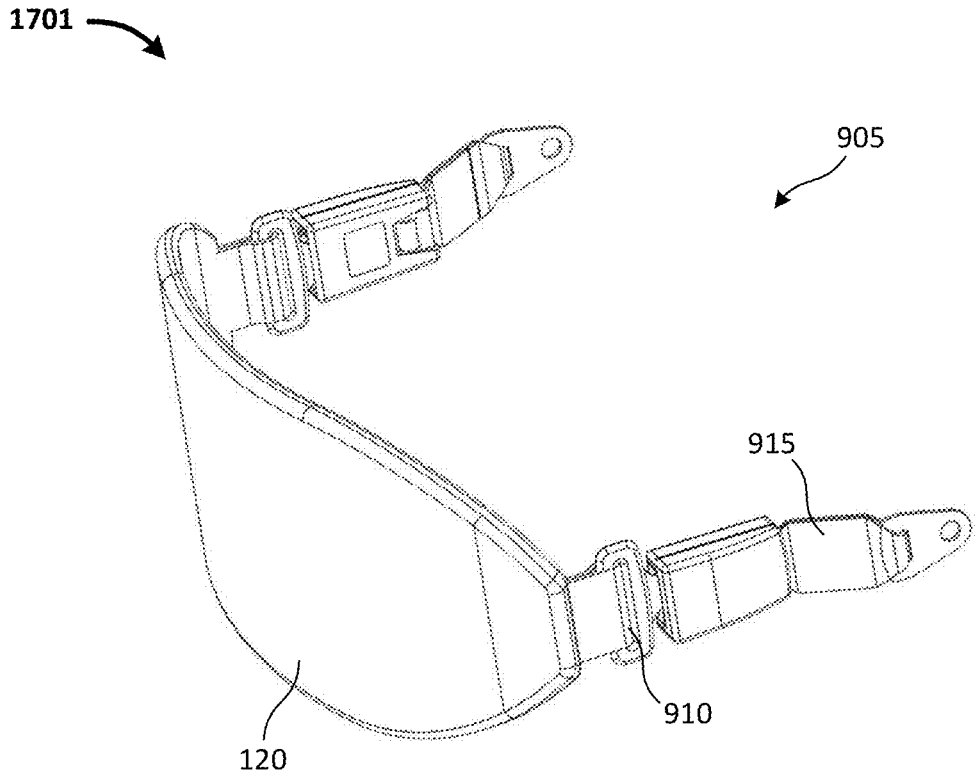

FIG. 17A and FIG. 17B depict sequential steps of fastening an exemplary rear lift strap assembly shown in an isolated view. The lift strap 120 is provided with first and second buckle inserts (third and fourth coupling elements 910). From a decoupled configuration 1700, the coupling elements 910 may be inserted into first and second buckle receptacles (first and second coupling elements 915). The coupling elements 910 and coupling elements 915 may thereby be releasably coupled together in respective buckle insert/receptacle pairs to configure the strap 120 in a coupled configuration 1701. Each coupling element 915 is provided with a respective attachment element(s) (e.g., strap and bracket, as depicted), which may be releasably or permanently coupled to a lift module element (e.g., cross-piece 920 in FIGS. 9A-10C). A patient may, for example, advantageously decouple one or both ends of the lift strap 120, position it in place (e.g., slide it under their buttocks while seated in a wheelchair), and then recouple the lift strap 120 to first and second coupling elements 915. Accordingly, in various embodiments the patient may advantageously position the lift strap 120 and support themselves therewith for use in lifting themselves into a standing position within a UBEGT.

Figure 18A:
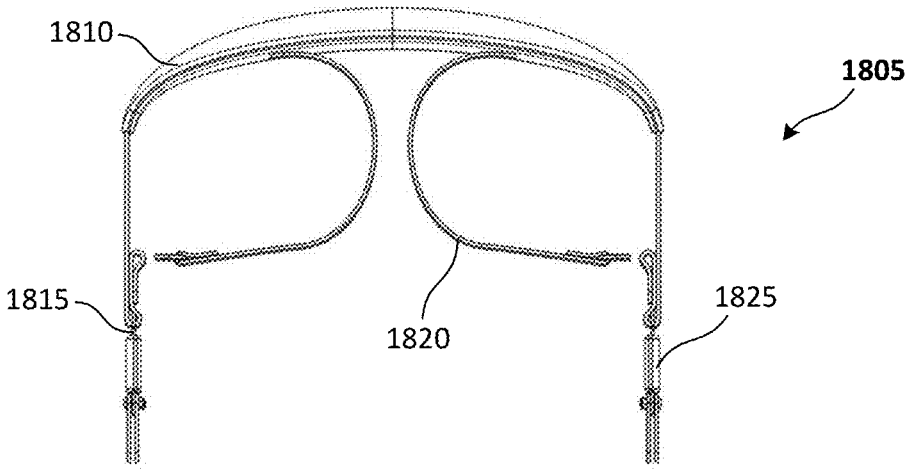
FIG. 18A, FIG. 18B, and FIG. 18C depict top, front-left, and right views, respectively, of an exemplary rear lift strap assembly provided with leg retainers and shown in an isolated view.
Figure 18B:
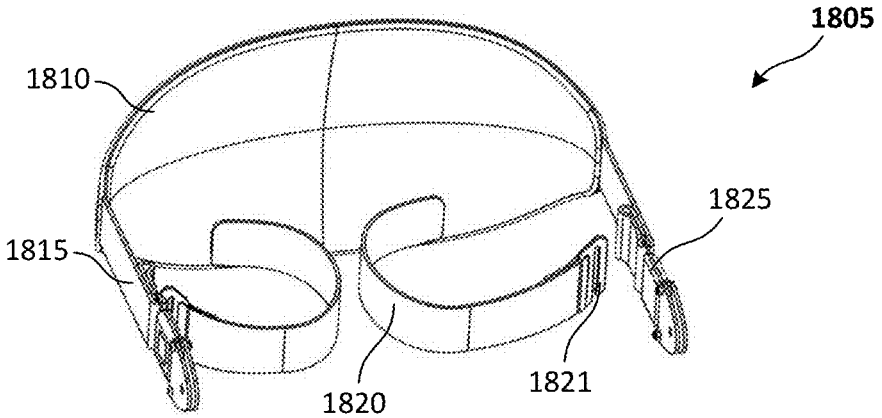
Figure 18C:
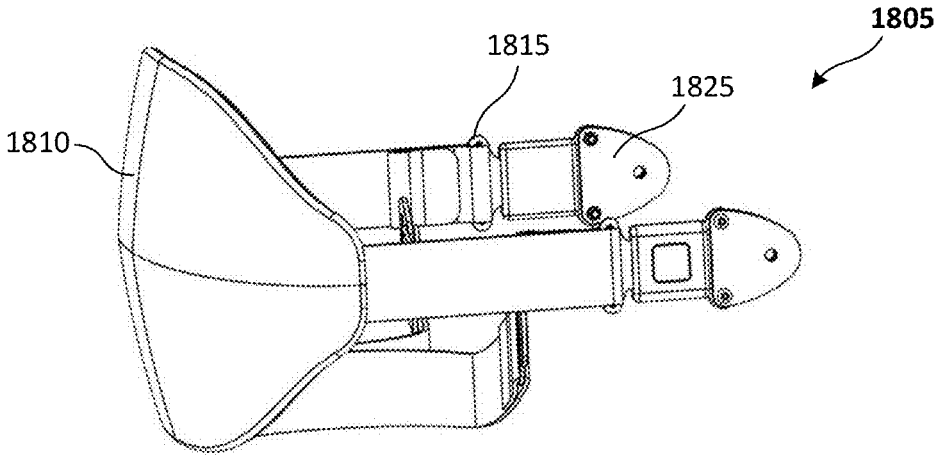

FIG. 18A, FIG. 18B, and FIG. 18C depict top, front-left, and right views, respectively, of an exemplary rear lift strap assembly provided with leg retainers and shown in an isolated view. The lift strap assembly 1805 includes a lift strap 1810. The lift strap is provided with coupling elements 1815 (e.g., buckle inserts) at a first and second end of the lift strap 1810. The coupling elements 1815 releasably couple to mating coupling elements 1825. The lift strap 1810 is further provided with a left and a right leg retaining strap 1820. Each leg retaining strap 1820 is coupled at a proximal end to the lift strap 1810. Each leg retaining strap 1820 is provided at a distal end with a coupling element 1821. In the depicted embodiment, the coupling element 1821 is a hook configured to releasably couple to a corresponding coupling element 1815 of the lift strap 1810. Accordingly, a user may advantageously decouple the coupling elements 1821, position the lift strap 1810 underneath their buttocks, position the left and right leg retaining straps 1820 around their left and right legs, respectively, and recouple the left and right coupling elements 1821 to the left and right coupling elements 1815, respectively. In various embodiments, the leg retaining straps 1820 may, for example, advantageously prevent the lift strap 1810 from slipping out of position (e.g., upwards, downwards, or laterally) during lifting, lowering, and/or exercise/therapy.

Figure 19A:
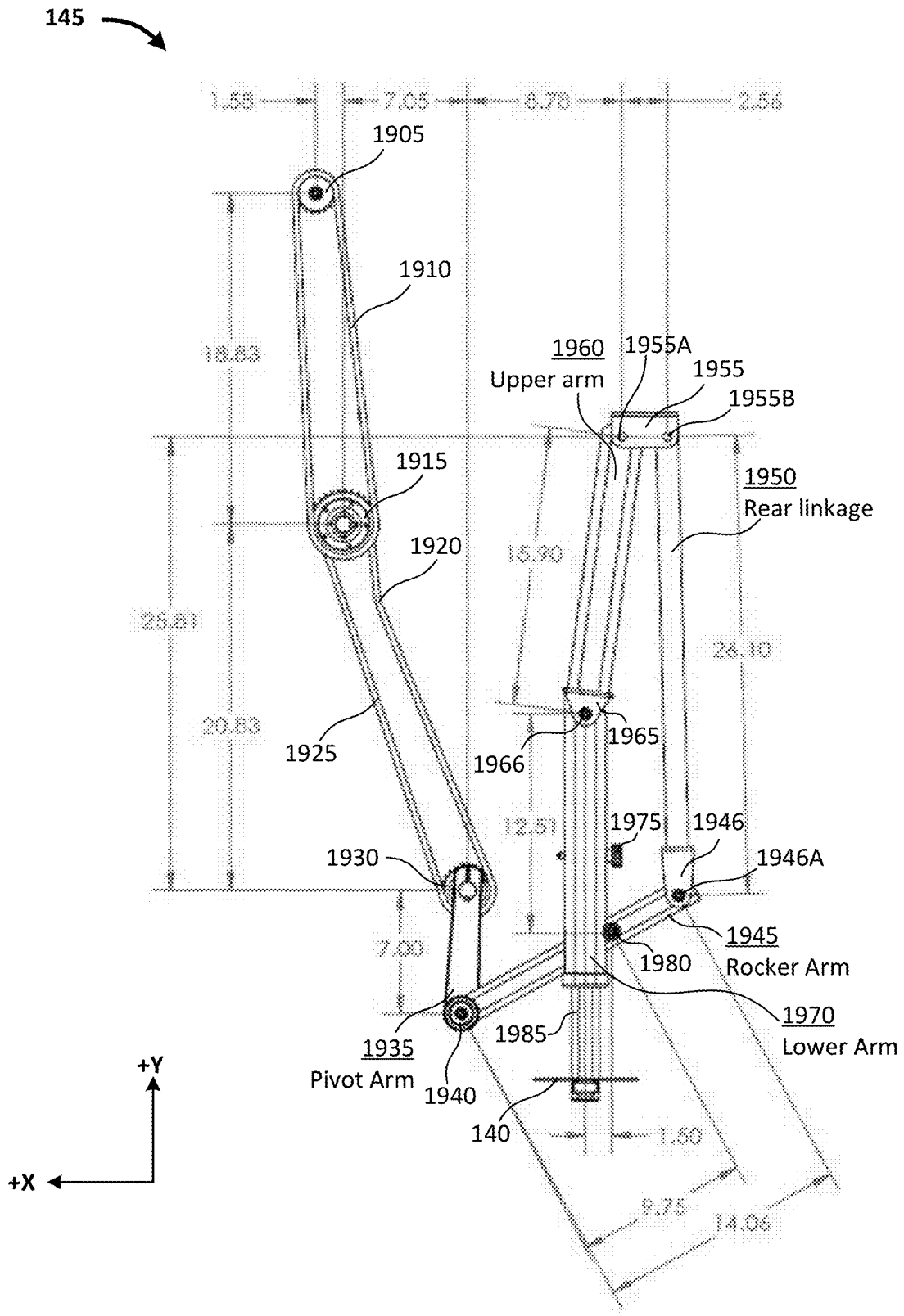
FIG. 19A depicts an exemplary linkage assembly of an exemplary gait therapy module.

FIG. 19A depicts an exemplary linkage assembly of an exemplary gait therapy module. An NGM 145 is suspended from a bracket 1955. The bracket 1955 may, for example, be releasably or statically coupled to a support frame of a UBEGT. The bracket 1955 is rotatably coupled to a proximal end of an upper arm 1960 via first pivot joint 1955A. The upper arm 1960 is statically coupled (e.g., welded, bolted, screwed, riveted) at a distal end to a pivot member 1965. The pivot member 1965 is rotatably coupled to a proximal end of a lower arm 1970 via a pivot joint 1966. The lower arm 1970 slidingly receives an extension arm 1985 into the lower arm 1970. The extension arm 1985 is releasably secured in one of a plurality of extension configurations by securing element 1975 (e.g., a pin). Mounted on the extension arm 1985 is the foot support 140. Accordingly, in various embodiments, when a user's foot is supported on the foot support 140, the user is thereby adjustably and rotatably suspended from the bracket 1955 and from thence may, for example, be suspended from a support frame of a UBEGT. In various embodiments, a knee support may be attached at or near a proximal (e.g., upper) end of the lower arm 1970. Accordingly, the user's knee may be further supported by the knee support attached to the lower arm 1970.

Rear linkage 1950 is also suspended from the bracket 1955 via second pivot joint 1955B at a proximal end of the rear linkage 1950. A proximal end of rear linkage 1950 is provided with a pivot member 1946. The pivot member 1946 is rotatably coupled to a distal end of a rocker arm 1945. The rocker arm 1945 is rotatably coupled between the distal end and a proximal end to the lower arm 1970 via a pivot member 1980. The rocker arm 1945 is rotatably coupled to a pivot arm 1935 via a pivot joint 1940 (e.g, a radial ball bearing). The pivot arm 1935 is statically coupled to a direct drive element (e.g., a first gear) 1930.

Accordingly, rotation of the direct drive element 1930 causes corresponding rotation of the pivot arm 1935 about the direct drive element 1930. Rotation of the pivot arm 1935 causes circular motion of the proximal end of the rocker arm 1945 about the direct drive element 1930, with a radius of motion defined by an effective length of the pivot arm 1935 (a distance between a center of the direct drive element 1930 and a center of the pivot joint 1940). The circular motion of the proximal end of the rocker arm 1945 induces a dual 'rocker' motion and forwards-backwards motion of the rocker arm 1945, due at least in part to the vertical constraint of the distal end of the rocker arm 1945 by the rear linkage 1950. The dual motion of the rocker arm 1945 induces a generally elliptical motion of the lower arm 1970 and a corresponding generally elliptical motion of the foot support 140, enabled at least in part by the pivot joints 1966 and 1955A. Accordingly, rotation of the direct drive element 1930 may advantageously induce a cyclical natural gait motion coordinating the foot support 140, and the knee support (not shown) within the confines of a support frame of a UBEGT.

In the depicted embodiment, the pivot member 1965 is provided with an engagement surface on a proximal (e.g., upper) end of the pivot member 1965. The flat may, for example, engage with an upper edge of the proximal end of the lower arm 1970. Accordingly, the pivot member 1965 and the lower arm 1970 may interact to restrict rotation of the lower arm 1970 relative to the upper arm 1960 within a predetermined range. By way of example and not limitation, the pivot member may prevent rotation of the lower arm 1970 forward (generally in the direction of the +X axis) beyond substantially parallel alignment of a longitudinal axis of the lower arm 1970 and a longitudinal axis of the upper arm 1960. Accordingly, the restricted range of rotation may, for example, advantageously prevent hyperextension of a user's knee by restricting the forward rotation of the lower arm 1970 relative to the lower arm 1960.

The direct drive element 1930 is in rotating connection to an intermediate drive element 1915 (e.g., an intermediate drive gear assembly) via a lower drive element 1925 (e.g., a belt, chain, or other continuous drive linkage). The intermediate drive element 1915 is in rotating connection to an originating drive element 1905 (e.g., an upper gear) via an upper drive member 1910 (e.g., a belt, chain, or other continuous drive linkage). In various embodiments, the originating drive element 1905 may, by way of example and not limitation, form a portion of a UBE such that operation of the UBE by a user causes rotation of the originating drive element 1905.

In various embodiments, the intermediate drive element 1915 may, by way of example and not limitation, form a portion of a walk control module and/or drive module. For example, the intermediate drive element 1915 may include a first rotating element (e.g., gear or pulley) engaged by the upper drive member 1910 and a second rotating element engaged by the lower drive element 1925 and, for example, coaxial with the first rotating element. A walk control module may, in a walking mode, releasably couple the first and second rotating elements such that at least motion in one rotational direction of the first rotating element causes corresponding rotation of the second rotating element. The walk control module may, for example, in a standing mode, decouple the first and second rotating element at least such that rotation of the first rotating element does not induce rotation of the second rotating element.

In various embodiments, a walk control module may, in a walking mode, engage a drive element (not shown) to cause a deflection 1920 in the lower drive element 1925. Accordingly, tension may be induced in the lower drive element 1925 such that rotation of the intermediate drive element 1915 induces corresponding rotation of the direct drive element 1930. Similarly, the walk control module may, in a standing mode, disengage the drive element (not shown), thereby releasing tension in the lower drive element 1925 and thereby disengaging the direct drive element 1930 from the intermediate drive element 1915.

The measurements depicted in FIG. 19A are illustrative and are provided by way of example and not limitation. Various embodiments may have different absolute and/or relative measurements. In various embodiments, such as in the depicted embodiment, the relative lengths and positions of the upper arm, lower arm, rear linkage, rocker arm, and pivot arm may advantageously maintain a foot support at a natural angle throughout the gait cycle (e.g., pivoted downwards at a negative slope relative to the +X axis during a toe-off phase, pivoted upwards at a positive slope during a heel strike phase, and substantially horizontal during a stance phase).

FIG. 19B depicts timing of the exemplary linkage assembly of FIG. 19A in an exemplary complete natural gait cycle. Flowchart 1901 and corresponding table 1902 depict relative positions of elements of an NGM 145 and associated linkage assembly during a natural gait cycle. The flowchart 1901 corresponds to a position of the foot support for a first NGM 145 in the gait cycle, and the flowchart 1903 corresponds to a position of a second foot support for a corresponding second NGM 145 in the gait cycle (e.g., first and second NGMs may be left and right NVMs). The flowchart 1901 begins with the foot support 140 in a downward position (approximately correlating to a standing position) as the corresponding pivot arm 1935 is pointed directly downwards toward the ground, such as is shown of the left NGM 145 at least in FIGS. 6A and 7A.

The flowchart proceeds with counterclockwise motion (when a corresponding UBEGT is viewed from a left side) as the foot support 140 moves to a rearmost position (towards the rear of the corresponding UBEGT) as the pivot arm 1935 is pointed rearwards, such as is shown of the left NGM in FIGS. 6B and 7B. The foot support 140 then moves to an uppermost position as the pivot arm 1935 is pointed upwards, such as is shown of the left NGM in FIGS. 6C and 7C. The foot support 140 then moves to a foremost position as the pivot arm 1935 is pointed forwards, such as is shown of the right NGM 145 in FIGS. 6B and 7B. As can be seen in flowchart 1903, the second NGM 145 is synchronized with the first NGM 145 but is maintained with a 180° phase offset in the rotation of the pivot arm 1935 when the walk control module is in a walking mode. Accordingly, left and right NGMs 145 may be operated by a drive module and/or by a user's own lower body motion to simulate a natural bipedal gait cycle.

Figure 20A:
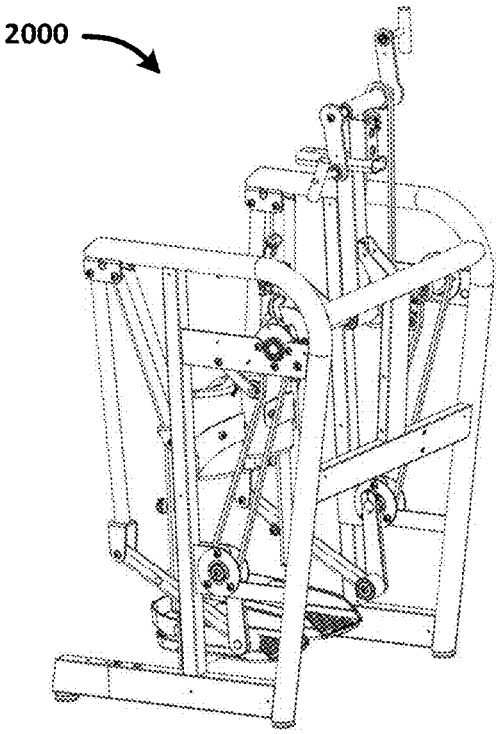
FIG. 20A and FIG. 20B depict a front-right and rear-left perspective view, respectively, of an exemplary UBEGT in a deployed, standing mode.
Figure 20B:
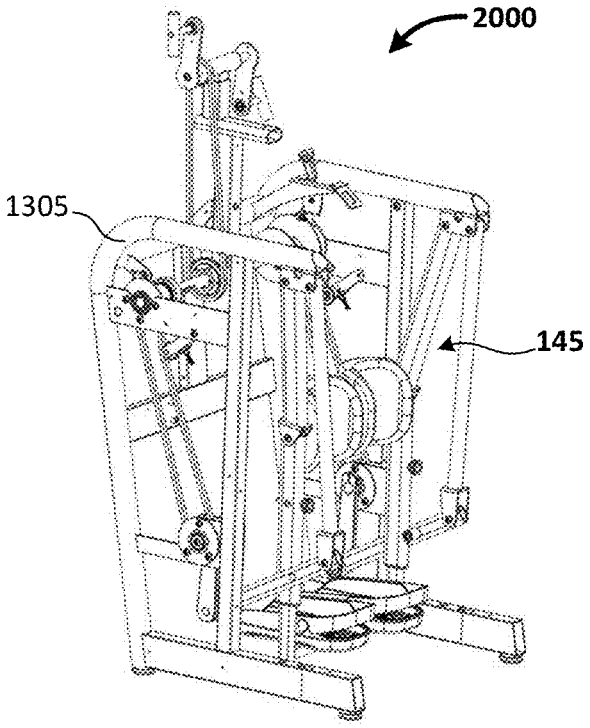
Figure 20C:
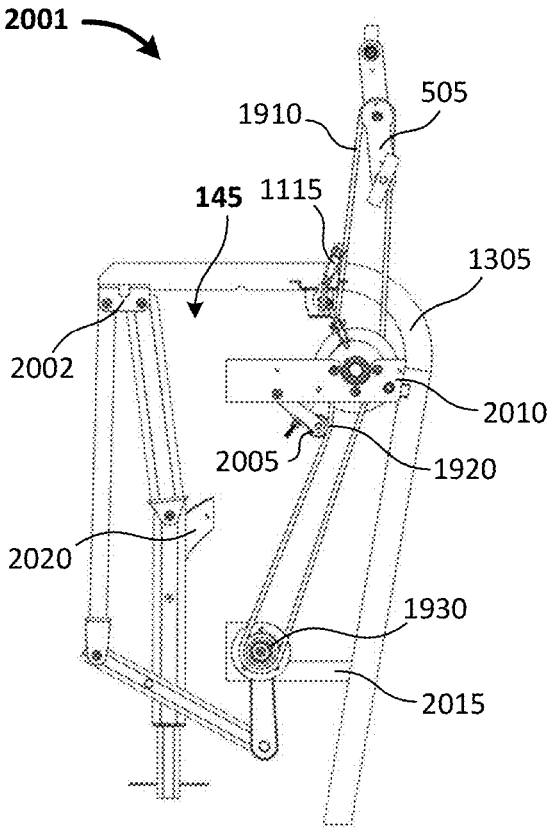
FIG. 20C and FIG. 20D depict a right side and front-right perspective view, respectively, of an exemplary UBE, left and right gait therapy modules, and walk control module in a deployed, standing mode, and shown in an isolated view.
Figure 20D:
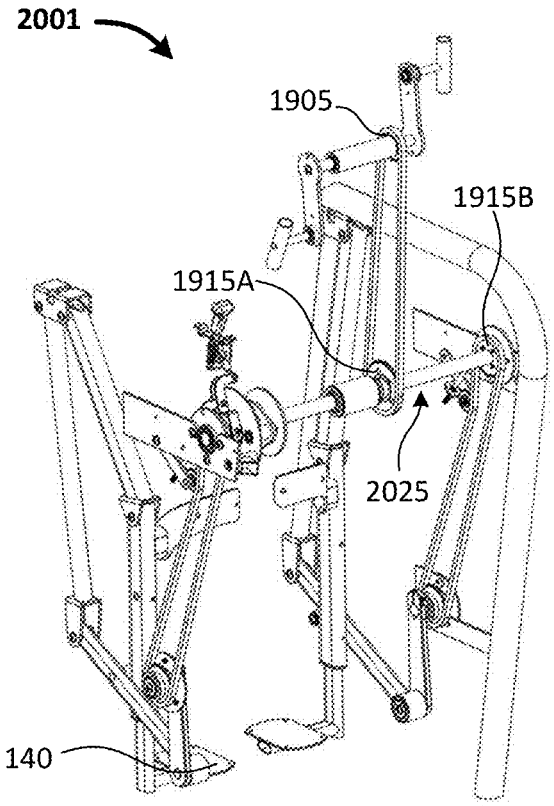
Figure 21B:
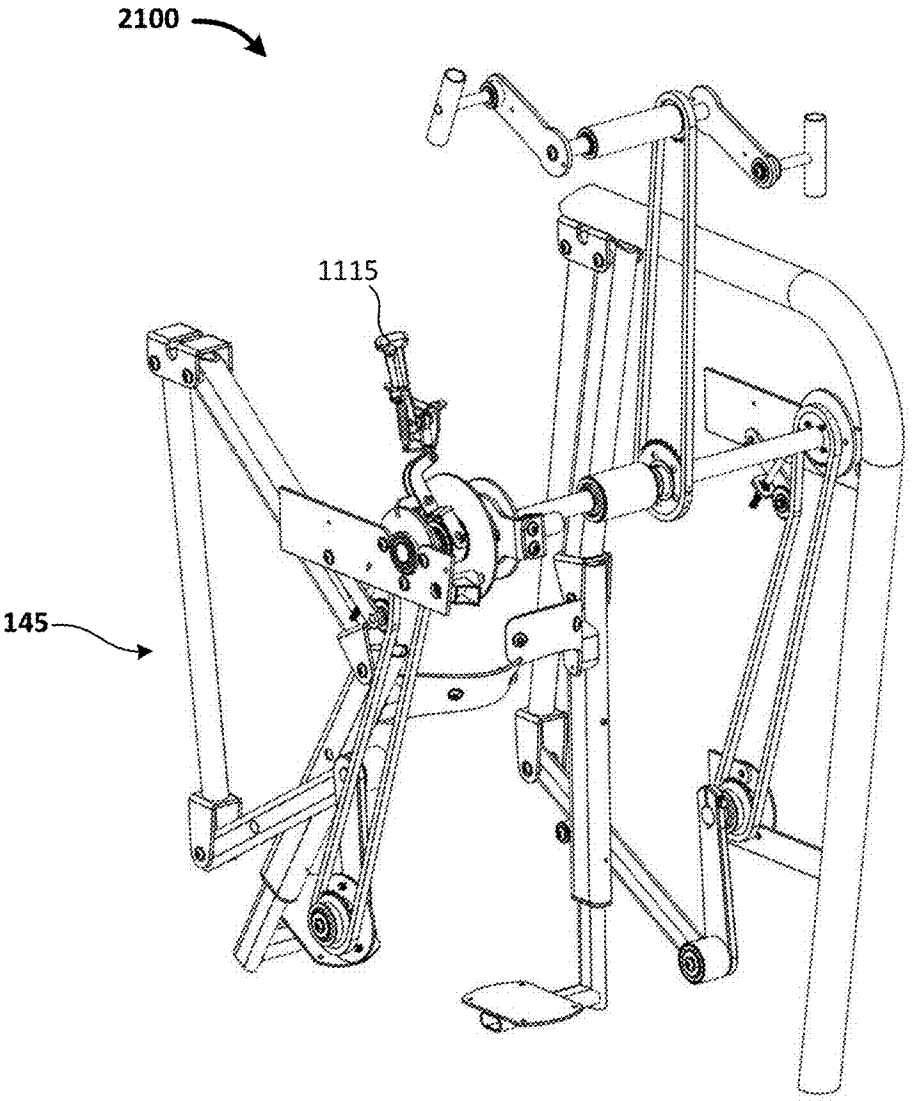
FIG. 21A and FIG. 21B depict a right side and front-right perspective view, respectively, of the exemplary UBE, left and right gait therapy modules, and walk control module of FIGS. 20C-20D, in a deployed, walking mode.
Figure 21A:
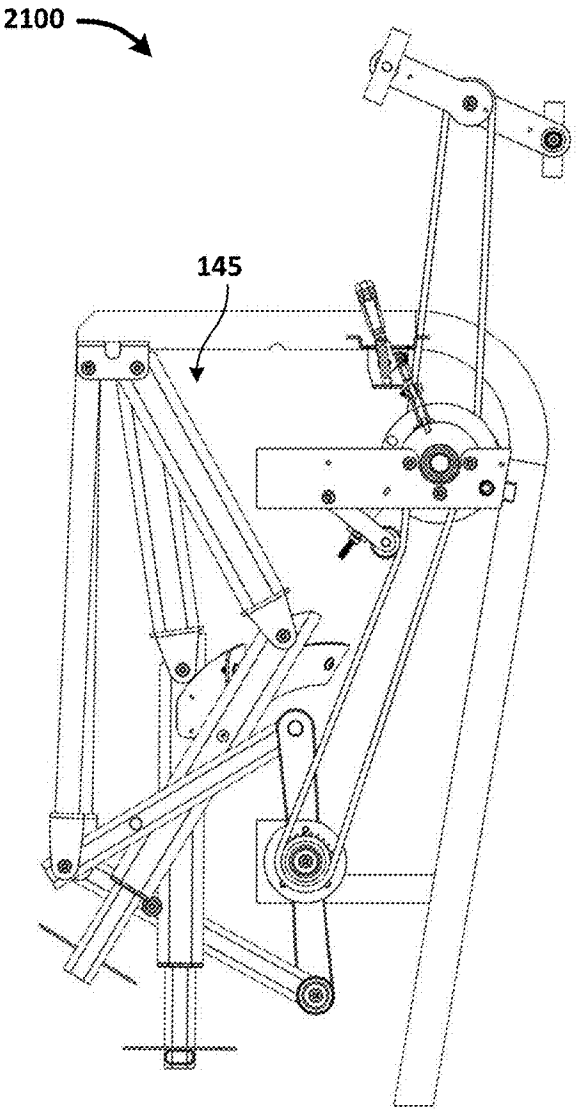
Figure 22B:
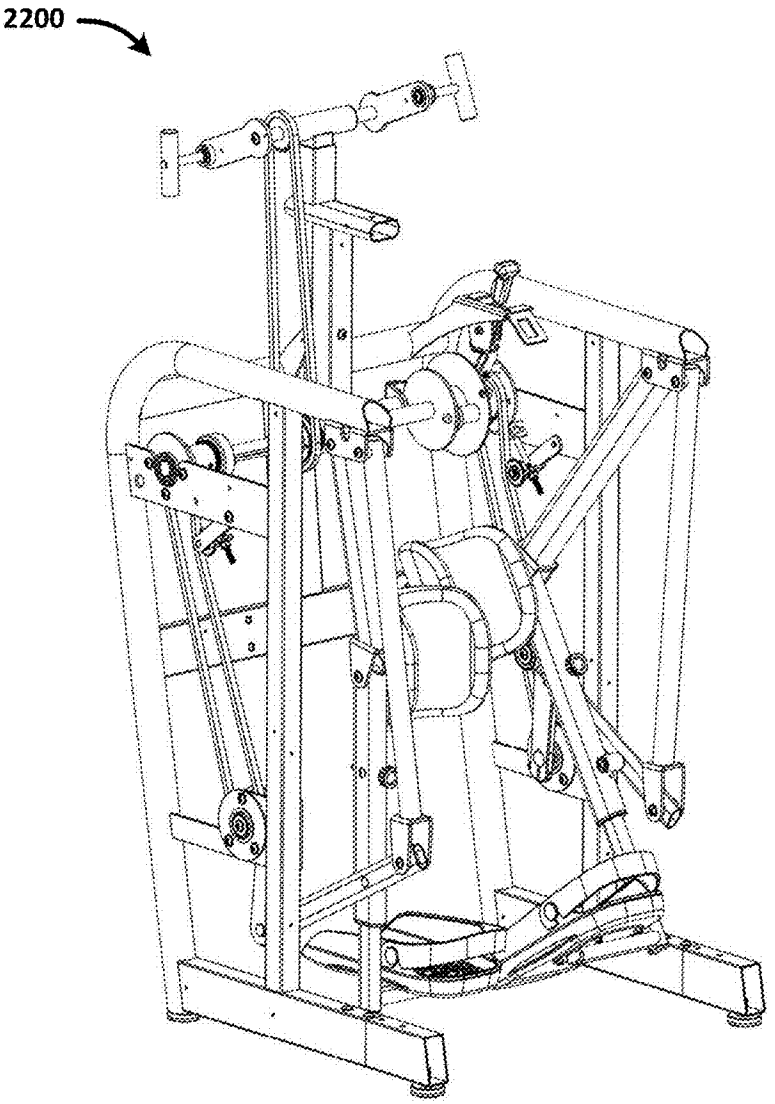
FIG. 22A and FIG. 22B depict an exemplary UBEGT in a deployed, walking mode.
Figure 22A:
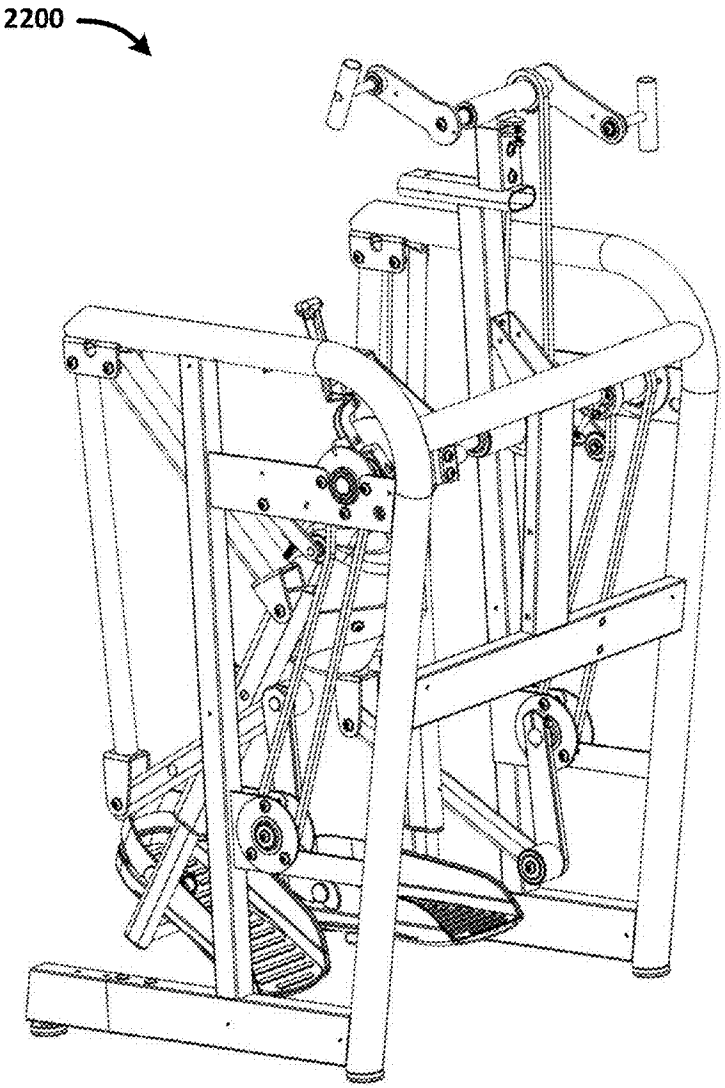

FIG. 20A and FIG. 20B depict a front-right and rear-left perspective view, respectively, of an exemplary UBEGT in a deployed, standing mode. FIG. 20C and FIG. 20D depict a right side and front-right perspective view, respectively, of an exemplary UBE, left and right gait therapy modules, and walk control module in a deployed, standing mode, and shown in an isolated view. FIG. 21A and FIG. 21B depict a right side and front-right perspective view, respectively, of the exemplary UBE, left and right gait therapy modules, and walk control module of FIGS. 20C-20D, in a deployed, walking mode. FIG. 22A and FIG. 22B depict an exemplary UBEGT in a deployed, walking mode.

In the assembled configuration 2000, left and right NGMs 145 are suspended from support frame 1305 at least partially by brackets 2002. In the isolated view 2001, a right and central portion of the support frame 1305 is removed for visibility. The UBE 505 operates the upper drive member 1910. The upper drive member 1910 rotatably connects the originating drive element 1905 of UBE 505 to a center drive element 1915A of the intermediate drive element 1915.

The intermediate drive element 1915 includes center drive element 1915A and left and right outer drive elements 1915B, all of which are mounted on a shaft of a drive module 2025. The shaft is supported on left and right ends by corresponding brackets 2010 mounted to corresponding left and right sides of the support frame 1305. The walk control module 1115 engages and disengages left and right drive elements 2005, corresponding to a standing and walking mode, respectively. As depicted in the configuration shown in the isolated view 2001, the walk control module 1115 is disengaged, co-aligning and releasably locking the NGMs 145 in the standing mode.

When the walk control module is engaged as shown in isolated configuration 2100 and assembled configuration 2200, the left and right drive elements 2005 tension the corresponding left and right lower drive elements 1925, respectively. When tensioned (engaged), the left and right lower drive elements 1925 operatively rotatably couple the left and right outer drive elements 1915B to the corresponding left and right direct drive elements 1930, respectively. The left and right direct drive elements 1930 are mounted by corresponding brackets 2015 to the left and right sides of the support frame 1305, respectively.

Accordingly, a user may advantageously transition the walk control module to a walk mode, operate the UBE 505, and drive a cyclical natural bipedal gait motion of the NGMs 145. The user may be supported in the NGMs 145 by the foot supports 140 and by corresponding knee supports mounted to left and right knee support brackets 2020.

Figure 23C:
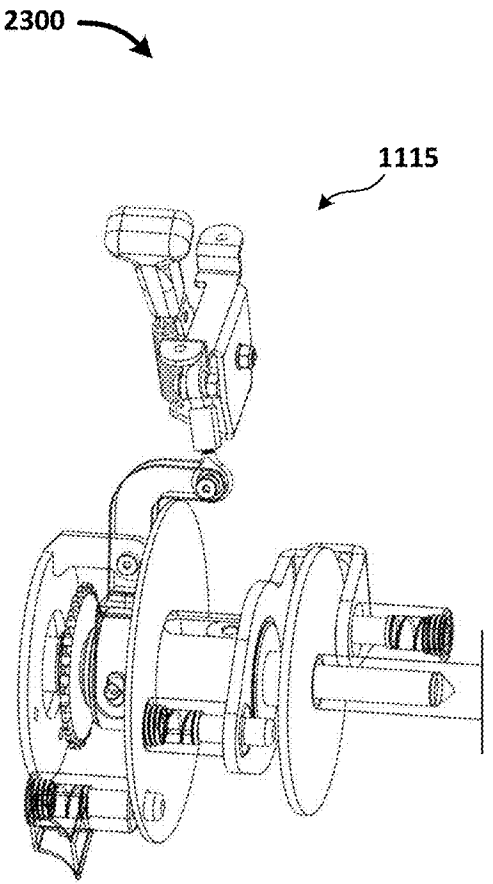
FIG. 23A, FIG. 23B, and FIG. 23C depict portions of a walk control module in a standing mode shown in an isolated view in a front view, a front view with selected housings displayed transparently, and a front-right view with the selected housings displayed transparently, respectively.
Figure 23B:
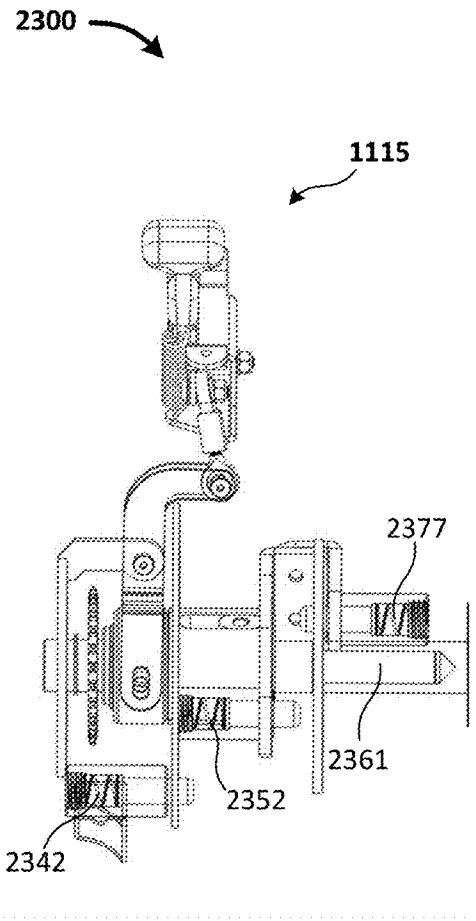
Figure 23A:
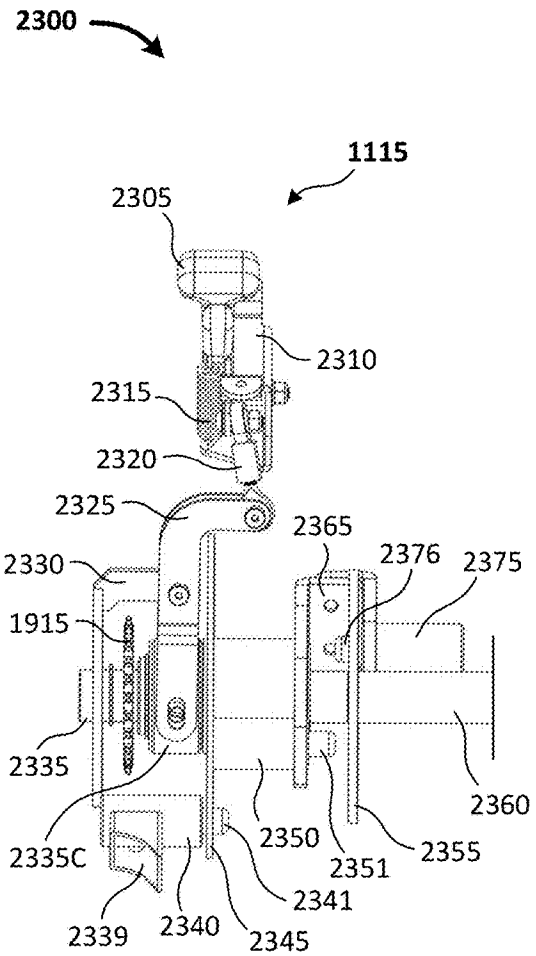

FIG. 23A, FIG. 23B, and FIG. 23C depict portions of a walk control module in a standing mode shown in an isolated view in a front view, a front view with selected housings displayed transparently, and a front-right view with the selected housings displayed transparently, respectively. The walk control module 1115 is provided with an actuation member, depicted as lever handle 2305. The lever handle 2305 is rotatably mounted in mounting bracket 2310. The mounting bracket 2310 may, for example, be mounted to a support frame (e.g., 1305 of FIG. 20C) of a UBEGT. A spring element 2315 is mounted to the lever handle 2305 and the bracket 2310, and may be configured, for example, to provide a 'snapping' action between an engaged and disengaged position of the lever handle 2305. Accordingly, the walk control module may advantageously be placed in either a walking (engaged) or standing (disengaged mode) and, for example, thereby prevent accidental injury or damage due to partial engagement and/or disengagement of the lever handle 2305.

The lever handle 2305 is rotatably coupled to a proximal end of a control linkage 2320. A distal end of the control linkage 2320 is rotatably coupled to a proximal end of a control arm 2325. The control arm 2325 is rotatably coupled to a mounting bracket 2330. The mounting bracket 2330 may, for example, mount to the support frame 1305 of the UBEGT. A distal end of the control arm 2325 is rotatably coupled to collar 2335C. The collar 2335C is mounted on shaft 2335 and axially slidable thereon. The collar 2335C abuts a plate 2345. The plate 2345 is assembled at least with a plunger housing 2350 and a bracket 2365 to form a unitary assembly (part of which is depicted as transparent in FIGS. 23A-24C, enabling visualization of normally hidden elements). A plunger 2341 releasably engages the plate 2345 via an aperture in the plate 2345. The plunger 2341 extends from a plunger housing 2340 and engages a spring element 2342 disposed therein. The plunger housing 2340 may be mounted (e.g., to a support frame of a UBEGT) via mounting element 2339.

A plunger 2351 extends from the plunger housing 2350 and engages a spring element 2352 disposed therein. As depicted, the plunger 2351 is disengaged from a plate 2355. A plunger 2376 extends from a plunger housing 2375 and engages a spring element 2377 therein. The plunger 2376 engages an aperture in the plate 2355, thereby releasably coupling the bracket 2365 and the plunger housing 2375 to the plate 2355. The plate 2355 is fixedly assembled to a shaft 2360. A shaft extension 2361 of the shaft 2335 axially assembles into the shaft 2360, thereby rotatably axially coupling the shaft 2335 to the shaft 2360.

Figures 24A, 24B, 24C:
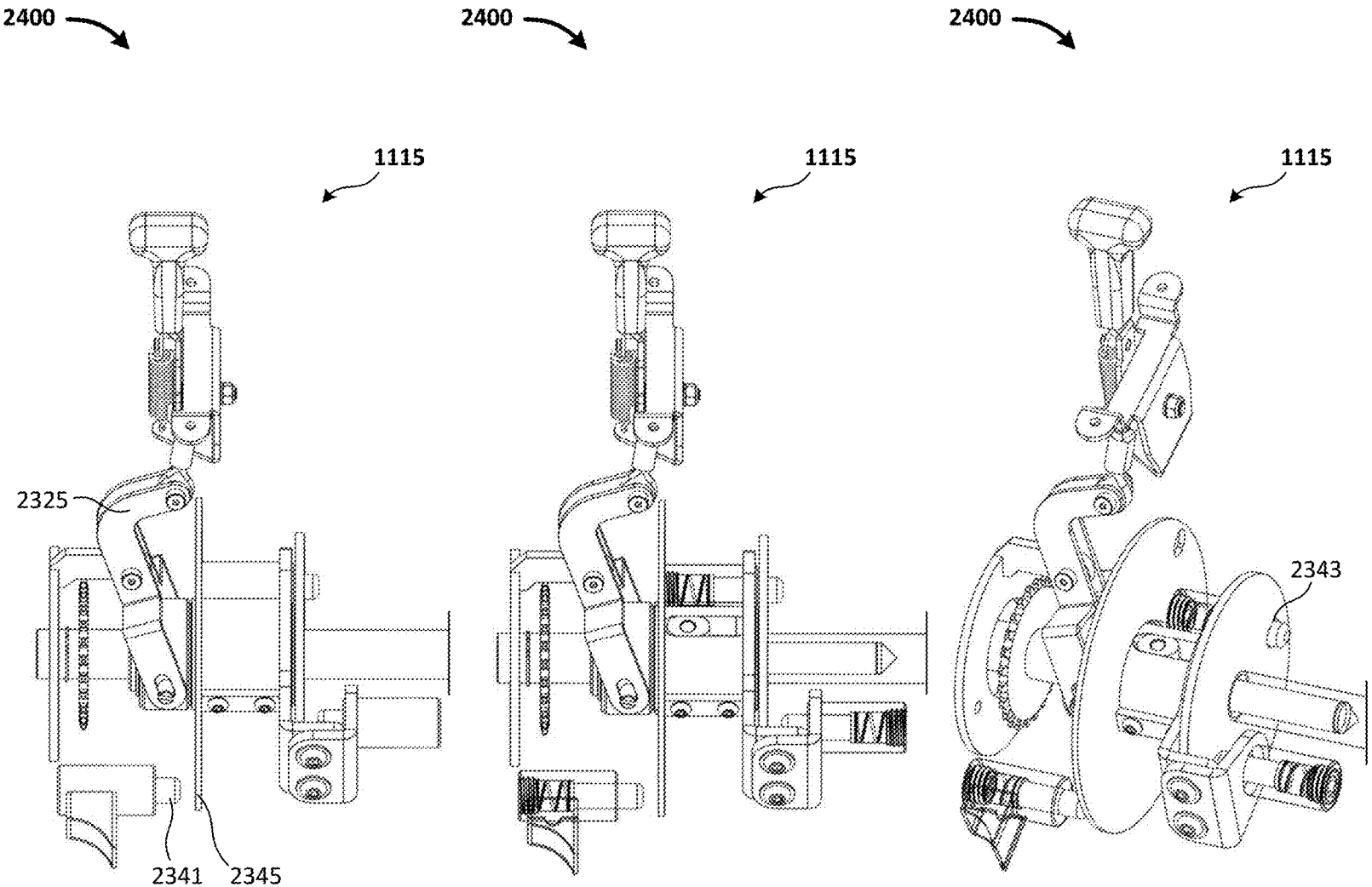
FIG. 24A, FIG. 24B, and FIG. 24C depict portions of the walk control module of FIGS. 23A-23C in a walking mode shown in an isolated view in a front view, a front view with selected housings displayed transparently, and a front-right view with the selected housings displayed transparently, respectively.

FIG. 24A, FIG. 24B, and FIG. 24C depict portions of the walk control module of FIGS. 23A-23C in a walking mode shown in an isolated view in a front view, a front view with selected housings displayed transparently, and a front-right view with the selected housings displayed transparently, respectively. The lever handle 2305 is pivoted rearward, lifting control arm 2325 via control linkage 2320. Lifting of the distal end of the control arm 2325 causes the control arm 2325 to pivot about bracket 2330, forcing the proximal end to pivot towards the plate 2345. The pivoting of the proximal end of the control arm 2325 towards the plate 2345 causes the collar 2335C to slide to the right (as viewed in FIGS. 24A-25C, but slid to the left relative to the UBEGT as depicted in various illustrations herein such as FIGS. 20A-22B) along the shaft 2335 towards the plate 2345.

As the collar 2335C slides to the right along the shaft 2335, the plate 2345 is likewise urged to the right and thereby disengaged from the plunger 2341. Rightward motion of the plate 2345 causes corresponding rightward motion of the plunger housing 2350, the plunger 2351, the bracket 2365, the plunger housing 2375, and the plunger 2376, together with corresponding spring elements. Accordingly, the plunger 2376 is disengaged from the plate 2355, and the plunger 2351 is engaged with the plate 2355. As the plunger 2351 engages plate 2355, if it is not aligned with the aperture 2343 in the plate 2355, the plunger 2351 is urged backwards within the plunger housing 2350, compressing spring element 2352. As the plate 2355 rotates relative to the plate 2345 and, thereby, to the plunger 2351, the plunger 2351 aligns with the aperture 2343 in the plate 2355. When the plunger 2351 is thereby aligned with the aperture 2343, the spring element 2352 extends the plunger 2351 out of the plunger housing 2350 into the aperture 2343, thereby engaging the plate 2355.

Figure 25:
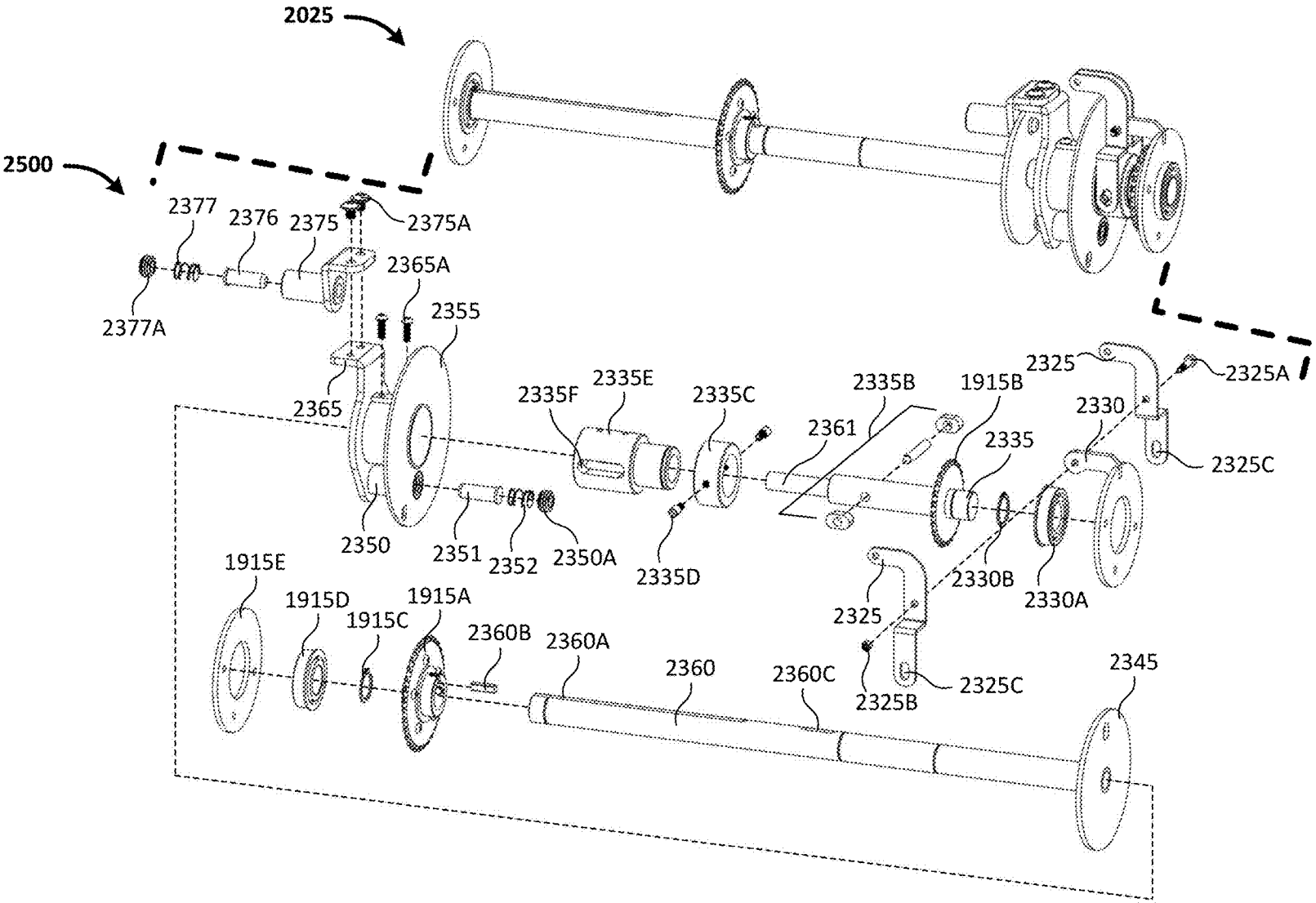
FIG. 25 depicts an exemplary walk control module in an assembled and exploded view.

FIG. 25 depicts an exemplary walk control module in an assembled and exploded view. The walk control module 2025 is shown in exploded view 2500, and includes elements of the drive module. The distal end of the control arm 2325 (made up of mirrored left and right brackets) is provided with a slot 2325C. The control arm 2325 is rotatably coupled to the bracket 2330 by bolt 2325A and nut 2325B passing through apertures in the control arm 2325 and the bracket 2330. The bracket 2330 axially assembles onto the bearing 2330A and abuts against a flange thereof. The bearing 2330A and a locking element 2330B axially assemble onto a proximal end of the shaft 2335. The shaft 2335 is provided with one of the left and right outer drive elements 1915B. The shaft 2335 is provided with an aperture therethrough. Guide assembly 2335B assembles to the shaft 2335 by a pin passing through the aperture of the shaft 2335 and engaging first and second guide elements on corresponding first and second ends of the pin. The collar 2335C is axially assembled onto the shaft 2335 on a distal side of the outer drive element 1915B. Coupling elements 2335D assemble into opposite sides of the collar 2335C from each other and rotatably and slidingly engage the corresponding slots 2325C in the control arm 2325.

A collar 2335E is axially assembled over the shaft 2335 distally of the collar 2335C. A proximal end of the collar 2335E assembles axially into a distal end of the collar 2335C. Matching longitudinal slots 2335F are provided on opposite sides of the collar 2335E, which the guide elements of the guide assembly 2335B slidingly engage. Accordingly, the collar 2335E is constrained to axial translation relative to the shaft 2335 and is rotationally coupled to the shaft 2335. The plate 2355, the bracket 2365, and the plunger housing 2350, as a unitary assembly, are axially assembled onto the collar 2335E and releasably coupled thereto via coupling elements (e.g., screws) 2365A. The plunger housing 2375 is releasably assembled to the bracket 2365 by fasteners 2375A.

The plunger 2351 and spring element 2352 are axially assembled into the plunger housing 2350 and secured therein by stopping element 2350A. Similarly, the plunger 2376 and the spring element 2377 are axially assembled into the plunger housing 2375 and secured therein by stopping element 2377A.

The shaft 2360 axially and rotatably assembles onto the shaft extension 2361 of the shaft 2335. A key 2360B assembles into a slot 2360C of the shaft 2335. The center drive element 1915A axially assembles over the shaft 2360 and the key 2360B, thereby being rotationally coupled to the shaft 2360. A locking element 1915C axially assembles over the shaft 2360 and abuts the center drive element 1915A. A plate 1915E axially assembles over a bearing 1915D and axially assembles over the distal end of the shaft 2360 to abut a distal side of the locking element 1915C. A second outer drive element 1915B is not shown assembled onto and rotationally coupled to the shaft 2360 proximally to the plate 1915E and distally to the center drive element 1915A.

Apertures may be provided in the plate 1915E, the plate 2355, the plate 2345, and/or the bracket 2330. In the depicted embodiment the bracket 2330 at the proximal end of the walk control module 2025 and the corresponding plate 1915E at the distal end of the walk control module 2025 are each provided with a matching plurality of apertures by which the walk control module 2025 and the elements of the drive module incorporated therewith are mounted to the brackets 2010. The aperture(s) in the plate 2355 and the plate 2345 provide for predetermined rotational coupling of the shaft 2360 and the shaft 2335.

Accordingly, in a standing mode, the shaft 2360 and the shaft 2335 may be rotated into a first predetermined angular orientation. In the first predetermined angular orientation, the left and right NGMs 145 are co-aligned so that a user standing in the corresponding foot supports 140 may have their left and right feet and legs aligned substantially in a coronal plane (also referred to as a frontal plane) of the user's body, and aligned such that the coronal plane is substantially parallel to a longitudinal axis of the shaft 2360 and the shaft 2335.

In a walking mode, the shaft 2360 and the shaft 2335 may be rotated into a second predetermined angular orientation. In the depicted embodiment, the second predetermined orientation is rotationally offset by 180 degrees (half of a complete revolution) from the first predetermined angular orientation. In various embodiments, other offset(s) may be used. In the second predetermined angular orientation, the left and right NGMs are offset so that a user may operate the NGMs 145 and simulate a desired gait cycle. In the depicted embodiment, the NGMs 145 are offset by 180 degrees, corresponding to a natural bipedal gait cycle in which the left and right feet are offset in the gait cycle by substantially one-half of the period of the gait cycle. Accordingly, various embodiments may advantageously provide a plurality of predetermined relationships between a plurality of NVMs.

Figure 26B:
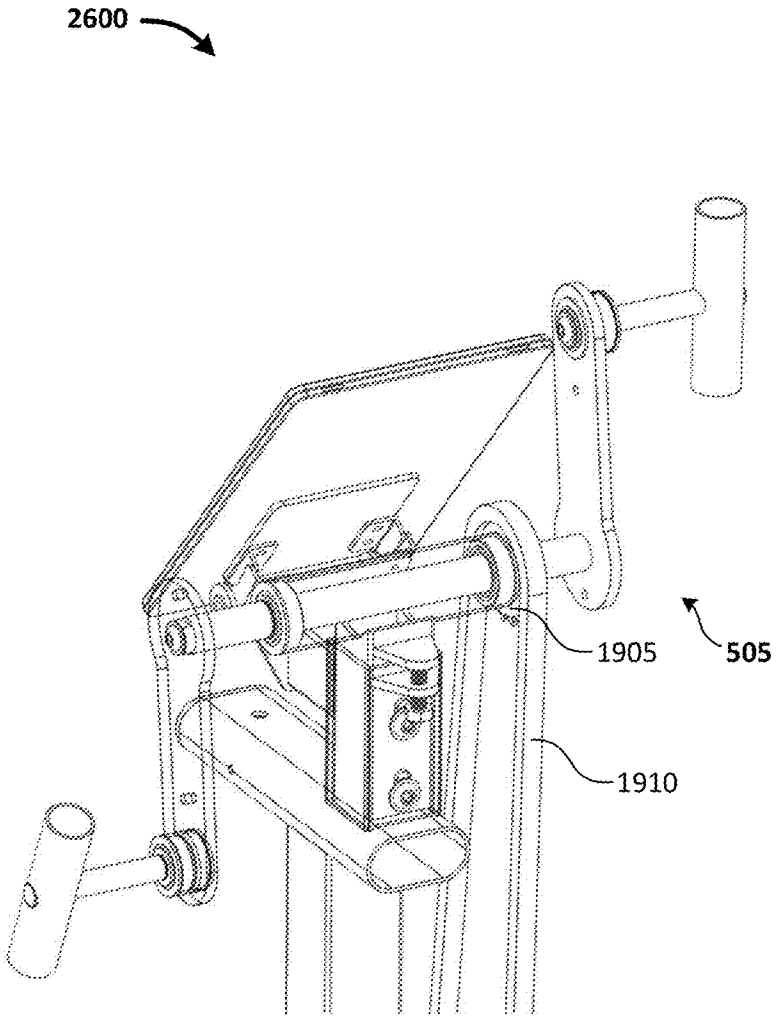
FIG. 26B depicts the exemplary UBE with selected elements displayed transparently.
Figure 26A:
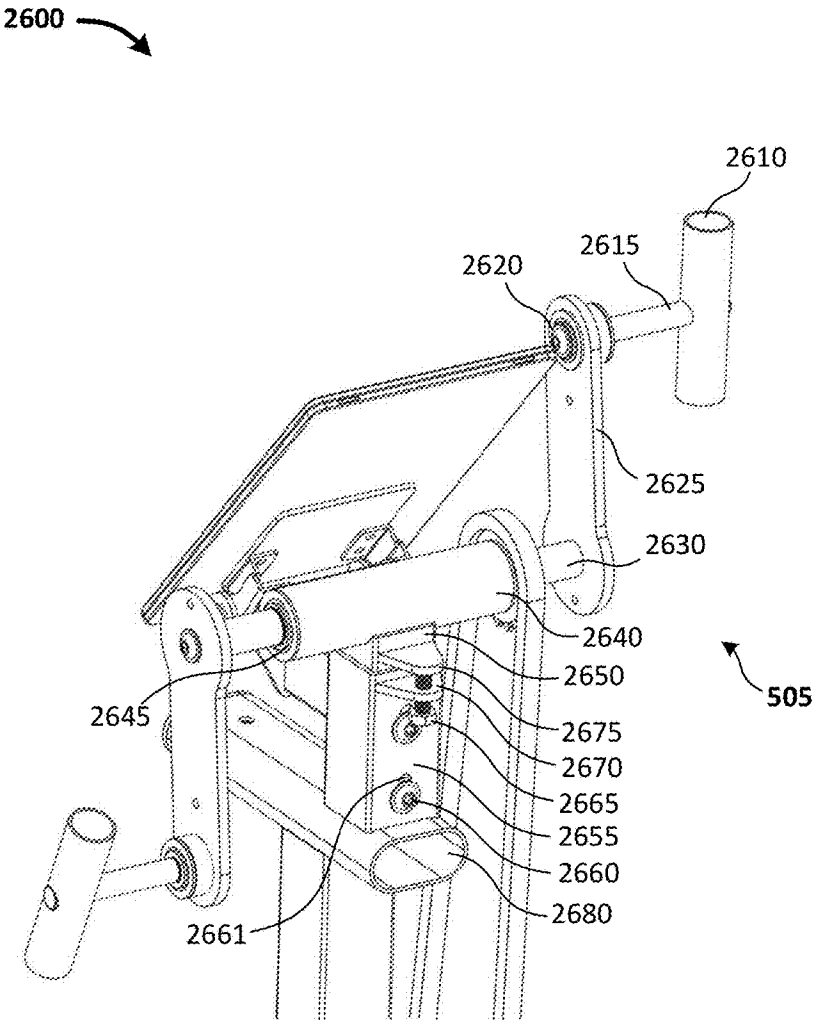
FIG. 26A depicts an exemplary UBE with drive belt adjustment.

FIG. 26A depicts an exemplary UBE with drive belt adjustment, and FIG. 26B depicts the exemplary UBE with selected elements displayed transparently. A UBE 505 is provided with left and right handles 2610. Each handle 2610 is mounted to a corresponding shaft 2615. Each shaft 2615 is rotatably coupled to a distal end of a corresponding arm 2625 via a pivot joint 2620. Each arm 2625 is mounted to a corresponding end of a central shaft 2630. The shaft 2630 is rotatably mounted within a cross-piece 2640 via left and right pivot members (e.g., bearing units) 2645. The cross-piece 2640 is fixed to a vertical shaft 2650. The vertical shaft 2650 slidingly axially assembles with receiving shaft 2655. The receiving shaft 2655 is attached (e.g., welded) to a mounting unit 2680.

The vertical shaft 2650 is releasably fixed in relation to the receiving shaft 2655 via coupling members 2660 (e.g., screws). Slots 2661 are provided in the receiving shaft 2655 such that the coupling members 2660 pass through the slots and couple to the vertical shaft 2650. The slots 2661 are configured to allow a predetermined range of axial translation of the vertical shaft 2650 within the receiving shaft 2655 when the coupling members 2660 are released (e.g., at least partially unscrewed). In various embodiments, the slots may be replaced, for example, with threaded holes and the coupling members 2660 may be configured as set screws. The receiving shaft is provided with a first adjustment feature 2670, through which is threaded an adjustment member 2665. A distal end of the adjustment member 2665 engages a lower surface of a second adjustment feature 2675. The second adjustment feature 2675 is attached to the vertical shaft 2650.

Accordingly, a user may release the coupling members 2660, and operate the adjustment member 2665 in a first rotational direction (e.g., clockwise when viewed from a proximal end of the adjustment member 2665) to axially advance the adjustment member 2665 distally through the first adjustment feature 2670. As the adjustment member 2665 advances distally, the distal end thereof urges the second adjustment feature 2675 away from the first adjustment feature 2670. Accordingly, the vertical shaft 2650 is advanced upwards within the receiving shaft 2655. As the vertical shaft 2650 advances upwards, the originating drive element 1905, which is attached to the shaft 2630, is advanced upwards, thereby tensioning the upper drive member 1910. Similarly, the adjustment member 2665 may be operated in an opposite rotational direction (e.g., counterclockwise) to lower the originating drive element 1905 and reduce the tension of the upper drive member 1910. Accordingly, a user may advantageously adjust the tension of the upper drive member 1910.

Figure 27A:
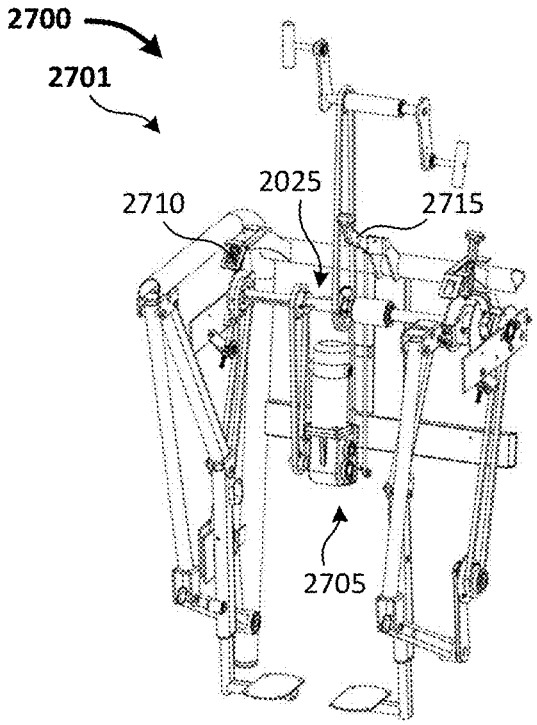
FIG. 27A and FIG. 27B depict an exemplary UBEGT with a cutaway support frame from a rear-right and front-left perspective, respectively.
Figure 27B:
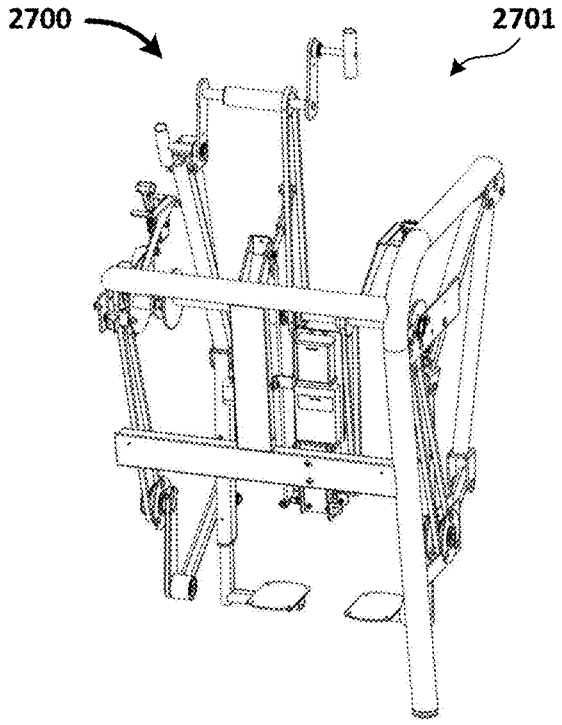
Figure 27C:
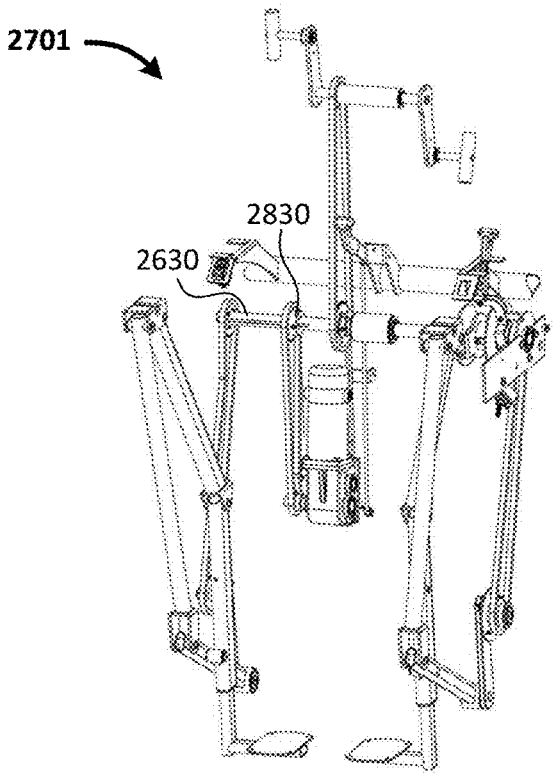
FIG. 27C and FIG. 27D depict the exemplary UBEGT in progressively isolated views from a rear-right and front-left view, respectively.
Figure 27D:
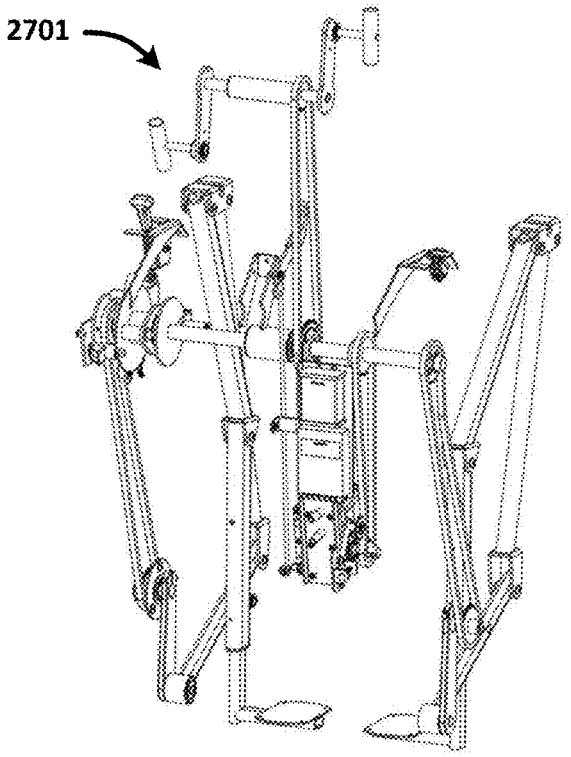
Figure 28B:
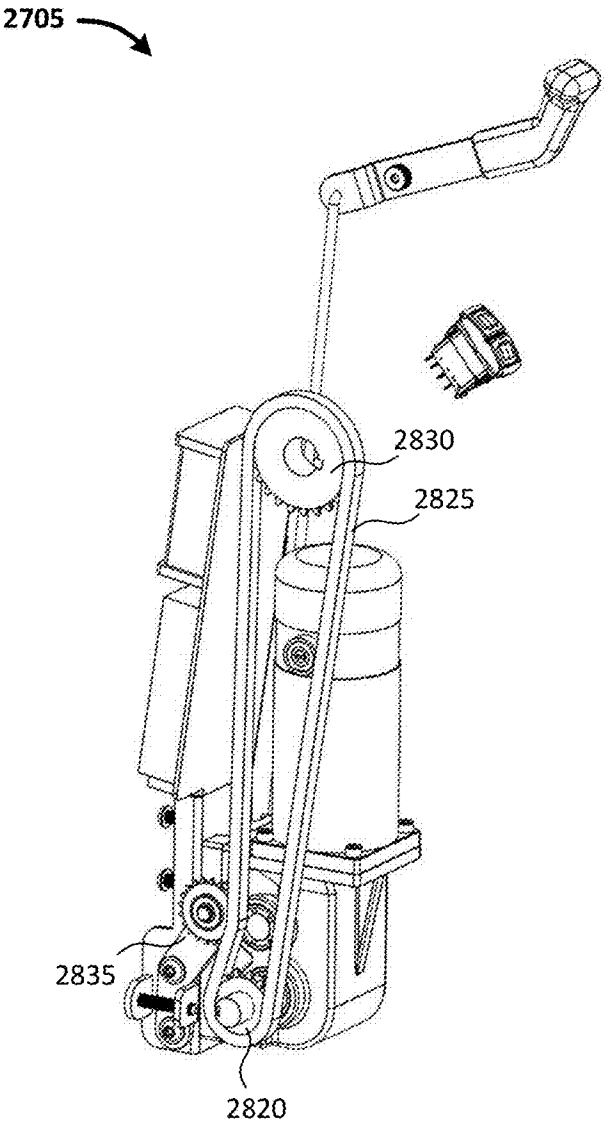
FIG. 28A and FIG. 28B depict an exemplary powered walk drive module from a left-rear and front-right view, respectively.
Figure 28A:
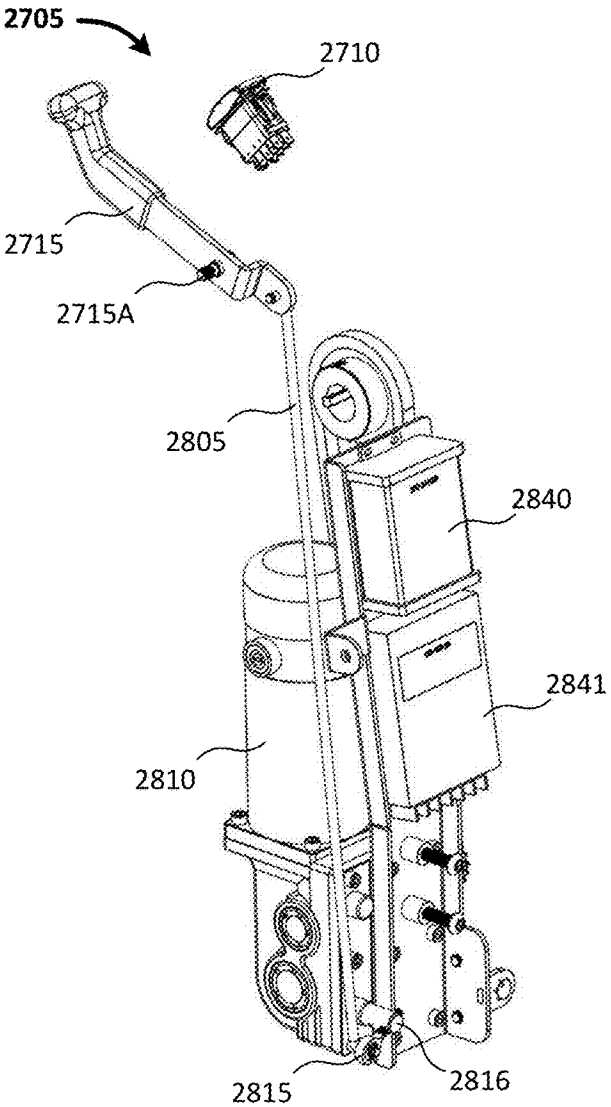

FIG. 27A and FIG. 27B depict an exemplary UBEGT with a cutaway support frame from a rear-right and front-left perspective, respectively. FIG. 27C and FIG. 27D depict the exemplary UBEGT in progressively isolated views from a rear-right and front-left view, respectively. FIG. 28A and FIG. 28B depict an exemplary powered walk drive module from a left-rear and front-right view, respectively. A UBEGT 2700 is provided with a drive module assembly 2701 including the walk control module 2025 and a powered drive module 2705, as shown within a cutaway support frame. The powered drive module 2705 is controlled by a user via an actuation input 2710 and an engagement control 2715. The powered drive module drives the shaft 2630 of the walk control module 2025 by driving an auxiliary drive member 2825 (e.g., a chain or belt) rotatably connected to an auxiliary central drive element 2830 (e.g., gear or pulley) rotationally fixed (e.g., by a key and slot assembly) to the shaft 2630. Accordingly, a user may advantageously operate NGMs 145 and achieve lower body exercise and/or therapy via a powered drive module without requiring exercise of the upper body by driving the NGMs via a UBE.

The powered drive module 2705 is engaged and disengaged by operation of the engagement control 2715 (e.g., a lever handle), which is rotatably connected to a bracket on the support frame of the UBEGT via a pivot joint 2715A. The engagement control 2715 (e.g., lever handle, as depicted) is rotatably connected to a linkage rod 2805. The linkage rod 2805 pivotally connected to an actuation shaft 2816 via a pivot joint 2815. Operation of the engagement control 2715 causes the linkage rod 2805 to push or pull the pivot joint 2815, thereby causing the actuation shaft 2816 to rotate counterclockwise (when viewed from the front of the UBEGT) or clockwise, respectively. Clockwise and counterclockwise rotation of the actuation shaft 2816 engages or disengages a tensioning element 2835. Engagement of the tensioning element 2835 tensions the auxiliary drive member 2825, thereby rotatably engaging a powered drive element 2820 to the auxiliary central drive element 2830 via the auxiliary drive member 2825. Accordingly, a user may advantageously engage or disengage the powered drive module 2705 by an easily accessible engagement control 2715.

A powered motor (e.g., an electric motor such as an induction, servo, or stepper motor) 2810 is configured and operably connected to drive the powered drive element 2820. The motor is controlled by control circuits 2840 and 2841. The user may provide input to the control circuits 2840 and/or 2841 via the actuation input 2710. The actuation input 2710 may, for example, provide a first and a second button which may, by way of example and not limitation, correspond to speed of the motor 2810 (e.g., a first button for increasing speed and a second button for decreasing speed). In various embodiments, other attributes may be controlled such as, by way of example and not limitation, resistance provided by the motor, direction of the motor 2810 and/or the powered drive element 2820. Accordingly, a user may advantageously adjust the resulting gait. Various embodiments may, for example, advantageously offer a robotic gait trainer in a maximally compact footprint and volume.

Figure 29:
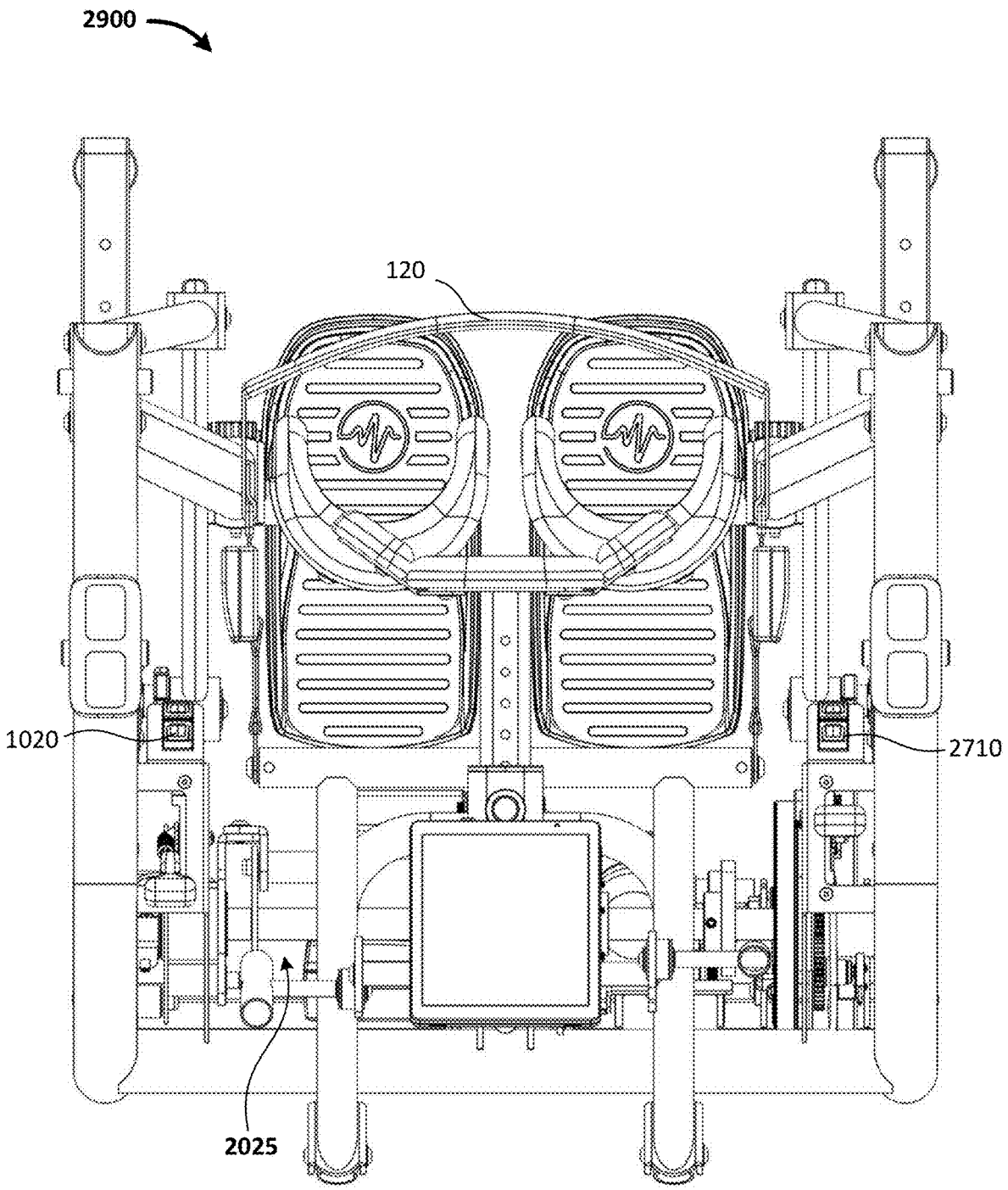
FIG. 29 depicts a top view of an exemplary UBEGT. The UBEGT 2900 is provided with a power lift module (e.g., power lift module 1005 in FIGS. 10A-C) operated by the input element 1020.

FIG. 29 depicts a top view of an exemplary UBEGT. The UBEGT 2900 is provided with a power lift module (e.g., power lift module 1005 in FIGS. 10A-C) operated by the input element 1020. The UBEGT 2900 is also provided with a powered drive module (e.g., 2705 in FIGS. 27A-28B) to drive the walk control module 2025. The powered drive module may be at least partially operated by the actuation input 2710.

Figure 30A:
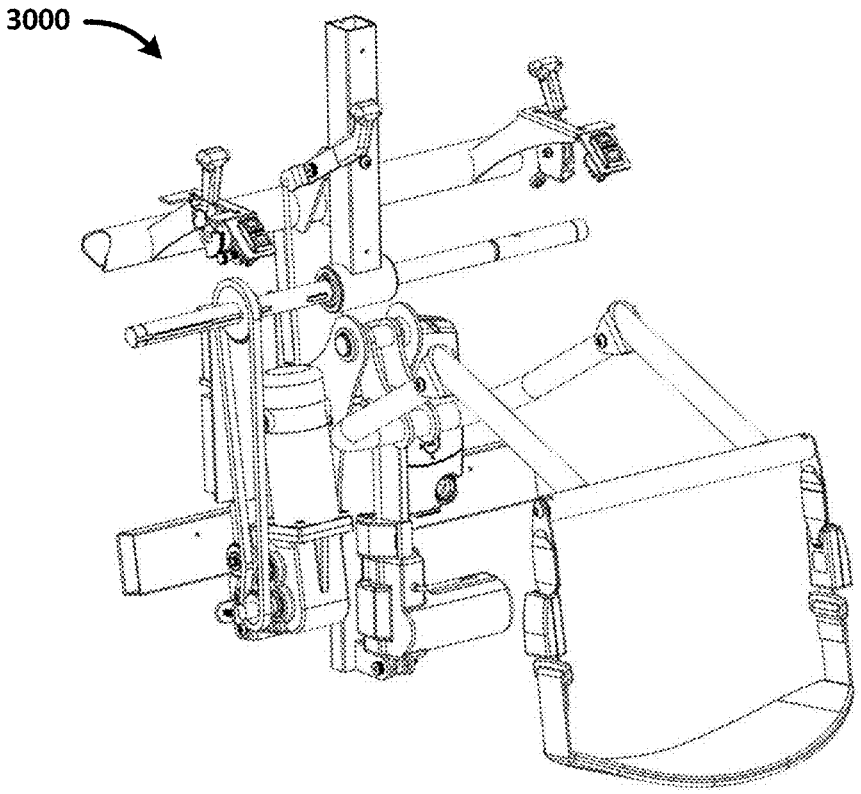
FIG. 30A and FIG. 30B depict an exemplary isolated portion of a UBEGT provided with an exemplary powered walk drive module and an exemplary powered lift support module.
Figure 30B:
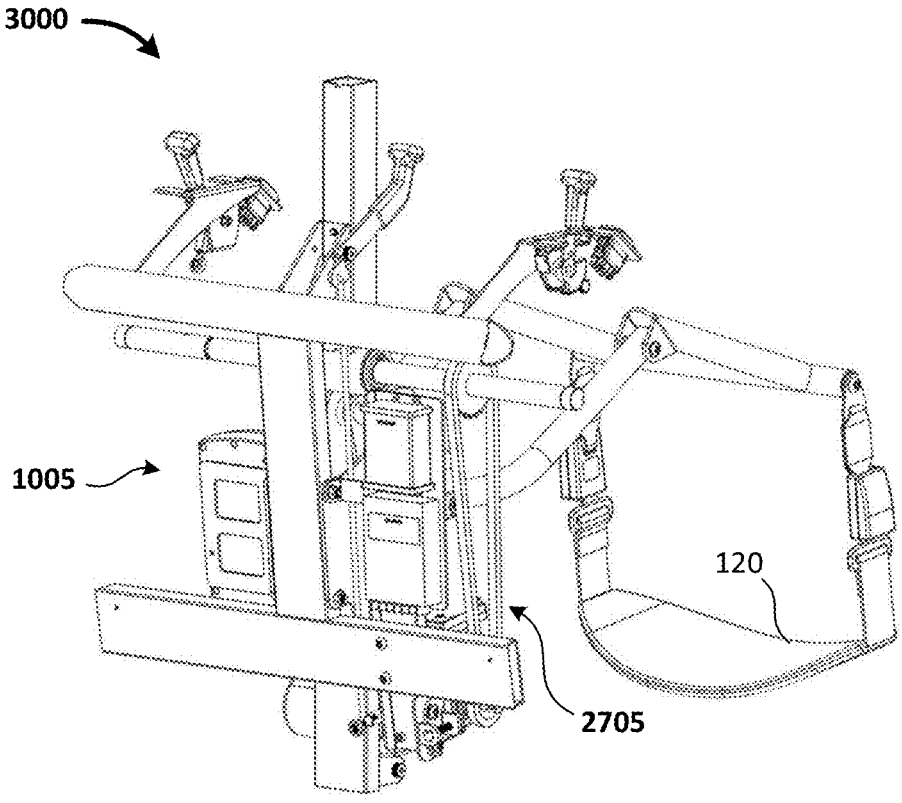

FIG. 30A and FIG. 30B depict an exemplary isolated portion of a UBEGT provided with an exemplary powered walk drive module and an exemplary powered lift support module. The assembly 3000 is provided with power lift module 1005 to operate lift strap 120. The assembly 3000 is further provided with powered drive module 2705. Accordingly, a user with little or no upper body strength and/or a user who does not wish to form upper body exercises and/or therapy can still use the UBEGT for lower body exercise and/or therapy.

Figure 31B:
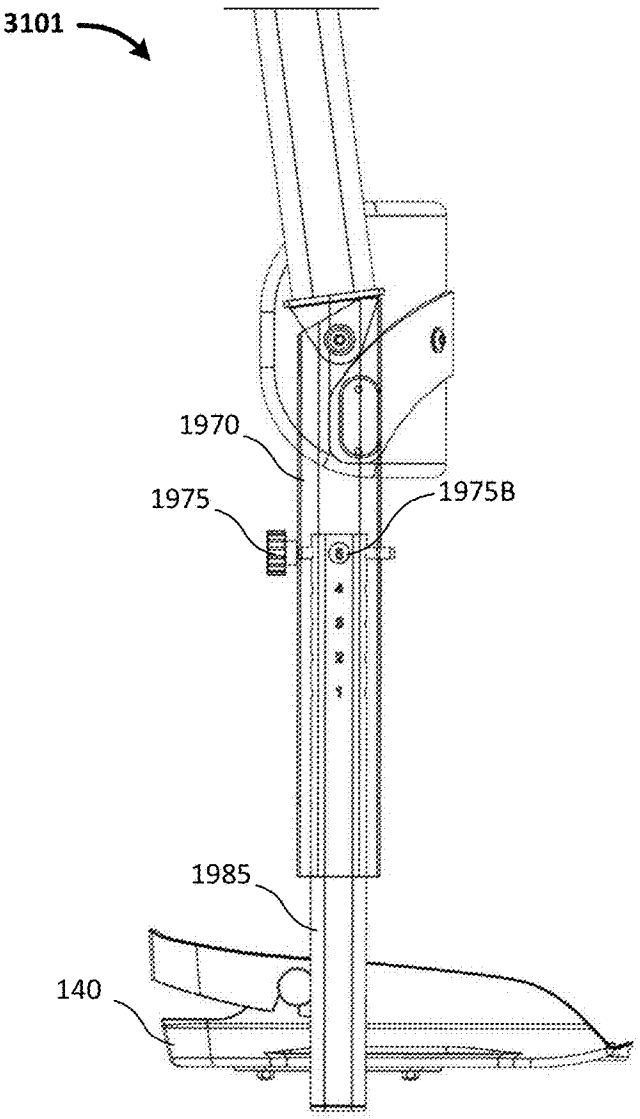
FIG. 31B depicts the portion of the exemplary gait therapy module of FIG. 31A in a maximally extended configuration.
Figure 31A:
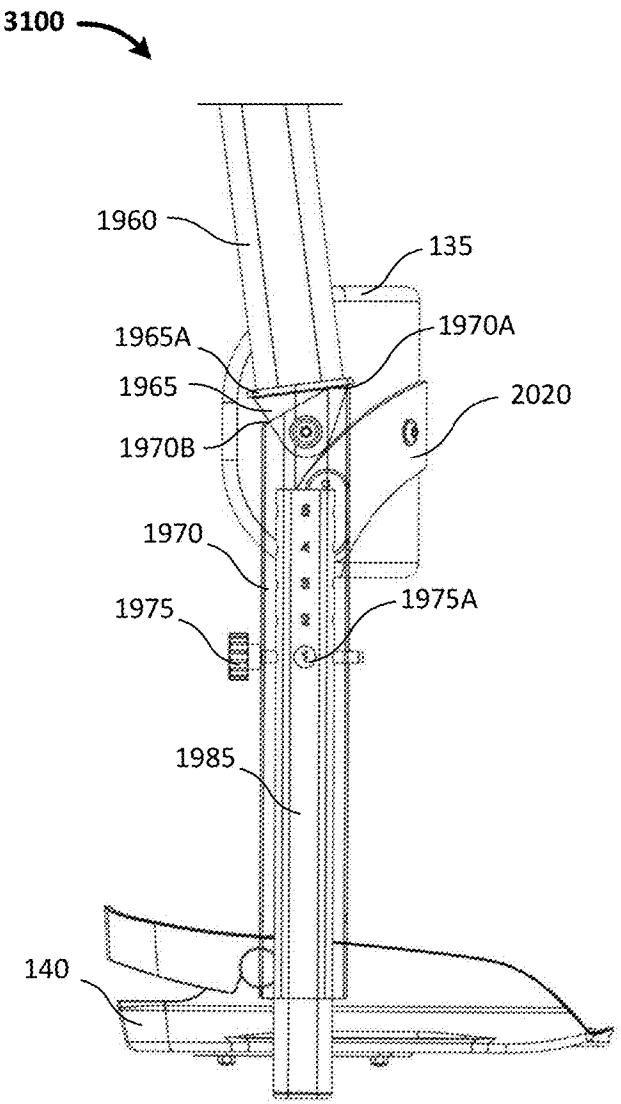
FIG. 31A depicts a portion of an exemplary gait therapy module in a standing state in an un-extended configuration.

FIG. 31A depicts a portion of an exemplary gait therapy module in a standing state in an un-extended configuration. FIG. 31B depicts the portion of the exemplary gait therapy module of FIG. 31A in a maximally extended configuration. The foot support 140 is mounted to the distal end of the extension arm 1985. The extension arm 1985 is releasably coupled in relation to the lower arm 1970 via securing element 1975. In a maximally retracted configuration 3100, the securing element 1975 is aligned with a first (lowest) aperture 1975A of a plurality of apertures (labelled 1-5 in the depicted embodiment) through the extension arm 1985. In a maximally extended configuration 3101, the securing element 1975 is aligned with a fifth (highest) aperture 1975B of the plurality of apertures. In various embodiments, a variety of aperture quantities and/or spacings may be provided. In various embodiments, a set screw(s) or other releasable coupling mechanism may be provided. Accordingly, a user may advantageously adjust a distance between the knee support 135 and the foot support 140 to fit the user.

As discussed in relation to FIG. 19A, the pivot member 1965 is provided with an engagement surface 1965A configured to engage with a front edge 1970A and/or a rear edge 1970B of the proximal end of the lower arm 1970. Accordingly, the interaction between the pivot member 1965 and the proximal end of the lower arm 1970 constrains the angle of the lower arm 1970 relative to the upper arm 1960. In various embodiments, the geometry of the front edge 1970A, the rear edge 1970B and/or the engagement surface 1965A may be predetermined in various configurations and/or adjustable to enable various ranges of motion of the lower arm 1970 relative to the upper arm 1960.

Figure 32A:
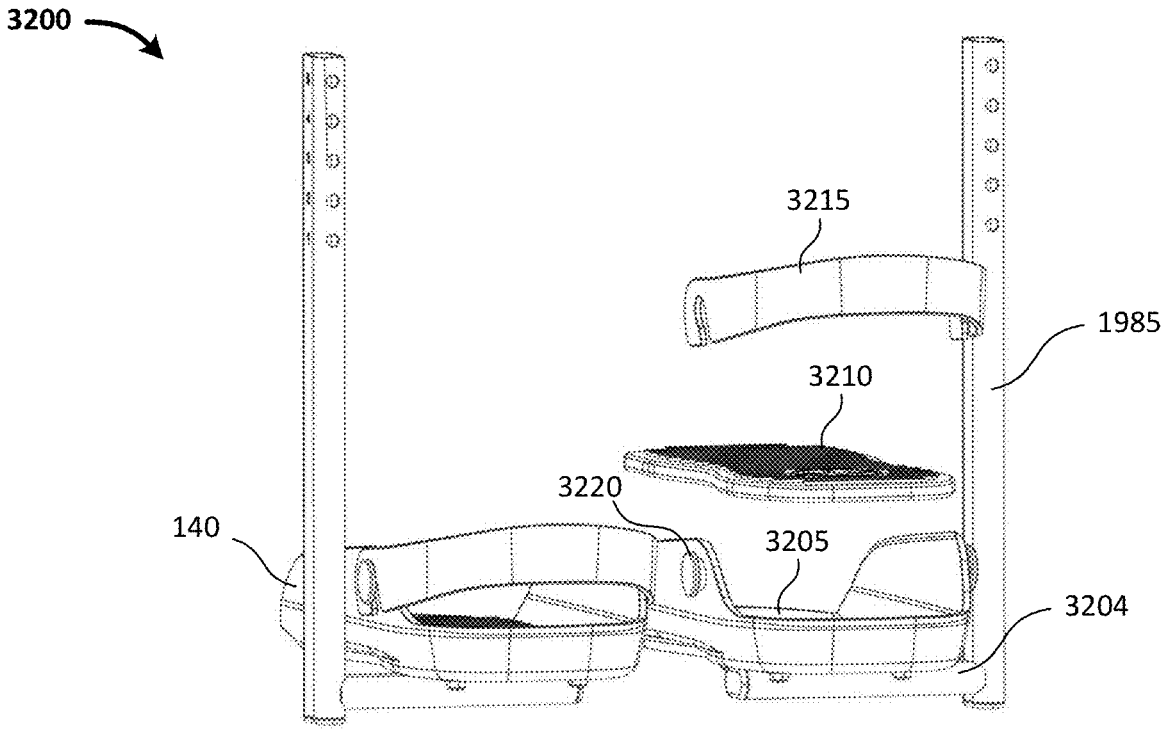
FIG. 32A depicts a first left exemplary foot support assembly in an assembled view and a first right exemplary foot support assembly in an exploded view.

FIG. 32A depicts a first left exemplary foot support assembly in an assembled view and a first right exemplary foot support assembly in an exploded view. The assembled foot support 140 is mounted to the extension arm 1985. A mounting member 3204 extends laterally inward (towards the adjacent NGM 145) from the extension arm 1985. A base platform 3205 is mounted to the mounting member 3204. A tread 3210 is disposed within the base platform 3205. Left and right retaining elements 3220 extend laterally from left and right sides, respectively, of the base platform 3205. A heel retaining strap 3215 releasably couples (e.g., snaps over) the left and right retaining elements 3220. Accordingly, in various embodiments, the foot support configuration 3200 may advantageously provide a comfortable foot support, an easily engaged foot support, or some combination thereof.

Figure 32B:
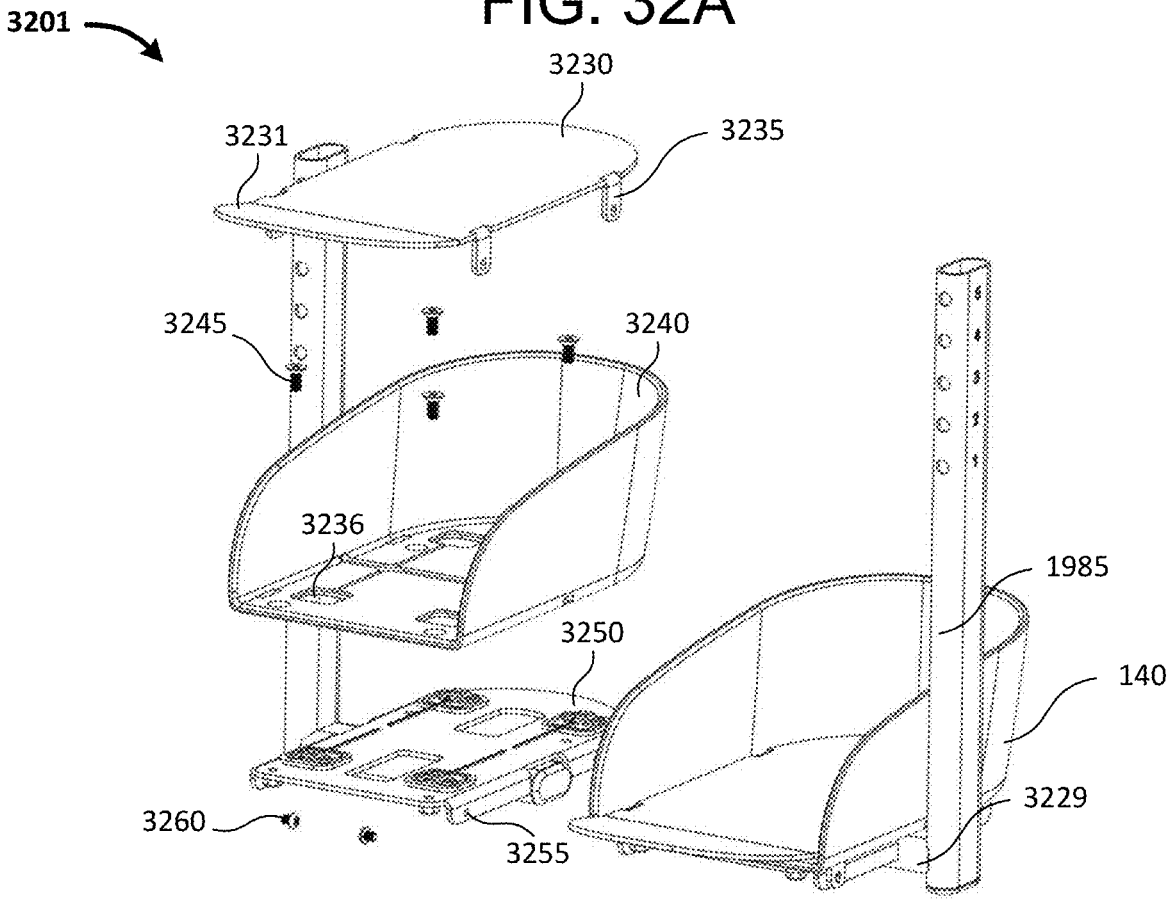
FIG. 32B depicts a second left exemplary foot support assembly in an assembled view and a second right exemplary foot support assembly in an exploded view.

FIG. 32B depicts a second left exemplary foot support assembly in an assembled view and a second right exemplary foot support assembly in an exploded view. The assembled foot support 140 is mounted to the extension arm 1985 via a mounting member 3229. A mounting platform 3250 is coupled (e.g., welded, screwed, riveted, unitarily formed) to the mounting member 3229. A foot guard 3240 is releasably coupled to the mounting platform 3250 via coupling members (e.g., screws) 3245. A foot plate 3230 provided with a plurality of tabs 3235 is disposed within the foot guard 3240. The tabs 3235 extend through apertures 3236 in the foot guard 3240. Coupling members 3260 couple the tabs 3235 of the foot plate 3230 to the mounting platform 3250 via apertures 3255. The foot plate 3230 is provided with an upward-angled lip 3231.

Accordingly, in various embodiments, the foot support configuration 3201 may advantageously provide a high-walled foot support, which a user may walk forward into. The lip 3231 may allow a user to easily remove their foot from the foot support while gently urging the foot forward. The foot guard 3240 may prevent a user's foot from sliding forward off of the foot support. In various embodiments, the foot support may be configured either to place a user's toe or a user's heel into the back of the foot support 140, i.e., into the region with the highest wall.

Figure 33:
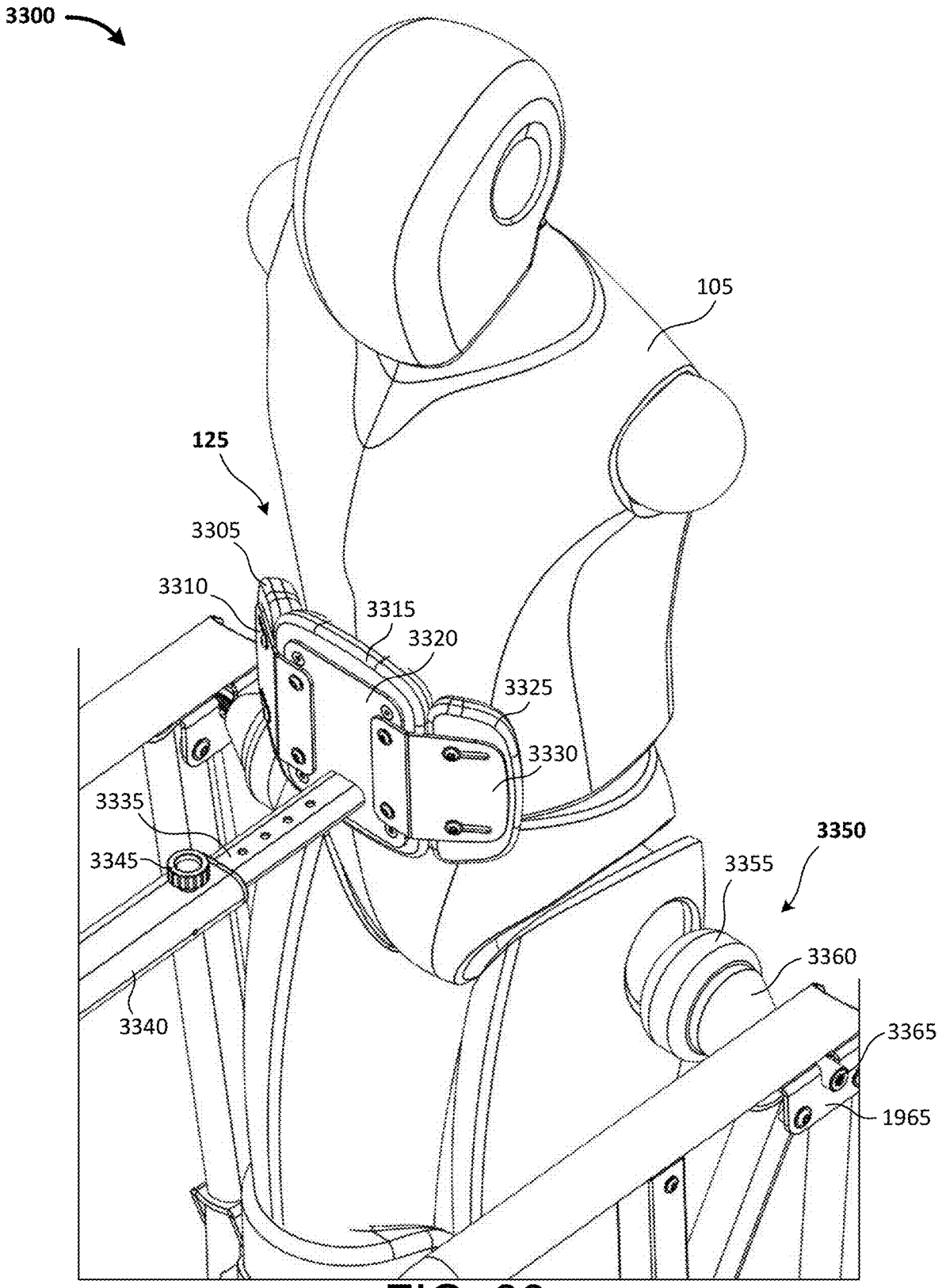
FIG. 33 depicts a portion of an exemplary UBEGT provided with an exemplary abdominal module and an exemplary hip support module.
Figure 34A:
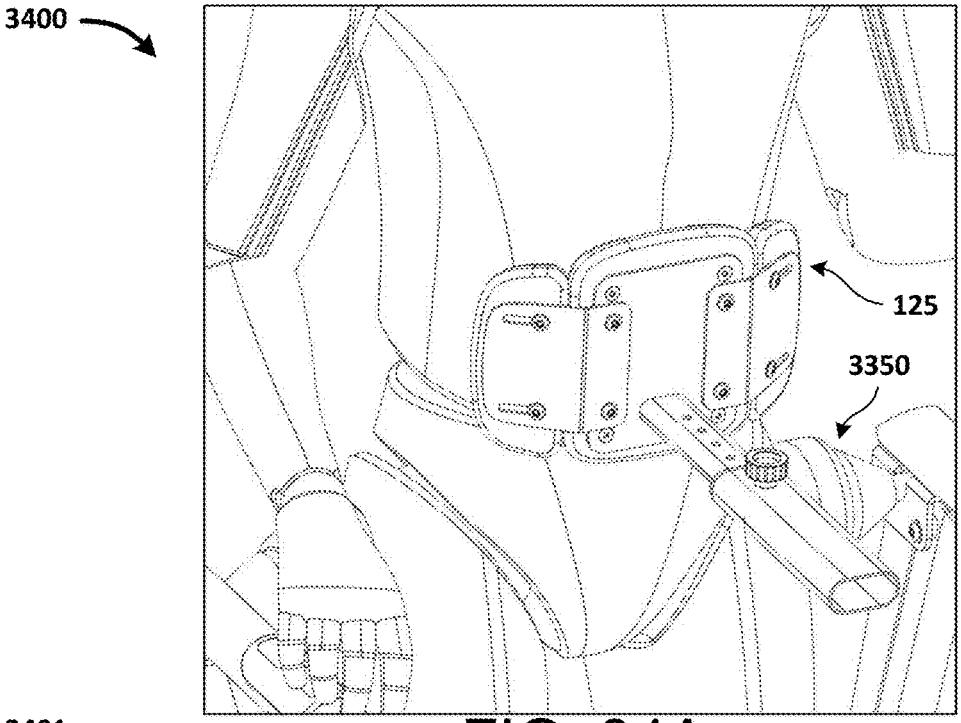
FIG. 34A depicts the exemplary UBEGT and provided exemplary abdominal module and exemplary hip support module of FIG. 33 from a front-right perspective.
Figure 34B:
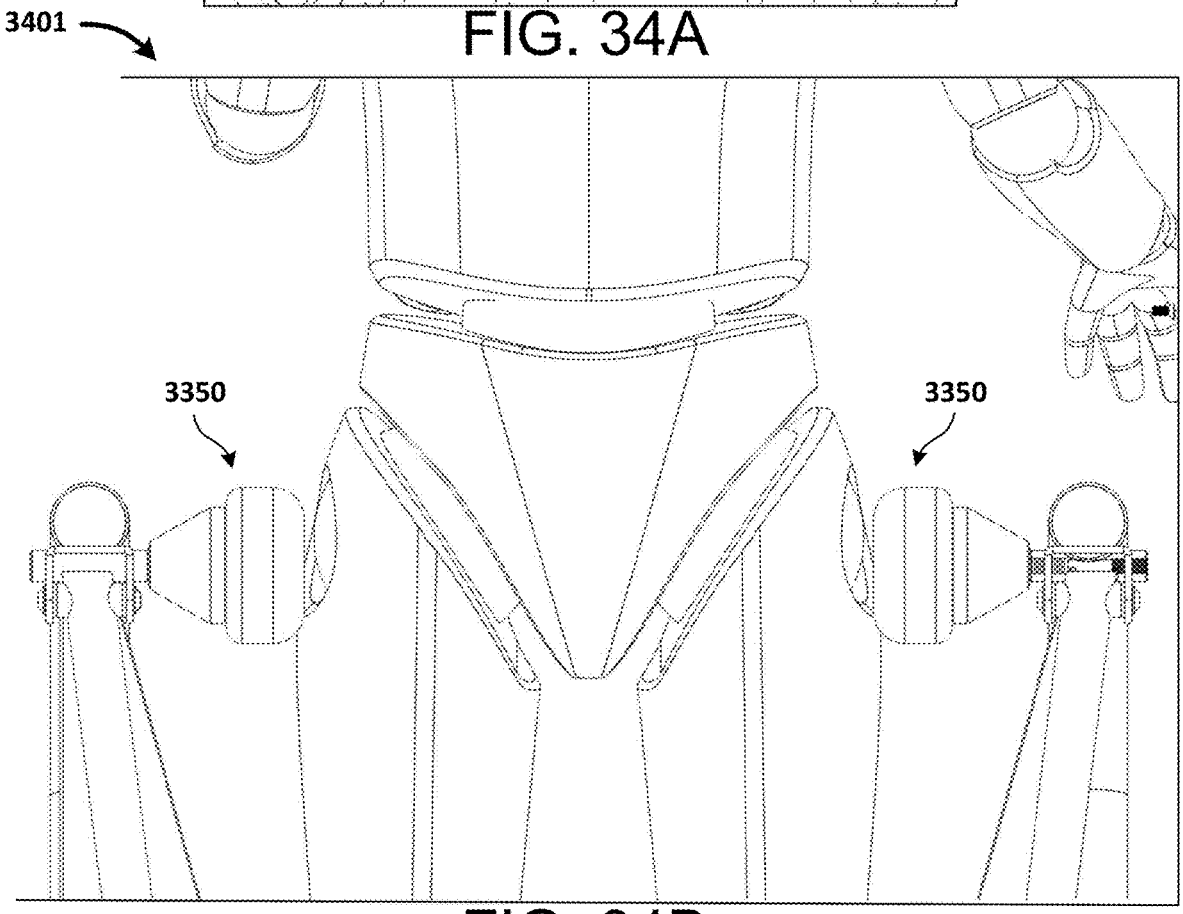
FIG. 34B depicts the exemplary hip support module of FIG. 33 and FIG. 34A.

FIG. 33 depicts a portion of an exemplary UBEGT provided with an exemplary abdominal module and an exemplary hip support module. FIG. 34A depicts the exemplary UBEGT and provided exemplary abdominal module and exemplary hip support module of FIG. 33 from a front-right perspective. FIG. 34B depicts the exemplary hip support module of FIG. 33 and FIG. 34A. The abdominal module 125 is configured to support an abdominal area of the patient 105. The abdominal support module is mounted to the support frame of the UBEGT via a receiving element 3340 extending from the support frame. A proximal end of an extension element 3335 is slidingly axially assembled into a distal end of the receiving element 3340. A coupling element 3345 (e.g., pin, screw, set screw) releasably couples the extension element 3335 to the receiving element 3340 to releasably fix the extension element 3335 relative to the receiving element 3340.

A central bracket 3320 is coupled (e.g., welded, adjustably coupled) to a distal end of the extension element 3335. A left bracket 3330 and a right bracket 3310 are coupled to a left and a right edge of the central bracket 3320, respectively. A central pad 3315 is coupled to the central bracket 3320. Left and right pads 3325 and 3305 are coupled to the left and right brackets 3330 and 3310, respectively. The brackets 3330 and/or 3310 may be, for example, formed into a predetermined angle or may be adjustable. The pads 3315, 3325, and 3305 are configured to cushion the patient 105.

Accordingly, in various embodiments, an adjustable-position abdominal support module 125 may be provided. The user may advantageously adjust the abdominal support module to a desired position. In various embodiments, the abdominal support module 125 may be configured to advantageously maintain a center of gravity of the patient 105 in a desired position within the support frame of the UBEGT. In various embodiments, the abdominal support module may advantageously cooperate with a back support module (e.g., a lift support or RBSM) to support the user in a desired position within the support frame.

A hip support module 3350 includes left and right hip support cushions 3355 mounted to hip support elements 3360. The hip support elements 3360 are coupled to the support frame of the UBEGT via a mounting element 3365 coupled (e.g., releasably coupled) to the mounting bracket 1955. Accordingly, in various embodiments, the patient 105 may be advantageously cushioned from bumping into the support frame during therapy and/or exercise, may be advantageously laterally supported in a desired lateral position, or some combination thereof. In various embodiments, the hip support elements 3360 may be adjustable such as, for example, by extending towards or retraction away from a sagittal plane of the patient, the sagittal plane oriented substantially parallel to the left and right sides of the support frame of the UBEGT. By way of example and not limitation, the hip support element 3360 may be axially adjustable (e.g., threadedly adjustable) with respect to the mounting element 3365 and/or the hip cushion 3355 may be axially adjustable (e.g., threadedly adjustable) with respect to the hip support element 3360.

Figure 35:
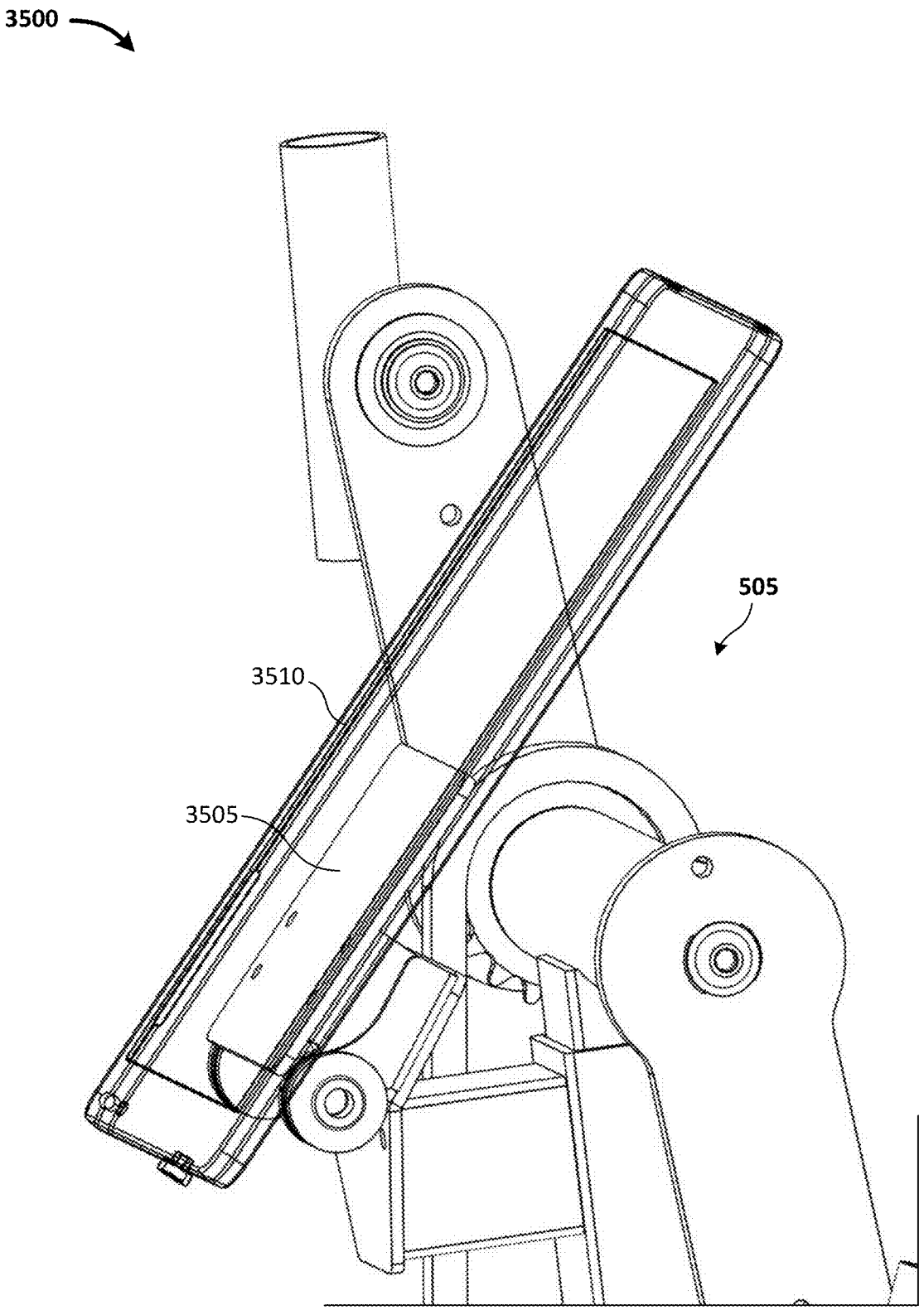
FIG. 35 depicts an exemplary display and control module of an exemplary UBEGT.

FIG. 35 depicts an exemplary display and control module of an exemplary UBEGT. In the depicted configuration 3500, combination display and control module 3510 is mounted to the support frame via adjustable mounting element 3505. The mounting element attaches to the UBE 505. In various embodiments, the display and control module 3510 may, by way of example and not limitation, be a commercially available tablet including at least one processor and memory module. The processor(s) may be configured to execute commercially available (including open source) and/or proprietary computer program instructions. For example, a readily available touchscreen tablet running a readily available operating system may be loaded with a program that provides program modules for interacting with various circuits of the UBEGT, for interacting with the patient and/or other users in relation to the UBEGT, for remote and/or local administration of the control module by support staff, or some combination thereof. Accordingly, a patient may advantageously interact with the UBEGT, interact with remote users, monitor progress of therapy and/or exercise while using the UBEGT, or some combination thereof.

Figure 36A:
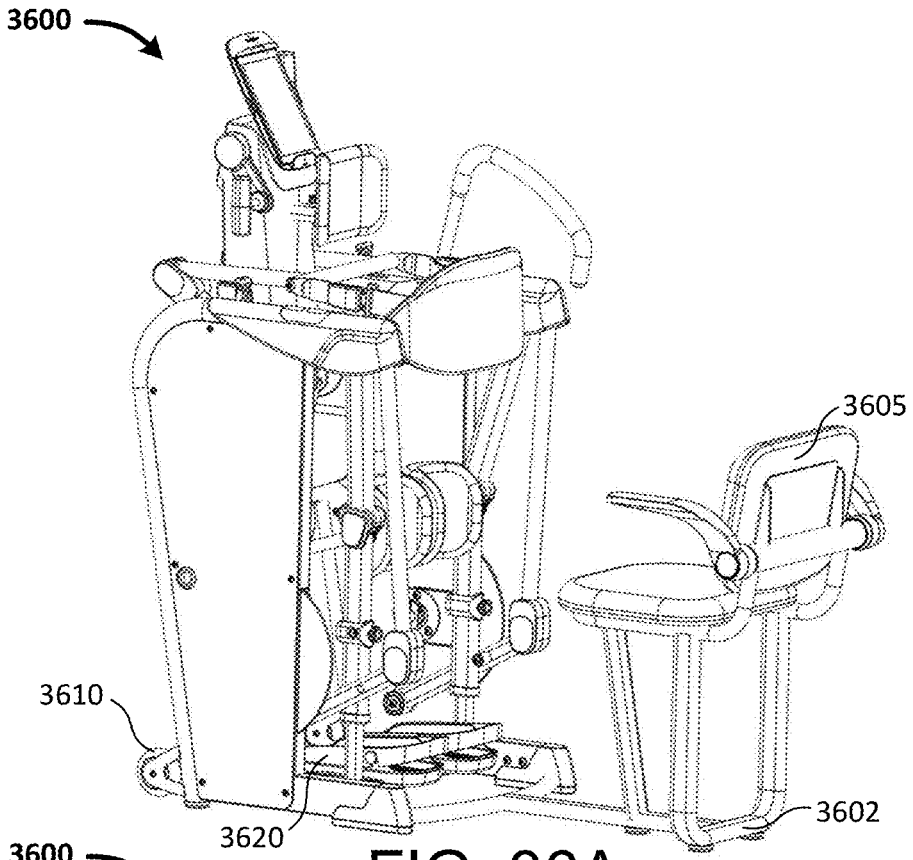
FIG. 36A and FIG. 36B depict a rear-right and front-right view, respectively, of an exemplary UBEGT provided with a seating module.
Figure 36B:
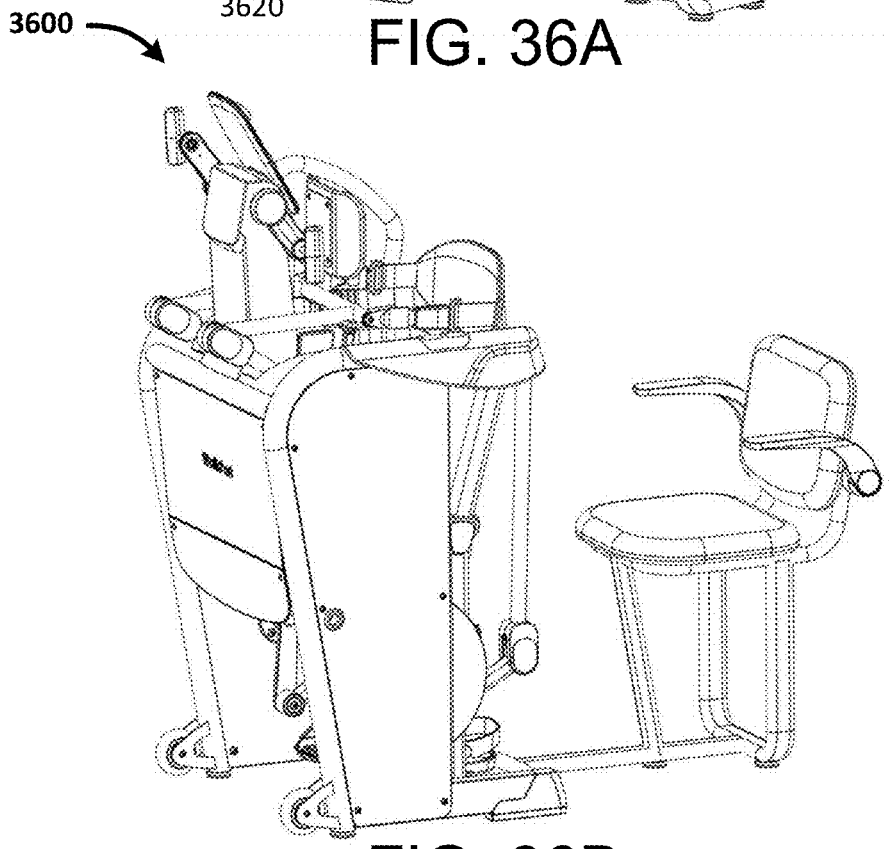

FIG. 36A and FIG. 36B depict a rear-right and front-right view, respectively, of an exemplary UBEGT provided with a seating module. In the depicted configuration 3600, the UBEGT is provided with a seating module 3602. The seating module 3602 is provided with a seat 3605. The seating module 3602 is releasably coupled to the support frame of the UBEGT. Accordingly, a user may advantageously seat themselves in the seat 3605 for support while positioning their feet, and then use a lift module to lift themselves into a standing position. In various embodiments, the seating module 3602 may be removed from the support frame. For example, the seating module may be shipped in a separate box such as, for example, to allow use of common carriers and/or avoid the necessity for freight and associated logistic challenges (e.g., truck access to residential areas, forklifts, unloading). The seating module may, for example, advantageously be removed for storage and/or transport.

In the depicted embodiments, the support frame is also provided with wheels 3610. In various embodiments, wheels may, for example, advantageously provide mobility of the UBEGT. The UBEGT may, for example, be rocked back onto the wheels and repositioned and/or transported.

Figure 37B:
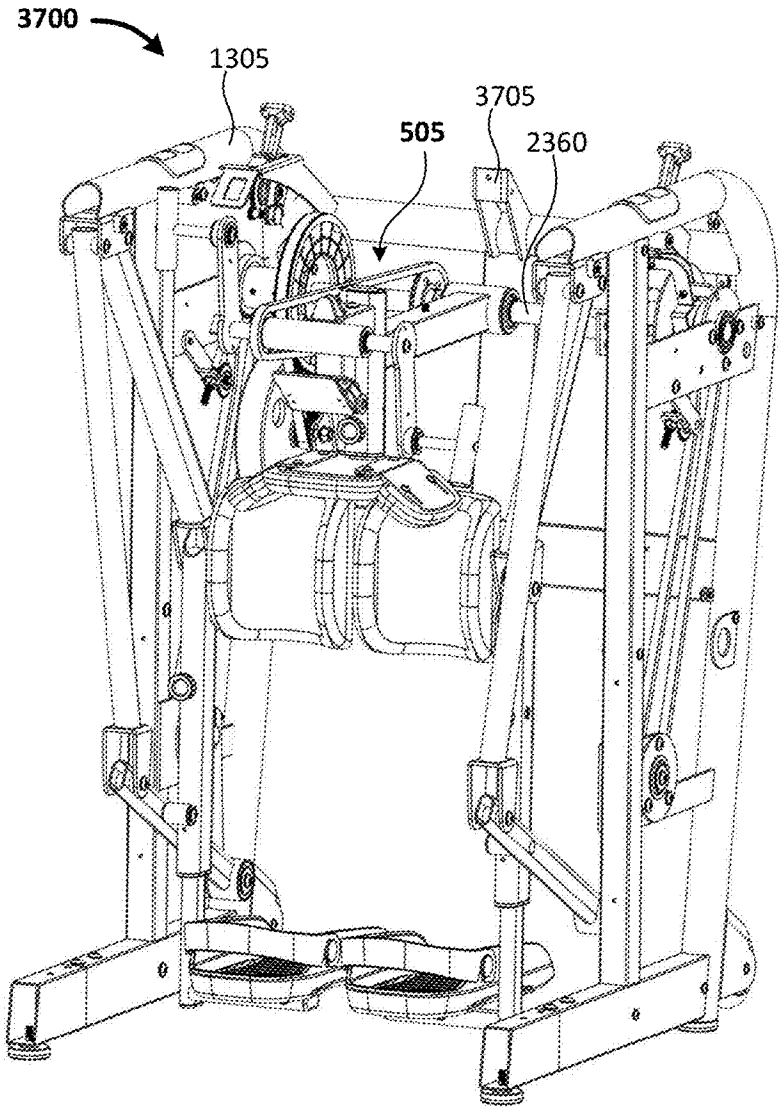
FIG. 37A and FIG. 37B depict a right side view and a rear-right view, respectively, of an exemplary UBEGT in a transport mode.
Figure 37A:
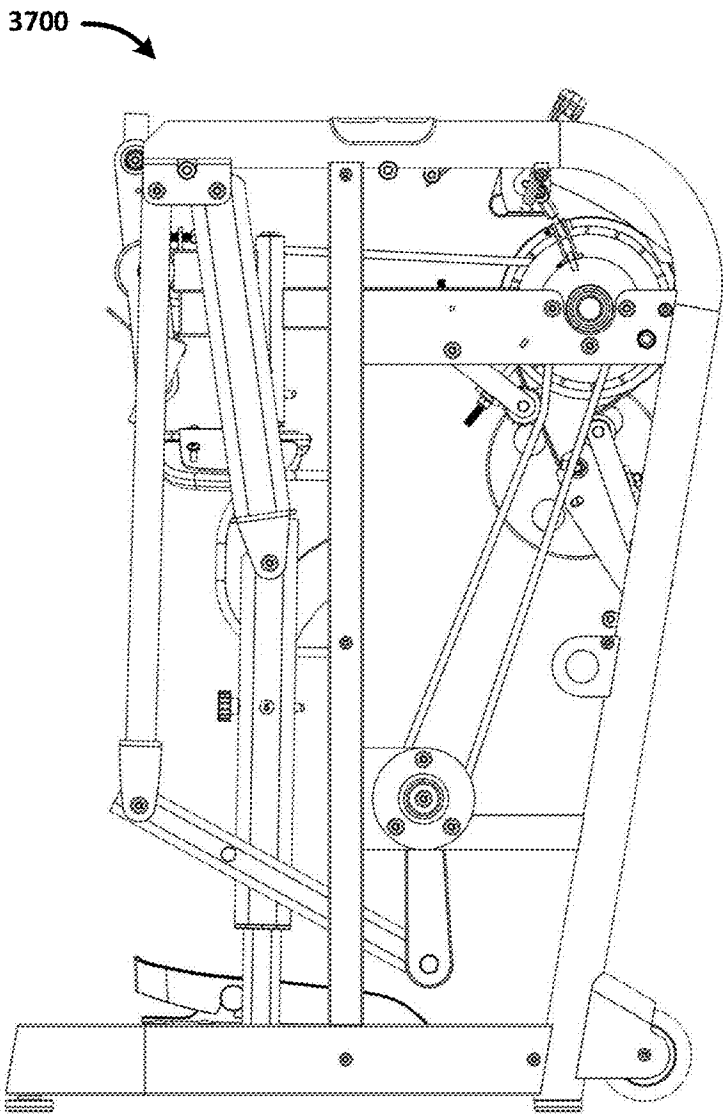
Figure 38B:
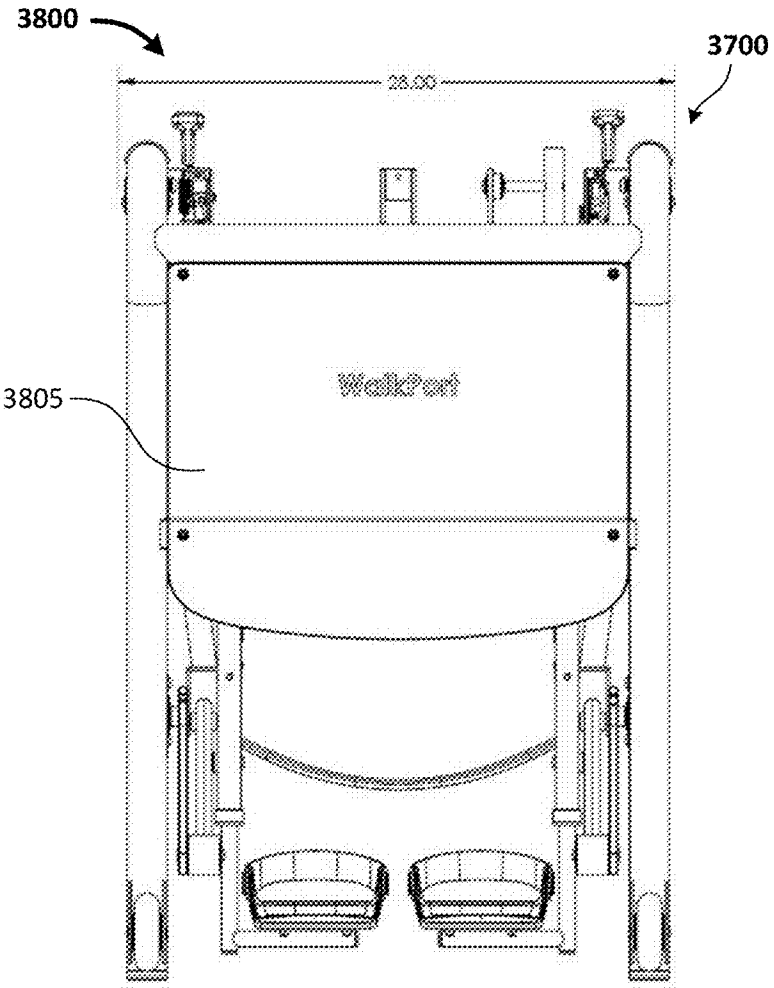
FIG. 38A and FIG. 38B depict a right side view and a frontal view, respectively, of an exemplary UBEGT provided with shrouding and in a transport mode.
Figure 38A:
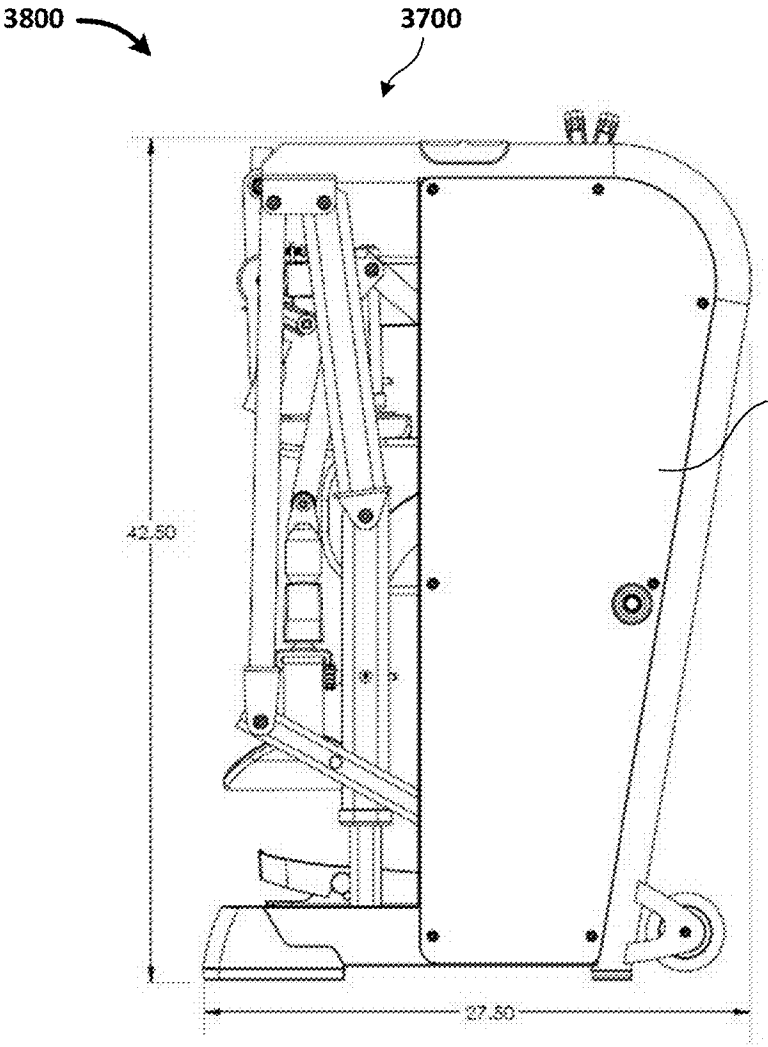

FIG. 37A and FIG. 37B depict a right side view and a rear-right view, respectively, of an exemplary UBEGT in a transport mode. FIG. 38A and FIG. 38B depict a right side view and a frontal view, respectively, of an exemplary UBEGT provided with shrouding and in a transport mode. In the depicted stowage configuration 3700, the UBE 505 (together with the attached abdominal support module) is released from an upper attachment to the support frame of the UBEGT by removing a coupling member securing the UBE 505 to a mounting bracket 3705 on the support frame. The UBE 505 then pivots downwards about the shaft 2360 of the walk control module and substantially completely inside the confines of the support frame 1305. The configuration 3800 includes the configuration shown in 3700 with the addition of panels 3805. The panels 3805 may, for example, advantageously increase aesthetic appearance and/or safety (e.g., shrouding from moving parts.

Various embodiments may provide easy transition between a deployed mode and a transport mode. In a transport mode, the UBEGT may be easily transported by hand and/or packaged for transport by standard ground carriers. In various embodiments, the dimensions of the UBEGT may advantageously enable deployment and operation within a patient's home, apartment, office, even if the space available prohibits traditional exercise and/or therapy equipment.

Figures 39A, 39B, 39C:
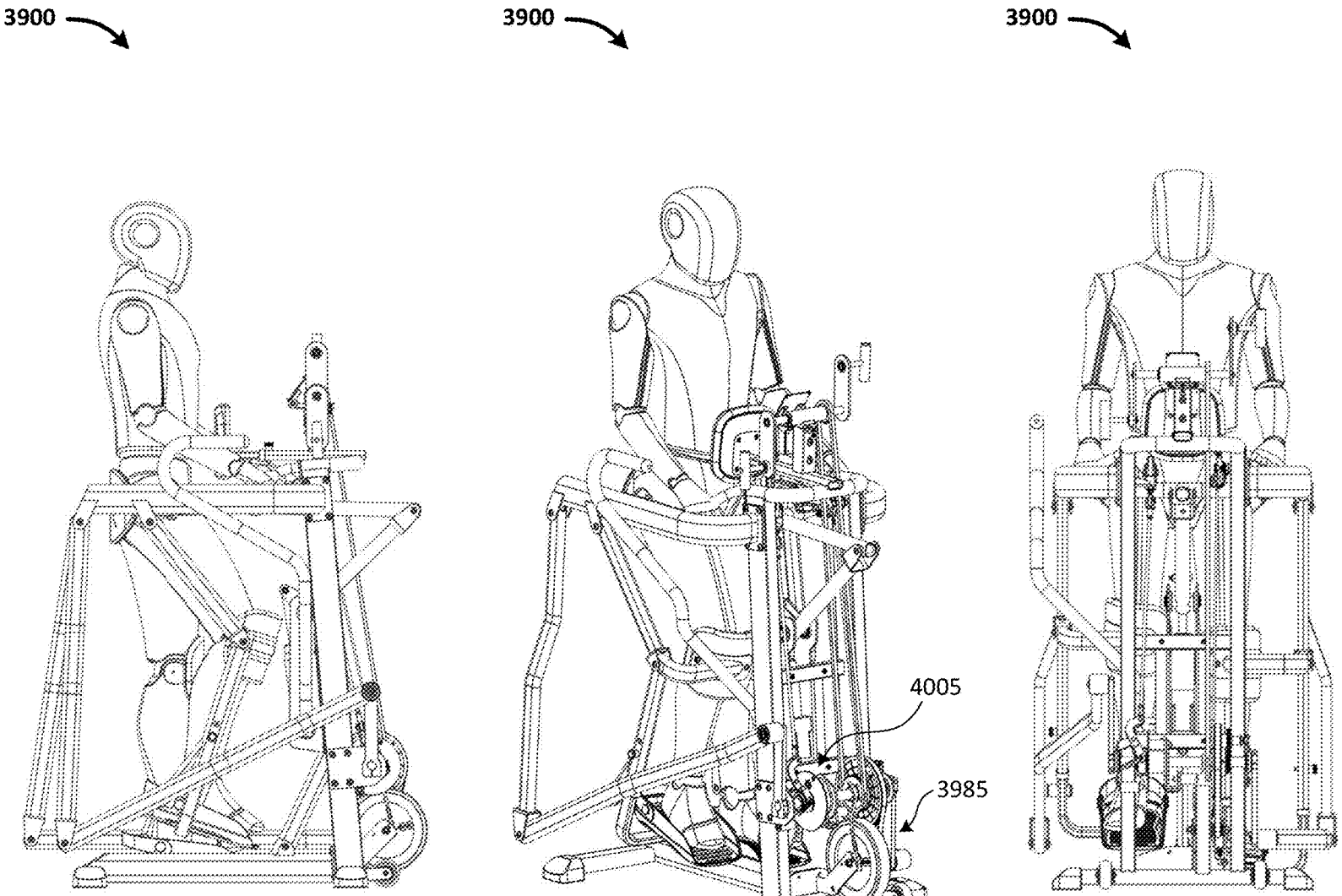
FIG. 39A, FIG. 39B, and FIG. 39C depict an exemplary UBEGT from a right side, front-right perspective, and frontal view, respectively.

FIG. 39A, FIG. 39B, and FIG. 39C depict an exemplary UBEGT from a right side, front-right perspective, and frontal view, respectively. The UBEGT 3900 is provided with a walk control module 4005 containing a resistance control module 3985.

Figure 40B:
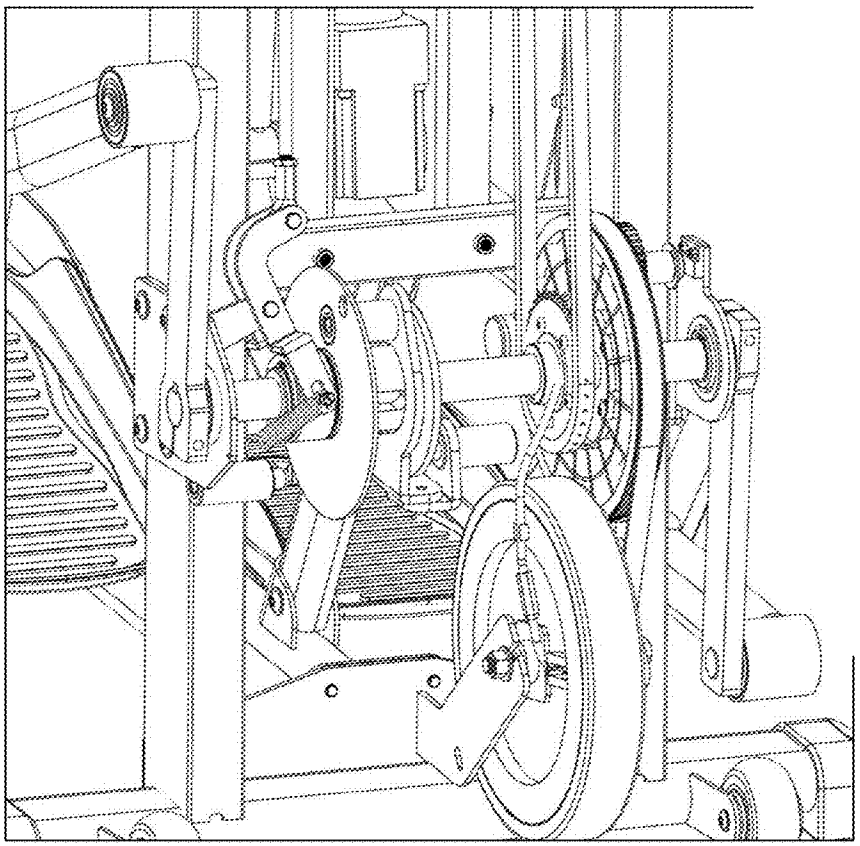
FIG. 40A and FIG. 40B depicts an exemplary walk control module from a front-left and front-right perspective, respectively.
Figure 40A:
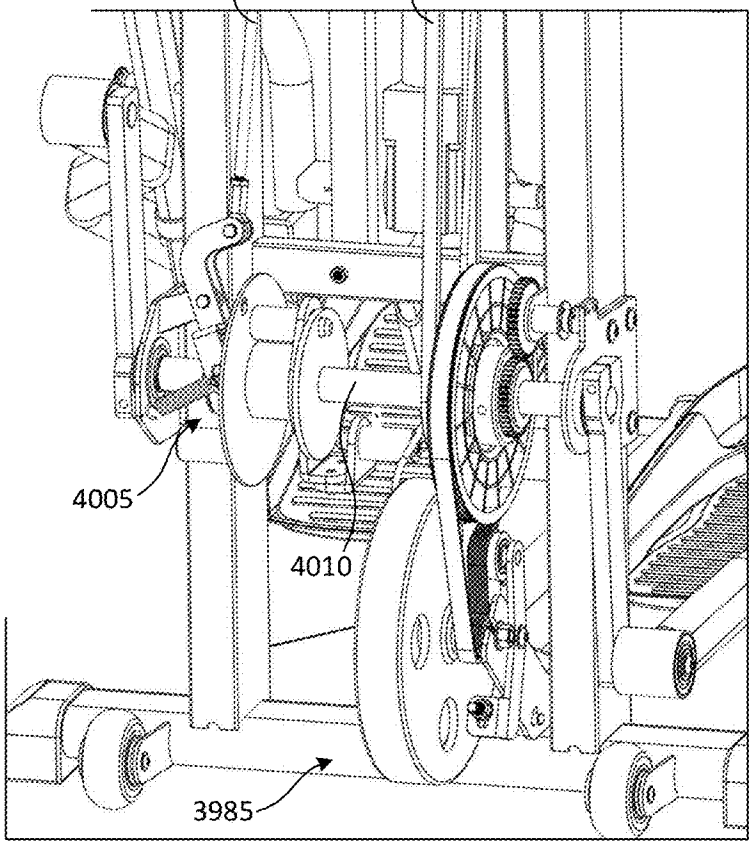

FIG. 40A and FIG. 40B depicts an exemplary walk control module from a front-left and front-right perspective, respectively. The resistance control module 3985 is mounted on a shaft 4010 of the walk control module 4005. The walk control module 4005 may, for example, operate similarly to the walk control module described at least in reference to FIG. 25. The shaft 4010 may, for example, be configured to operate similarly to shaft 2360 described at least in relation to FIG. 25. Transition of the walk control module 4005 between a standing mode and a walking mode may, for example, be effected by vertical displacement of a linkage element 4020.

Figure 41B:
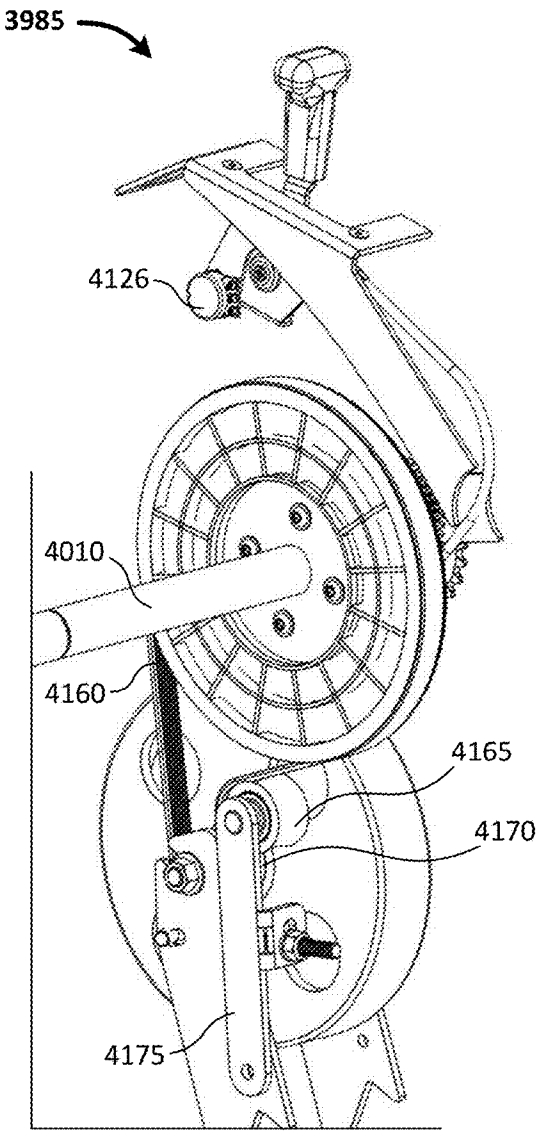
FIG. 41A and FIG. 41B depict an exemplary resistance control module from a front-right and front-left perspective, respectively, in an isolated view.
Figure 41A:
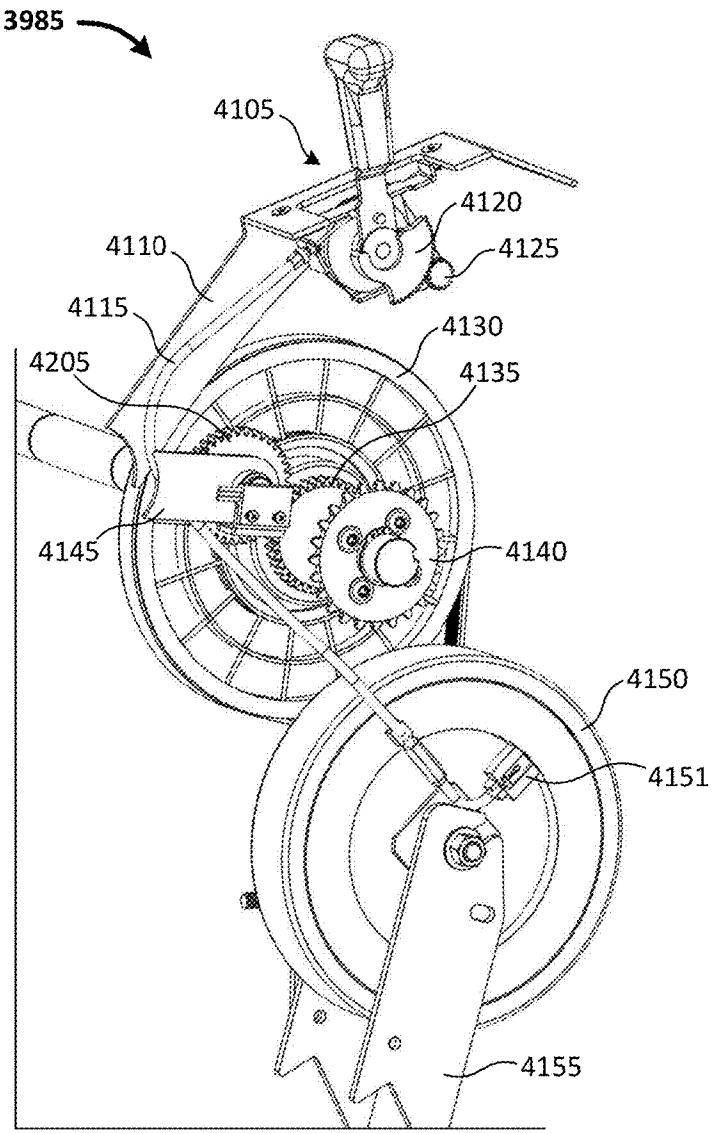
Figure 42:
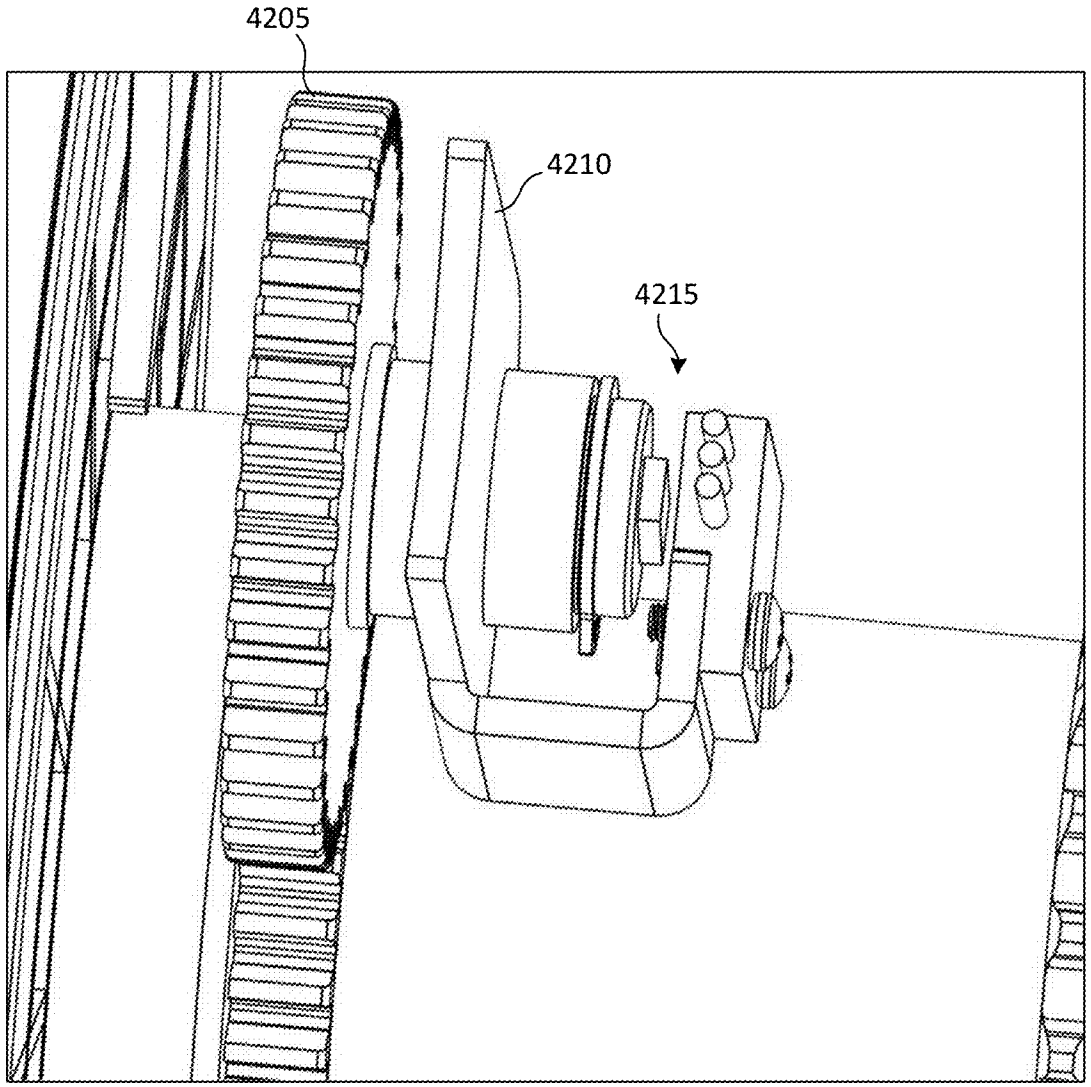
FIG. 42 depicts a close-up view of an exemplary gait position sensing module.

FIG. 41A and FIG. 41B depict an exemplary resistance control module from a front-right and front-left perspective, respectively, in an isolated view. FIG. 42 depicts a close-up view of an exemplary gait position sensing module. In general, the resistance module 3985 of the walk control module 4005 includes a control input 4105 which may be operated by a user to adjust resistance of a magnetic flywheel 4150. The magnetic flywheel 4150 is rotatably coupled to a drive element 4130. The drive element 4130 is rotationally coupled to the shaft 4010 such that adjusting the speed of rotation of the drive element 4130 correspondingly affects the speed of rotation of the shaft 4010.

The control input 4105 is mounted to a bracket 4110. The bracket 4110 is configured to mount the control input 4105 to a support frame of the UBEGT. The control input 4105 includes an adjustment element 4120 (e.g., a portion of a toothed gear) and a mating adjustment element 4125 (e.g., a toothed wheel). The adjustment element 4125 is axially connected to an adjustment sensing element 4126 (e.g., a rotary variable resistor). The adjustment sensing element 4126 may, for example, be connected to a control and/or monitoring circuit. The circuit may monitor the adjustment sensing element 4126 to determine a current level of resistance set by a user. Accordingly, the control circuit may advantageously monitor and/or record the input of a user.

The adjustment element is configured and connected to operate the cable 4115. Operation of the cable 4115 adjusts a resistance control element 4151 of the magnetic flywheel 4150. By way of example and not limitation, the resistance control element 4151 may adjust a distance between a magnet(s) and a flywheel within the magnetic flywheel 4150. Accordingly, a user may advantageously adjust resistance generated by the magnetic flywheel 4150.

The magnetic flywheel 4150 is mounted to the support frame via brackets 4155. The magnetic flywheel 4150 is axially and rotationally coupled to a flywheel drive element 4170. The flywheel drive element 4170 is rotatably coupled to the shaft 4010 via a drive member 4160 (e.g., a belt) engaging the drive element 4130 (e.g., a pulley), which is rotationally coupled to the shaft 4010. The drive member 4160 is tensioned by tensioner element 4165 mounted on pivot arm 4175. Engagement (tensioning) or disengagement (release) of the tensioner element 4165 with the drive member 4160 engages or disengages the resistance module 3985, respectively.

The drive element 4130 is axially and rotationally connected to a timing drive member 4135 and a drive member 4140 (e.g., corresponding to center drive element 1915A). The timing drive member 4135 engages with timing receiving member 4205. In various embodiments, the timing drive member 4135 and the timing receiving member 4205 may, for example, be timing gears with a 1:1 ratio relative to each other. In various embodiments, a ratio between the timing drive member 4135 and the timing receiving member 4205 may be predetermined and provided via a parameter(s) in at least one control circuit.

The timing receiving member 4205 is rotatably mounted on bracket 4145. Bracket 4145 may be mounted to the support frame of the UBEGT. The timing receiving member 4205 is operably coupled to an angular position sensor 4215. The angular position sensor 4215 is mounted to bracket 4210. The angular position sensor 4215 may be configured, for example, to detect a current angular position of the timing receiving member 4205. The angular position sensor 4215 may be connected, for example, to a monitoring and/or control circuit(s). Accordingly, in various embodiments a current position of the NGMs 145 may, for example, be advantageously determined. In various embodiments, an angular position sensor may, for example, advantageously enable monitoring of therapy, display of therapy progress to a patient and/or other user, functional electrode stimulation timed to a gait of the user, or some combination thereof. Although the resistance module and angular position sensor are depicted in the context of a UBEGT such as is shown in FIGS. 39A-39C, the resistance module and/or angular position sensor module may be incorporated in any embodiments described herein.

Figure 43:
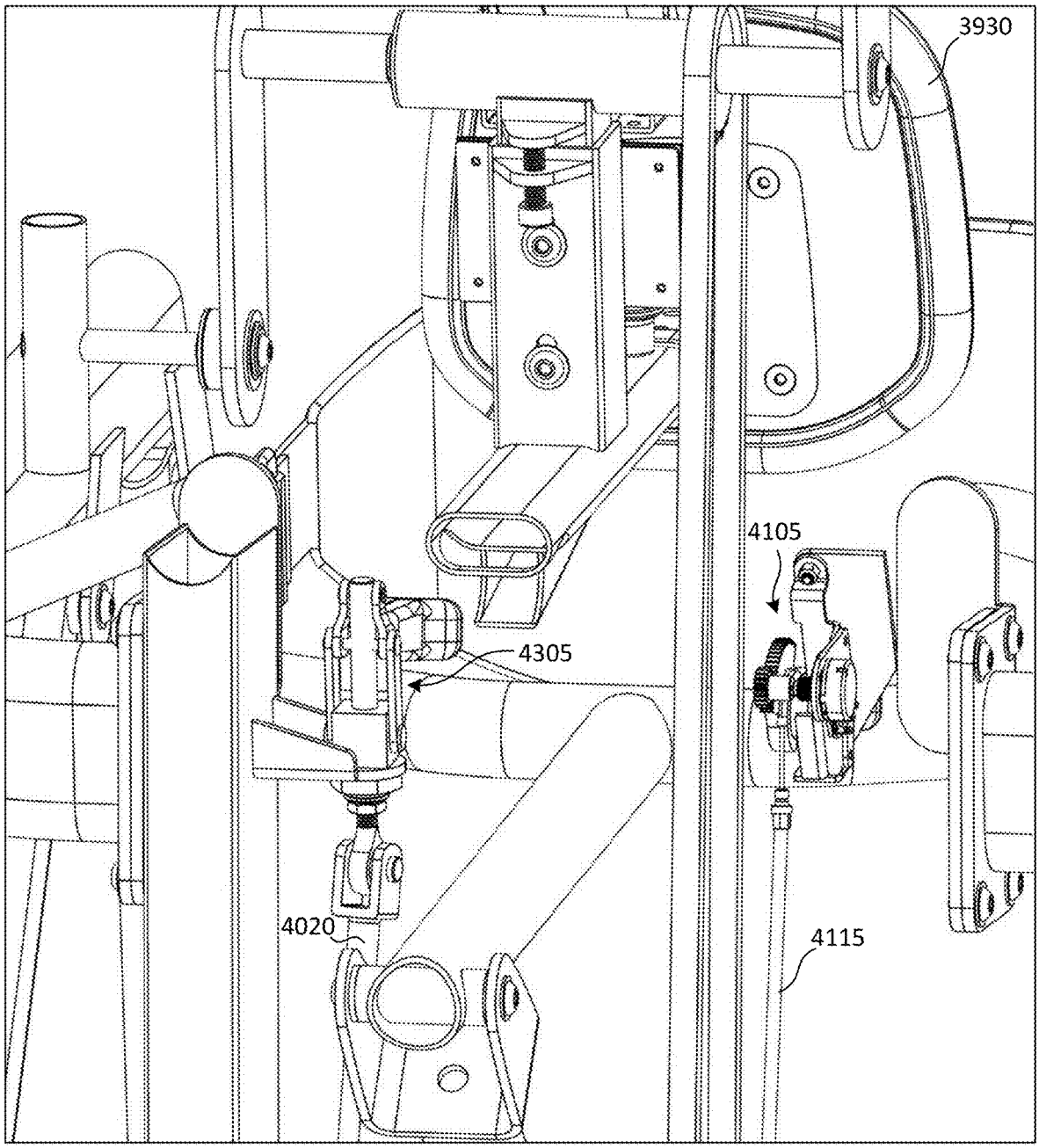
FIG. 43 depicts a close-up view of exemplary isolated controls and elements of an exemplary UBEGT.

FIG. 43 depicts a close-up view of exemplary isolated controls and elements of an exemplary UBEGT. The control input 4105 is displayed attached to the support frame of the UBEGT and connected to the cable 4115. A control input 4305 (e.g., a hand lever) may operate the linkage element 4020 to transition the walk control module 4005 between a walking mode and a standing mode.

Figure 44:
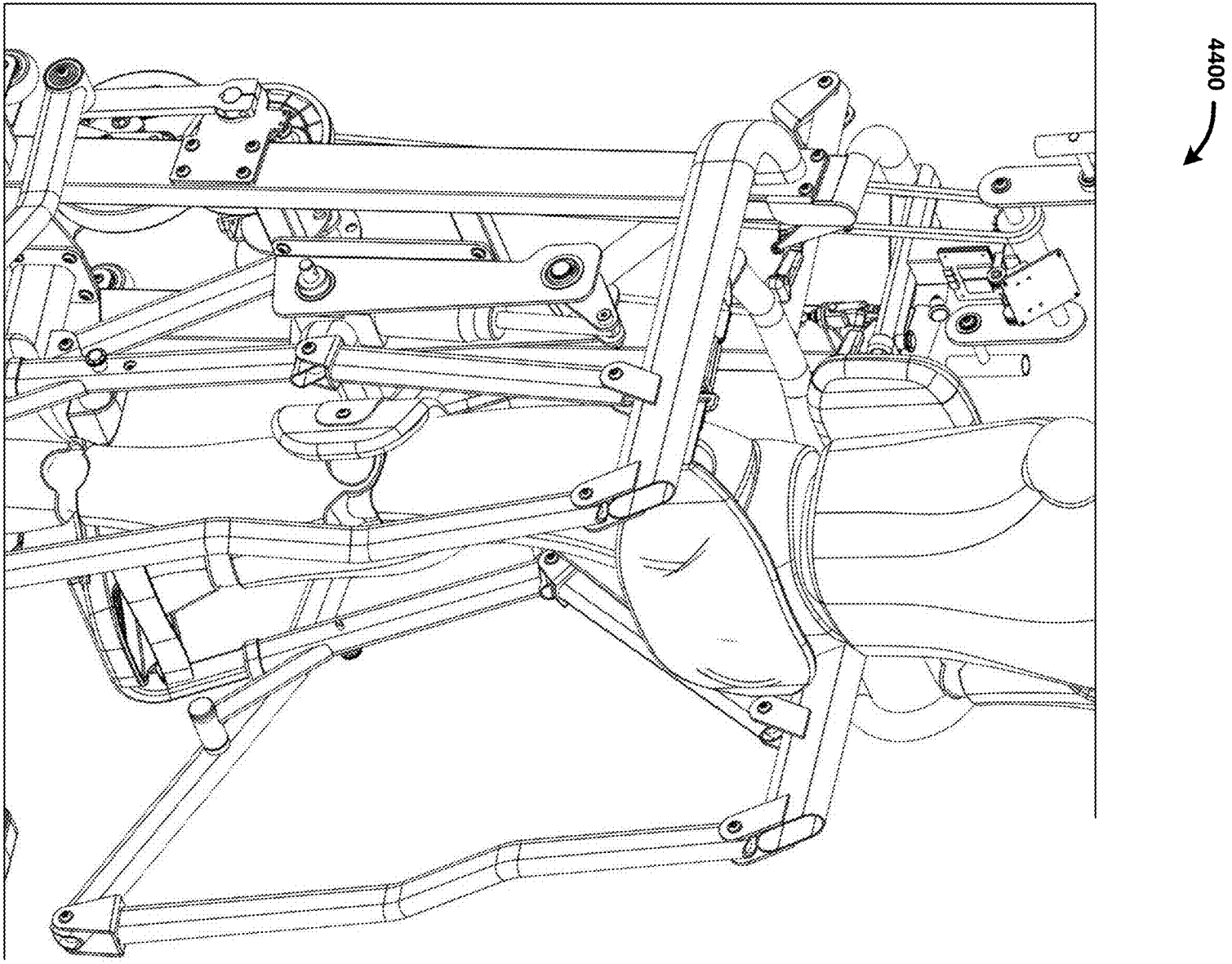
FIG. 44 depicts an exemplary UBEGT in a walking mode.

FIG. 44 depicts an exemplary UBEGT in a walking mode. In walking configuration 4400, a user is engaging in gait simulation suspended within a support frame of the UBEGT via left and right NGMs. The user is supported within the support frame by a lift strap and an abdominal support module.

Figures 45A, 45B, 45C:
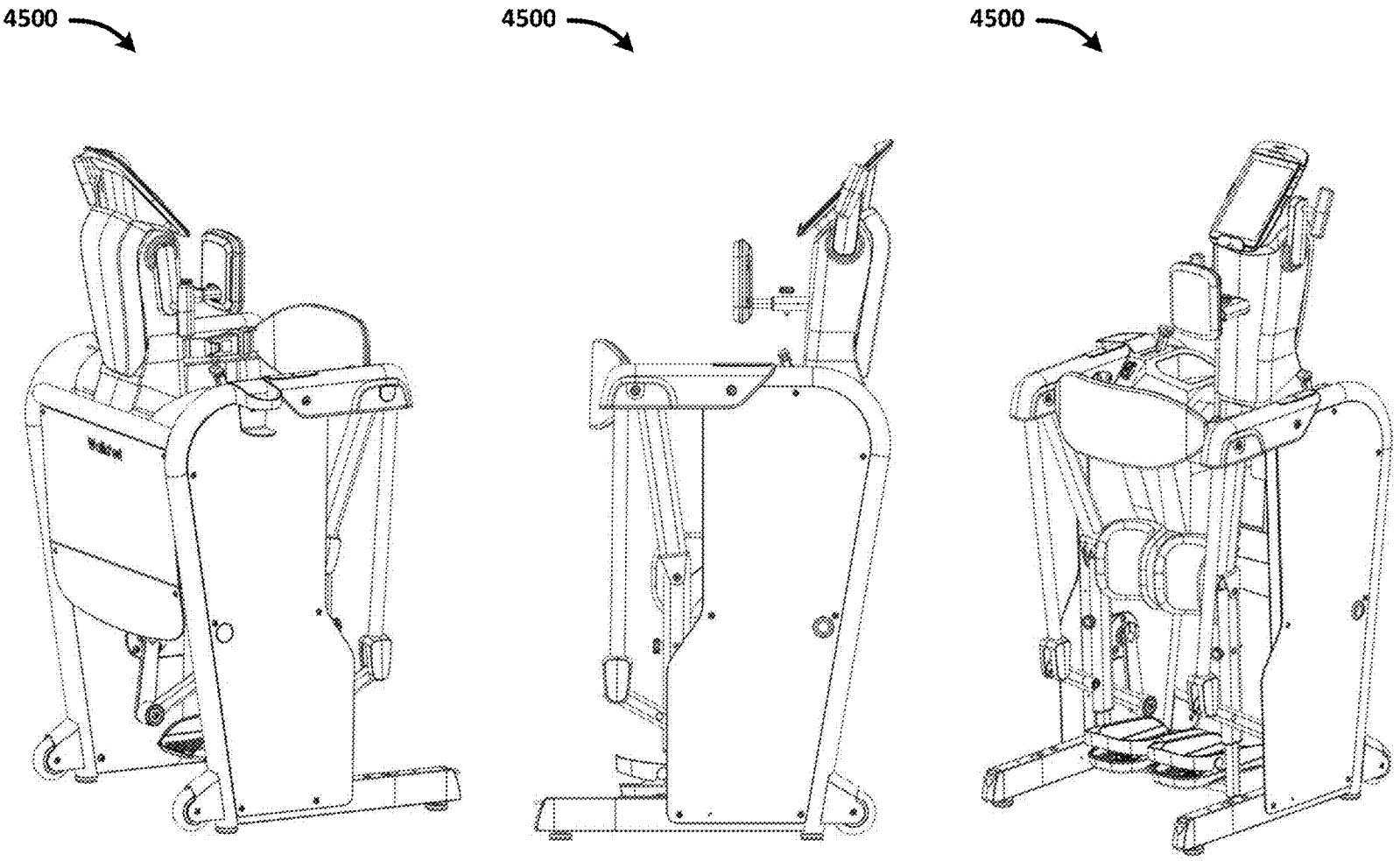
FIG. 45A, FIG. 45B, and FIG. 45C depict an exemplary UBEGT in a deployed mode from a front-left perspective, right side, and rear-right perspective view, respectively, and provided with a lift module.

FIG. 45A, FIG. 45B, and FIG. 45C depict an exemplary UBEGT in a deployed mode from a front-left perspective, right side, and rear-right perspective view, respectively, and provided with a lift module. The UBEGT 4500 is provided with a support frame (e.g., as described in relation to 1305). By way of example and not limitation, the support frame houses NGMs (e.g., as described in relation to the NGMs 145), a lift module having lift strap (e.g., as described in relation to the lift strap 120), an abdominal support module (e.g., as described in relation to the abdominal support module 125, but having only a central bracket and cushion), a display and/or control module, and a UBE (e.g., as described in relation to UBE 505). Various shrouding, aesthetic, and/or styling elements are depicted.

Figure 46C:
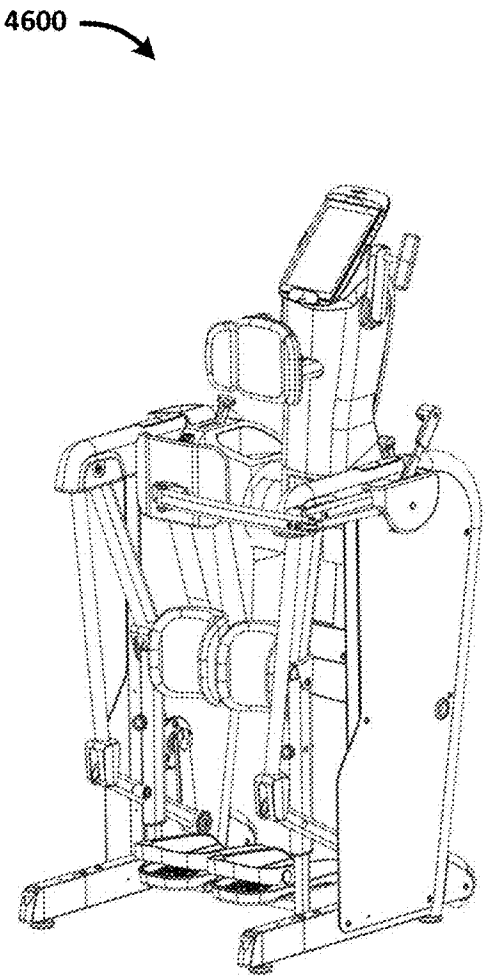
FIG. 46A, FIG. 46B, and FIG. 46C depict an exemplary UBEGT in a deployed mode from a front-left perspective, right side, and rear-right perspective view, respectively.
Figure 46B:
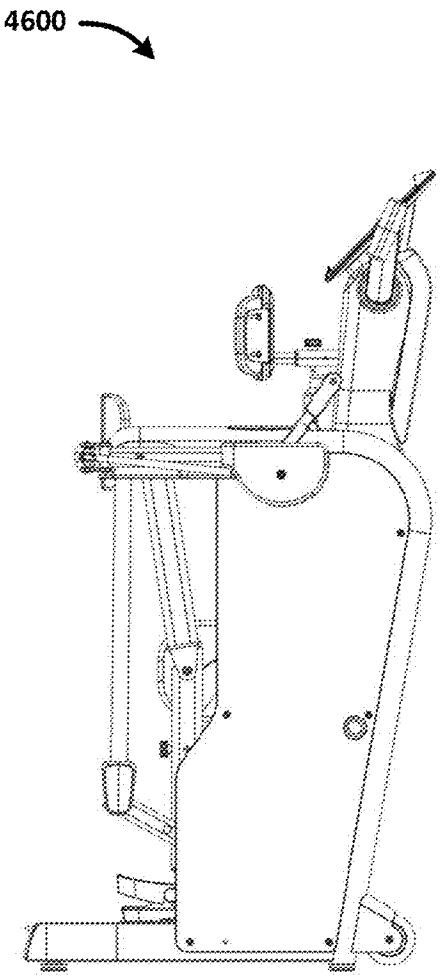
Figure 46A:
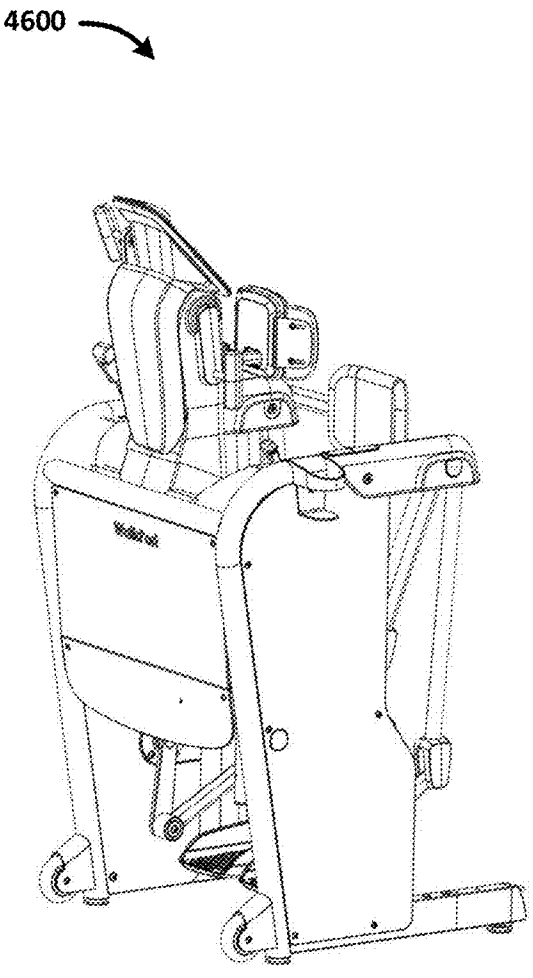

FIG. 46A, FIG. 46B, and FIG. 46C depict an exemplary UBEGT in a deployed mode from a front-left perspective, right side, and rear-right perspective view, respectively. The UBEGT 4600 is provided with a support frame (e.g., as described in relation to 1305). By way of example and not limitation, the support frame houses NGMs (e.g., as described in relation to the NGMs 145), a RBSM (e.g., as described in relation to the RBSM 1105), an abdominal support module (e.g., as described in relation to the abdominal support module 125), a display and/or control module, and a UBE (e.g., as described in relation to UBE 505). Various shrouding, aesthetic, and/or styling elements are depicted.

Figure 47C:
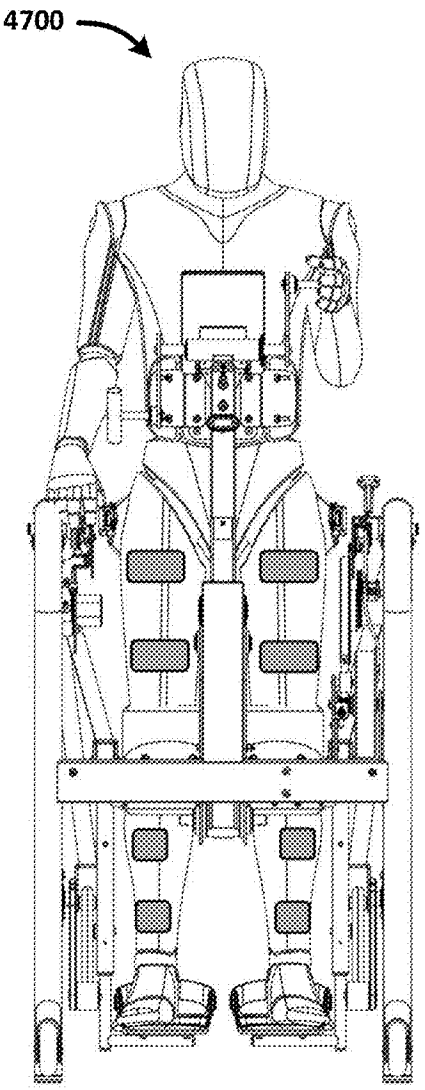
FIG. 47A, FIG. 47B, and FIG. 47C depict a rear, right side, and frontal view, respectively, of an exemplary UBEGT in a walking mode and provided with an exemplary functional electrical stimulation (FES) module and exemplary associated electrodes.
Figure 47B:
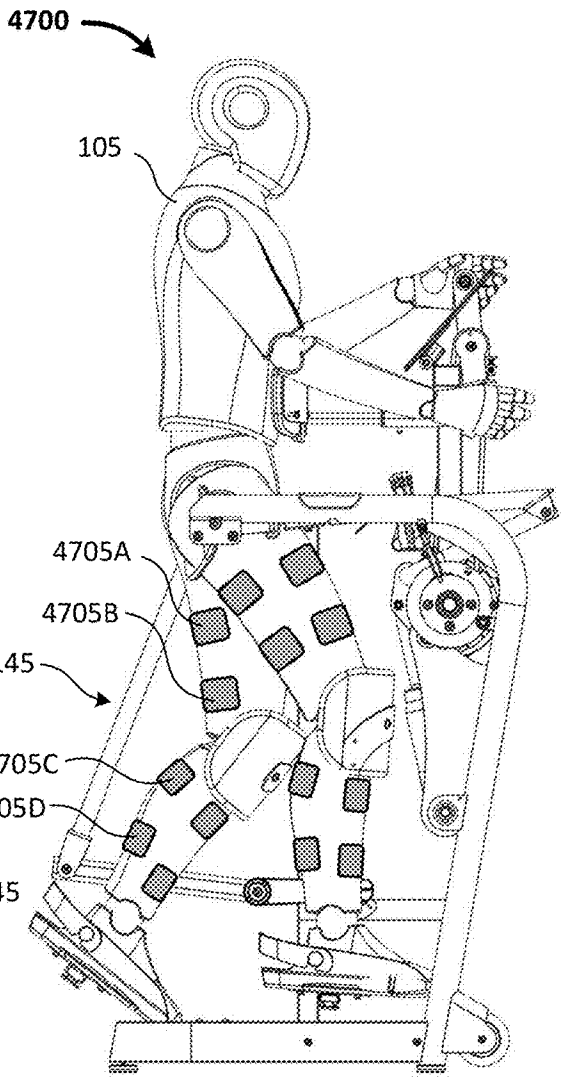
Figure 47A:
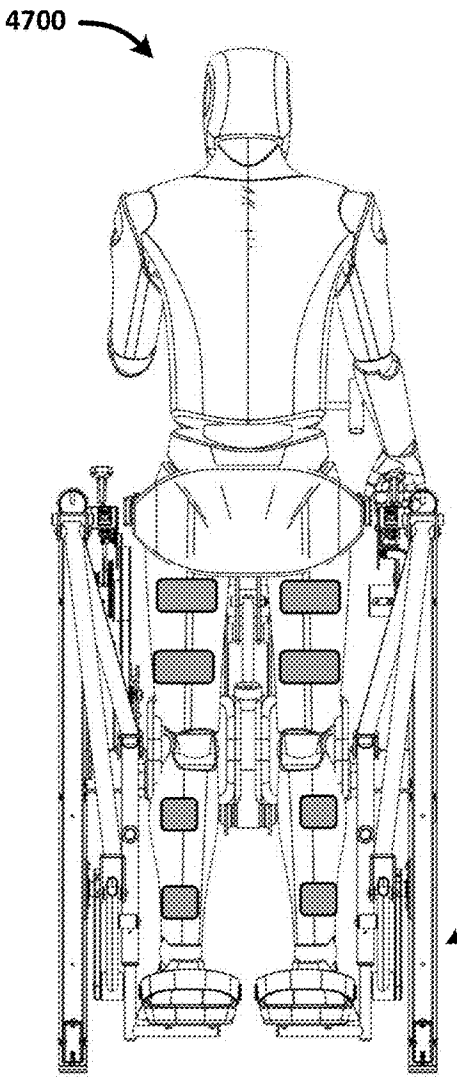

FIG. 47A, FIG. 47B, and FIG. 47C depict a rear, right side, and frontal view, respectively, of an exemplary UBEGT in a walking mode and provided with an exemplary functional electrical stimulation (FES) module and exemplary associated electrodes. In configuration 4700, electrodes 4705A-4705D are placed on the left and right legs of the patient 105. Four sets of electrodes are placed on each leg: first set 4705A, second set 4705B, third set 4705C, and fourth set 4705D. The patient may operate the UBEGT to simulate a natural gait cycle in the left and right NGMs 145.

In various embodiments, the electrodes 4705 may be operably connected to a control circuit. The control circuit may monitor a current stage of the gait cycle (e.g., via the angular position sensor 4215 described at least in relation to FIG. 42) and activate the electrodes 4705 in a predetermined sequence. The predetermined activation sequence may, for example, be configured to correspond to a sequential stimulation of muscle groups according to a normal sequence of muscle activation in a natural bipedal gait cycle. In various embodiments, the patient may adjust the timing, speed, intensity, or other appropriate characteristic of FES therapy. In various embodiments, the therapy may be predetermined by a healthcare giver (e.g., therapist, physician). Accordingly, various embodiments may advantageously synchronize FES therapy with mechanical gait therapy to more closely simulate natural physiological processes during a normal gait cycle. Various embodiments may, for example, advantageously enable rehabilitation of injured, paralytic, or otherwise disabled patients.

Figure 48:
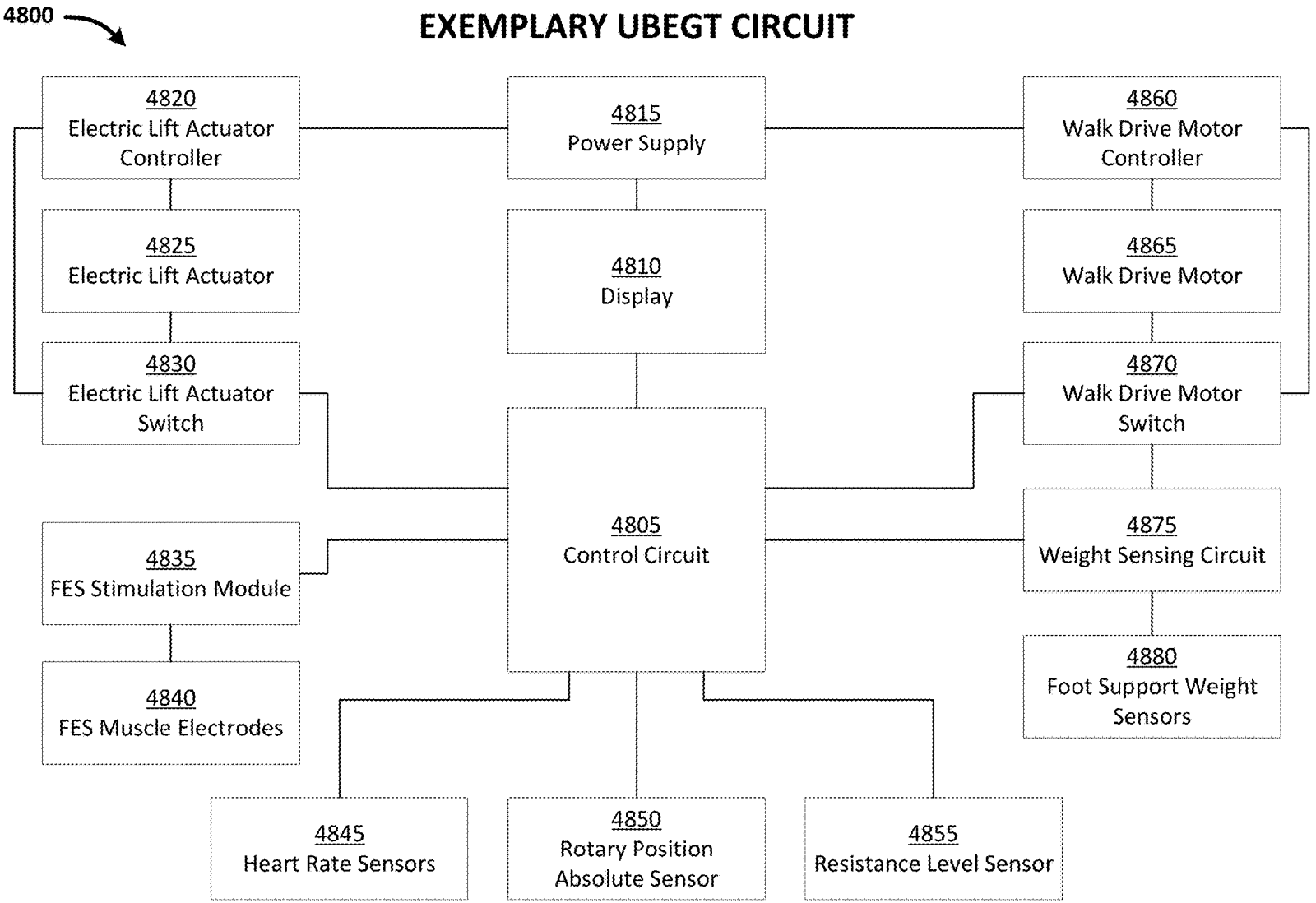
FIG. 48 depicts a schematic of an exemplary UBEGT circuit.

FIG. 48 depicts a schematic of an exemplary UBEGT circuit. A central control circuit 4805 may include, for example, at least one processor and memory circuit, and may include at least one data store. The control circuit 4805 is connected to at least one display 4810 such as, by way of example and not limitation, a touchscreen (e.g., a touchscreen tablet). The control circuit and display may, for example, be integrated into a single device (e.g., a commercially available tablet). The control circuit 4805 and the display 4810 are powered by a power supply 4815. The power supply 4815 also provides power to an electric lift actuator controller 4820 and walk drive motor controller 4860. The power supply 4815 may, for example, also provide power to various other modules shown and/or not shown.

The control circuit 4805 receives input from the UBEGT including, by way of example and not limitation, via heart rate sensors 4845 (e.g., via sensor panels 156), a rotary position absolute sensor 4850 (e.g., angular position sensor 4215), a resistance level sensor 4855 (e.g., adjustment sensing element 4126), and a weight sensing circuit 4875. The control circuit interacts with (e.g., sends commands to and/or receives feedback from), by way of example and not limitation, an electric lift actuator switch 4830, an FES stimulation module 4835, and a walk drive motor switch 4870.

The electric lift actuator switch 4830 (e.g., input element 1020, described at least in relation to FIG. 10A) connects to an electric lift actuator 4825 (e.g., linear actuator 1010 described in relation at least to FIG. 10A) and an electric lift actuator controller 4820 (e.g., control circuit 1030 described in relation at least to FIG. 10A). In various embodiments, the switch 4830 may connect directly and/or through the intermediation of the control circuit 4805.

The FES stimulation module 4835 is connected to FES muscle electrodes 4840 (e.g., electrodes 4705 described at least in relation to FIG. 47B). The FES stimulation module 4835 may, for example, activate the electrodes 4840, monitor a connected state of the electrodes, monitor muscle activity via the electrodes, or some combination thereof.

The walk drive motor switch 4870 (e.g., actuation input 2710, described at least in relation to FIGS. 27A-28B) is connected both to a walk drive motor 4865 (e.g., motor 2810, described at least in relation to FIGS. 27A-28B) and a walk drive motor controller 4860 (e.g., control circuit(s) 2840 and/or 2841, described at least in relation to FIGS. 27A-28B). The walk drive motor switch may, for example, activate the walk drive motor 4865 according, for example, to commands from the control circuit 4805, commands from a user, or both. The walk drive motor switch 4870 may, for example, control power to the walk drive motor 4865 via control of the walk drive motor controller 4860.

The weight sensing circuit 4875 is connected both to foot support weight sensors 4880 and the walk drive motor switch 4870. The weight sensing circuit 4875 may, by way of example and not limitation, interlock the walk drive motor switch 4870 such that a predetermined weight threshold must be reached before the walk drive motor switch 4870 operates to activate the walk drive motor 4865. The weight sensing circuit 4875 may, for example, determine a current weight of a user via the foot support weight sensors 4880. The weight sensors 4880 may be disposed in one or both left and right foot supports such as, for example, on a mounting platform or mounting member.

In various embodiments, connection to the control circuit and/or between various elements may be made by, for example, wired connection, wireless connection (e.g., Wi-Fi, Bluetooth), mechanical connection, magnetic connection, or some combination thereof. For example, the FES muscle electrodes 4840 may be connected to the FES stimulation module via wireless (e.g., Bluetooth) connection. The control circuit 4805 and the display 4810 may, for example, be a unitary tablet device and may connect wirelessly to various modules such as, for example, the FES stimulation module 4835, the electric lift actuator switch 4830, the various sensors 4845-4855, the weight sensing circuit 4875, the walk drive motor switch 4870, or some combination thereof.

In various embodiments, the control circuit 4805 may include a plurality of sub-circuits. For example, a first portion of the control circuit 4805 may be implemented in a combination control circuit and display device (e.g., computer, tablet). A second portion of the control circuit 4805 may be implemented in a separate control circuit. The second portion of the control circuit 4805 may, for example, interface with one or more modules (e.g., sensors, switches, and/or other modules) and with the first portion of the control circuit 4805. In various embodiments, the second portion of the control circuit 4805 may, by way of example and not limitation, include one or more analog-to-digital converter circuits, digital acquisition circuits, power distribution circuits, or some combination thereof.

Figure 49:
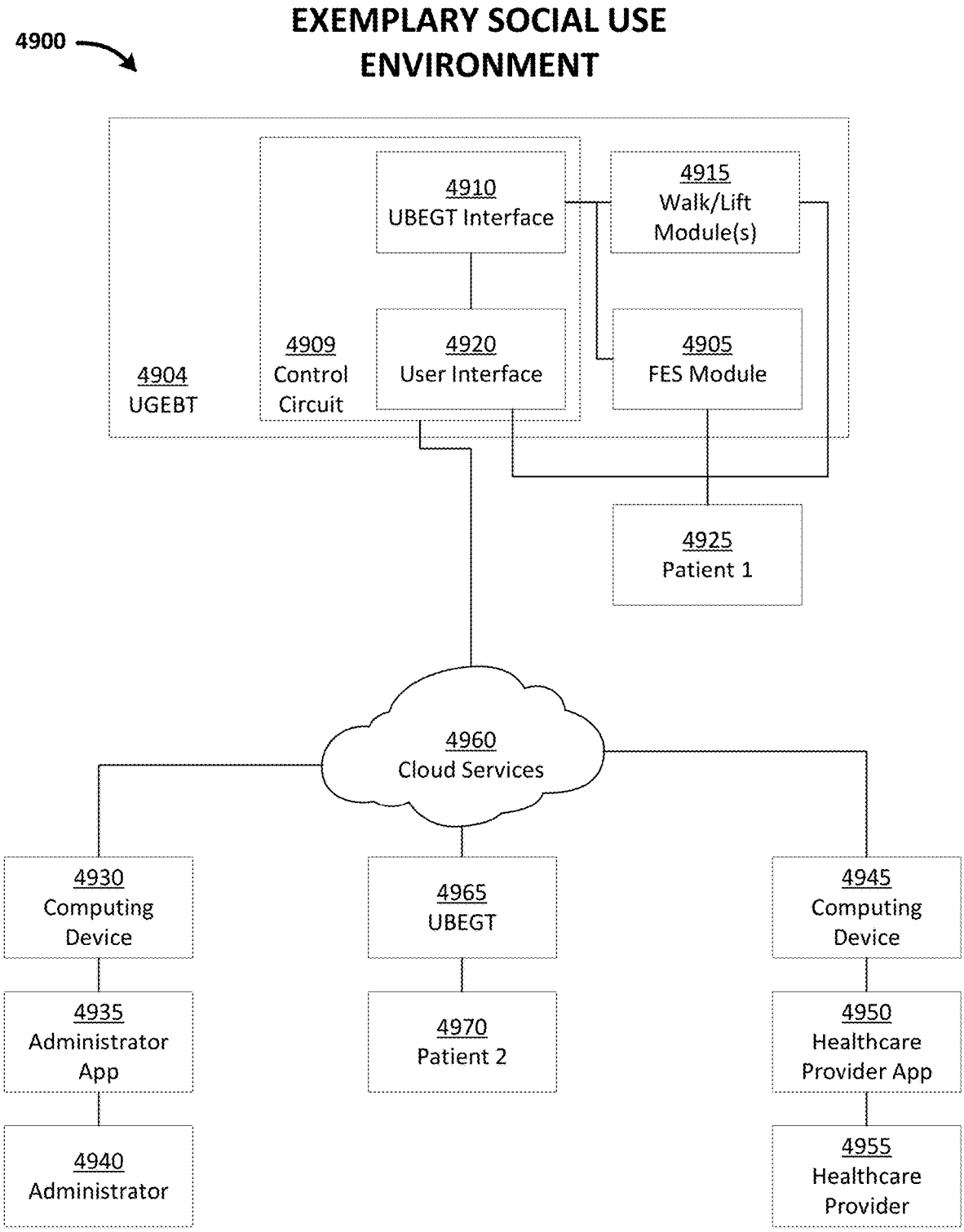
FIG. 49 depicts a schematic of an exemplary social use environment for a plurality of UBEGTs.

FIG. 49 depicts a schematic of an exemplary social use environment for a plurality of UBEGTs. A first patient (Patient 1) 4925, a second patient (Patient 2) 4970, an administrator 4940, and a healthcare provider 4955 may interact with each other and/or various UBEGTs via cloud services 4960. The various persons (administrators, healthcare providers, patients) may be remote from one another.

An exemplary UBEGT 4904 includes a control circuit 4909. The control circuit 4909 includes a user UBEGT interface 4910 and a user app 4920 (e.g., providing a (dynamic) user interface). The UBEGT interface 4910 communicates between walk/lift module(s) 4915 and an FES module 4905. Patient 1 4925 interacts with the UBEGT via the user app 4920, the walk/lift module(s) 4915 and/or the FES module 4905. Patient 1 4925 may interact with the user app 4920, by way of example and not limitation, by entering commands, monitoring feedback, interacting with social features, interacting with healthcare features, or some combination thereof. Patient 1 4925 may interact with the FES module 4905, by way of example and not limitation, by wearing FES electrodes and directing stimulation via the user app 4920. Patient 1 4925 may interact with the walk/lift modules 4915, by way of example and not limitation, by operating left and right NGMs, a UBE, a walk drive module, a lift module, a RBSM, a powered walk module, a walk control module, a resistance module, or some combination thereof.

The user app 4920 may, for example, be an app loaded on a tablet. The app may, by way of example and not limitation, determine access, determine user permissions, provide remote access to one or more features, interface with the UBEGT (e.g., via the UBEGT interface 4910, or may integrate the UBEGT interface 4910), or some combination thereof. The user app 4920 may provide communication and/or other interface features for the Patient 1 4925 to interact with the administrator 4940, the healthcare provider 4955, Patient 2 4970, or some combination thereof, via cloud services 4960.

The cloud services 4960 may, for example, include one or more remote data stores, processors, and memory modules. The cloud services 4960 may, for example, store information (e.g., therapy history, sensor history, communication history) on the remote data store(s). The cloud services 4960 may be configured such that the remote processor(s) execute instructions on one or more of the remote data store(s) and, by way of example and not limitation, process information retrieved from the UBEGT 4904, process information retrieved from other UBEGTs, communicate messages between various users (e.g., patients, administrators, healthcare providers), determine therapy progress, monitor patient health and/or progress, or some combination thereof.

The UBEGT 4904 is connected to cloud services 4960 via the user app 4920. Also connected to the cloud services 4960 is a second UBEGT 4965 of a second patient (Patient 2) 4970, a computing device 4930 of an administrator 4940, and a computing device 4945 of a healthcare provider 4955. Patient 2 4970 may, for example, be a patient in another location (e.g., apartment, room, building, city, state, country) from Patient 1 4925. The administrator 4940 may, for example, interact with the computing device 4930 using an administrator app 4935 running thereon. The healthcare provider 4955 may interact with the computing device 4945 using a healthcare provider app 4950 running thereon.

The administrator 4940 may, for example, monitor a plurality of UBEGTs including, but not limited to, UBEGT 4904 and UBEGT 4965. The administrator may, by way of example and not limitation, provide technical support, customer support, firmware updates, interface updates, or some combination thereof. The administrator 4940 may interact with the patients 4925 and/or 4970, the healthcare provider 4955, or some combination thereof via cloud services 4960. The administrator may provide services for third parties to communicate with various UBEGT, patients, other devices, other persons, or some combination thereof via the cloud services 4960. For example, the administrator 4940 may provide anonymized data to insurance providers, may allow a user (e.g., patient 4925 or 4970) to provide access to various data (e.g., usage reports) to third parties (e.g., healthcare provider 4955, insurance provider), or some combination thereof. Accordingly, various embodiments may allow an administrator to remotely support multiple UBEGT. Various embodiments may advantageously allow healthcare funding entities to evaluate whether therapies and/or devices funded are increasing patient health.

Patients may, for example, interact via cloud services 4960. For example, Patient 1 4925 and Patient 2 4970 may set goals, 'compete' with each other, encourage each other, message each other, share progress updates with each other, or some combination thereof. The administrator 4940 may, for example, facilitate the interaction upon user permission. The cloud services 4960 may, for example, suggest other patients which a patient may wish to interact with. Patients may be suggested, for example, based on a user's existing social network, attributes of the patient (e.g., disability, therapy goals, location, demographics), or some combination thereof. Accordingly, patients may advantageously interact remotely. Remote interaction may, for example, advantageously increase patient compliance, perseverance, and emotional health.

The healthcare provider 4955 may interact with various patients including, for example, with Patient 1 4925, Patient 2 4970, or some combination thereof. The healthcare provider 4955 may, by way of example and not limitation, monitor therapy progress, receive and view patient progress reports, message patients, collect and/or share healthcare records, prescribe and/or configure therapy parameters (e.g., FES parameters such as sequence, location, intensity, duration; walk parameters such as duration, intensity, resistance), or some combination thereof. A healthcare provider 4955 may, for example, include therapists, physicians, caretakers, nurses, or some combination thereof. The administrator 4940 may facilitate communication of the healthcare provider 4955 with a patient upon the patient granting permission. The healthcare provider 4955 may, for example, send predetermined settings to a patient's UBEGT. The patient may determine whether to apply the settings. The healthcare provider may, for example, send settings recommendations to the administrator 4940, and the administrator 4940 may generate predetermined settings therefrom for application to one or more UBEGTs. Accordingly, a healthcare provider may advantageously remotely monitor and assist multiple patients.

Figure 50:
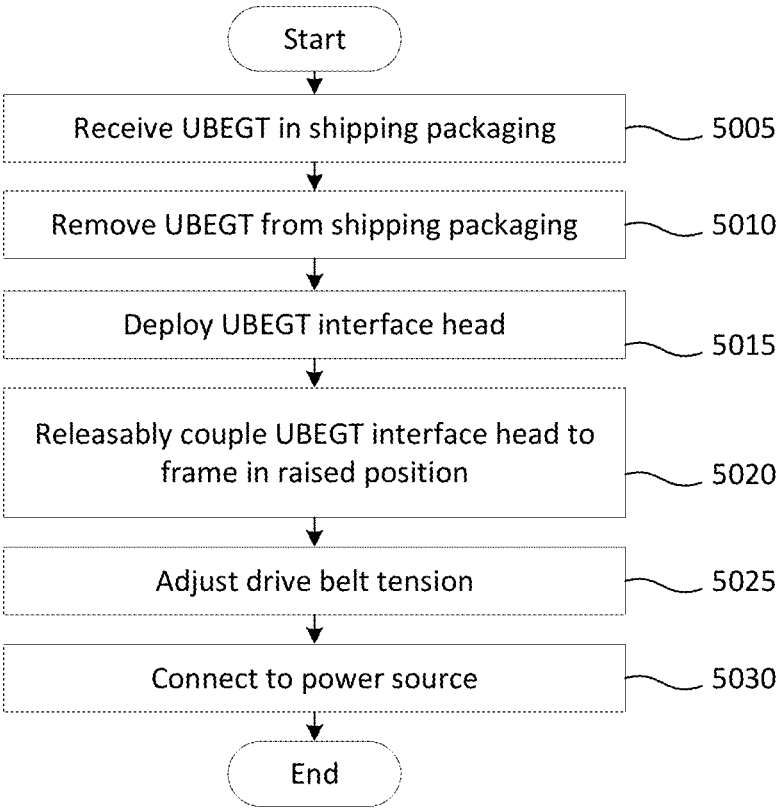
FIG. 50 depicts an exemplary method of deploying an exemplary UBEGT.

FIG. 50 depicts an exemplary method of deploying an exemplary UBEGT. The method 5000 begins when a user receives 5005 a UBEGT in a transport mode and packaged for shipping such as, for example, by a ground carrier. The user removes 5010 the UBEGT from the shipping packaging such that the UBEGT is now accessible but is still in a transport mode (e.g., as described at least in relation to FIG. 1 and FIGS. 37A-38). The user then deploys 5015 the UBEGT interface head (e.g., UBE 505 and attached user interface and display as described at least in relation to FIG. 37B) such as, for example, by rotating the interface head upwards out of a support frame (e.g., support frame 1305 at least as described in relation to FIG. 37B) of the UBEGT and into a raised (e.g., substantially vertical) position (e.g., as described at least in relation to FIGS. 1-2C). The user then releasably couples 5020 the UBEGT interface head to the support frame in the raised position (e.g., as described at least in relation to FIG. 1 and the mounting bracket 3705 of FIG. 37B). The user subsequently adjusts 5025 the drive belt tension (e.g., as discussed at least in relation to FIGS. 26A-26B). The user then connects 5030 the UBEGT to a power source, if required. The UBEGT is then ready for use. Accordingly, in various embodiments, a UBEGT may be advantageously shipped to a patient's home and the patient may independently or with minimal assistance unpack, deploy, adjust, and operate the UBEGT.

Figure 51:
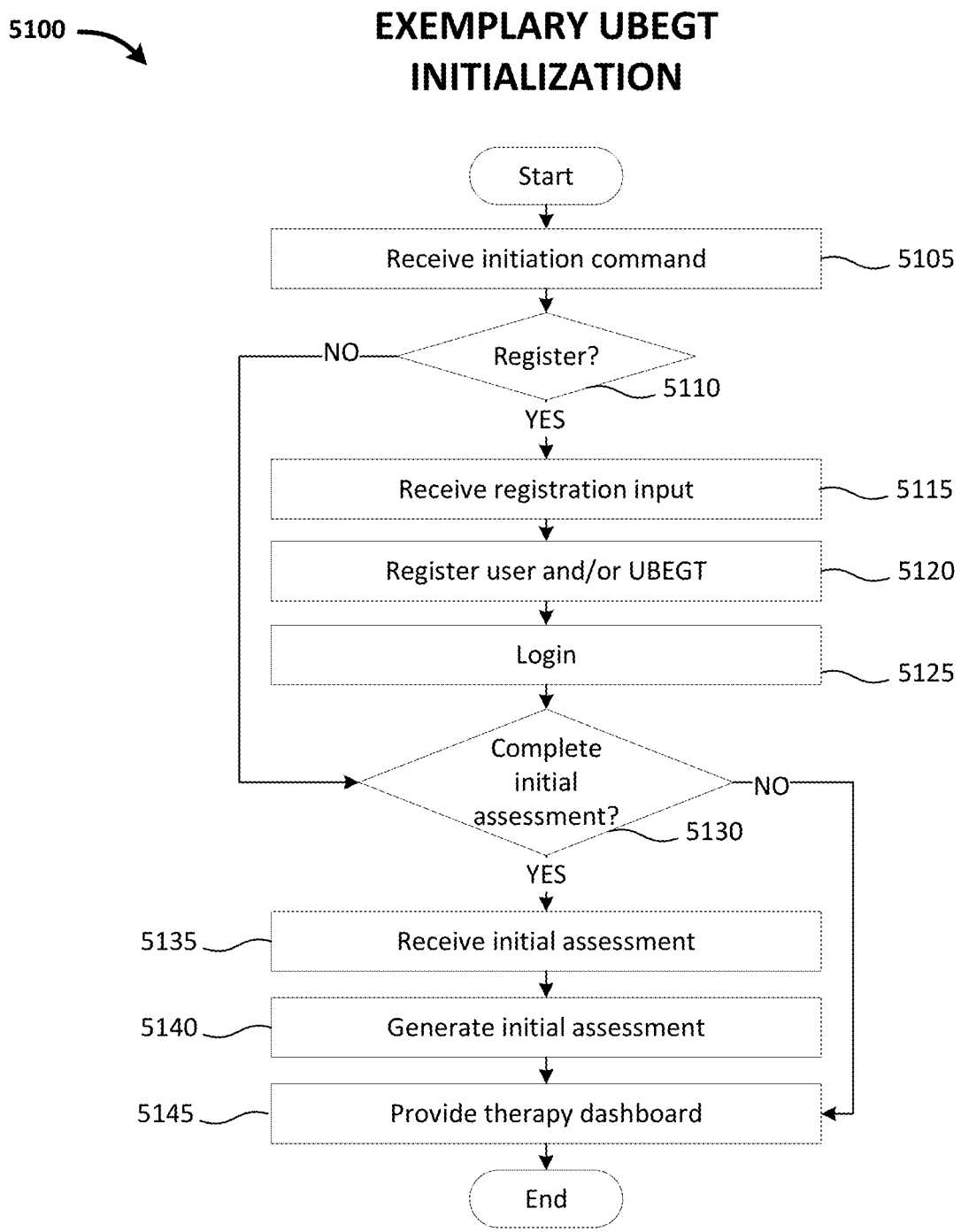
FIG. 51 depicts an exemplary method for initializing an exemplary UBEGT.

FIG. 51 depicts an exemplary method for initializing an exemplary UBEGT. The method 5100 begins by receiving an initiation command 5105 such as, for example, an input from a user to a control circuit. The control circuit determines 5110 whether to enter a device registration process such as, for example, with a remote administrator via cloud services. If registration has already been completed or the user does not wish to register, registration is bypassed, and the method proceeds to an assessment step 5130. Otherwise, registration information is received 5115 such as, by way of example and not limitation, prompting a user for input (e.g., name, address, date of birth, purchase information, desired login information), retrieving device information (e.g., model number, serial number or device ID, local network information), or some combination thereof. The user and/or device are then registered 5120 such as, for example, via cloud services.

The method then proceeds to determine 5130 whether to complete an initial assessment. The initial assessment may include, for example, user condition, user goals, or other information related to optimizing use of the UBEGT. If the user does not wish to complete an initial assessment or the initial assessment has already been completed, a therapy dashboard is provided 5145 to the user. Otherwise, initial assessment information is received 5135. Initial assessment information may, by way of example and not limitation, be received by prompting the user for input (e.g., health scores, wellness ratings, various physiological function evaluations, weight, age, height), by prompting the user to operate the UBEGT in an assessment mode and gathering information (e.g., duration, speed, resistance, heart rate, stability (such as be measurement of interaction profiles with weight sensing elements)), or some combination thereof. The initial assessment information received is then processed to generate 5140 an initial assessment. The user is then presented with the therapy dashboard 5145. Accordingly, various embodiments may advantageously assess a user's current health and/or disability status. The assessment may, for example, advantageously be used to automatically generate recommended therapies and/or settings, to provide to healthcare personnel, or some combination thereof.

Figure 52:
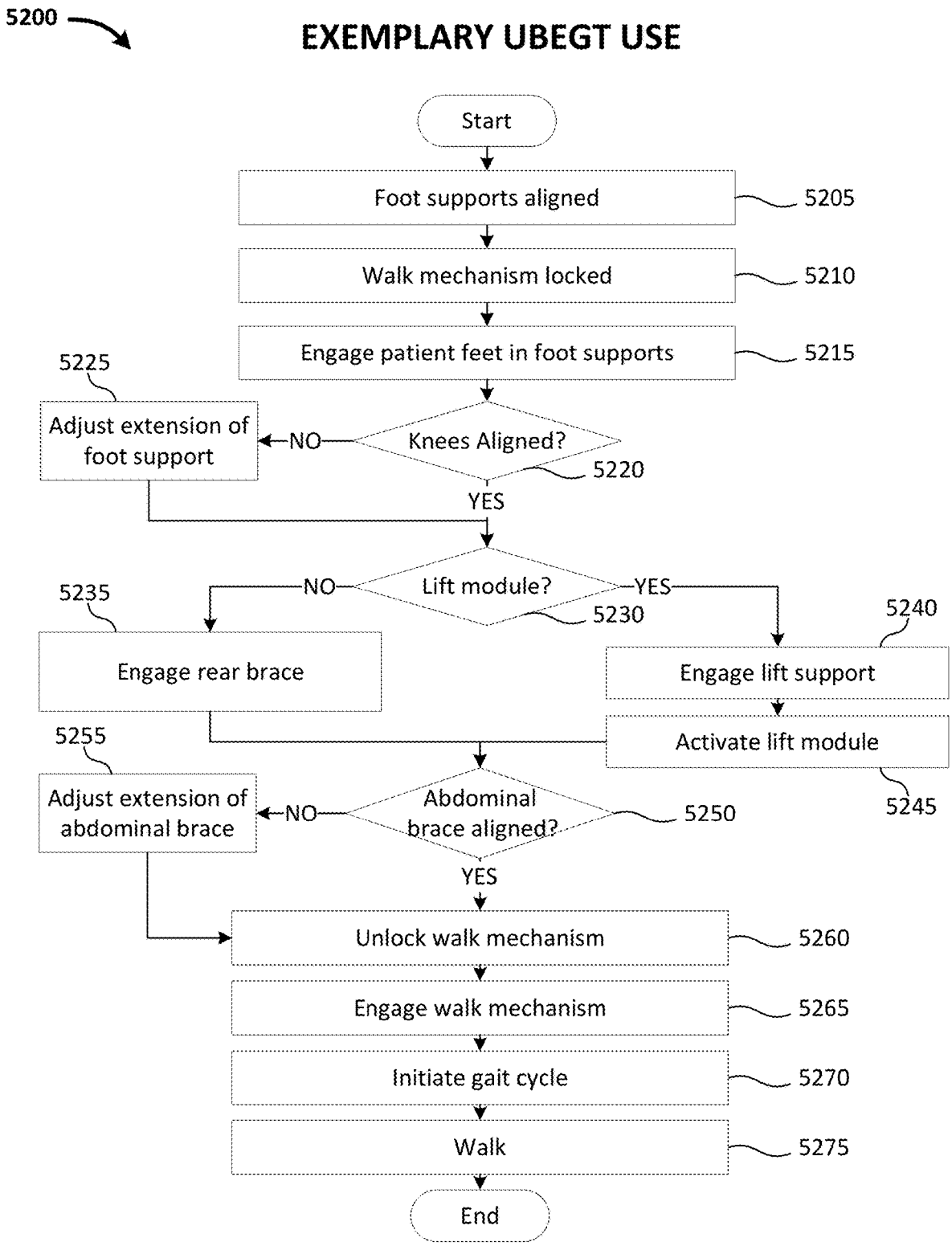
FIG. 52 depicts an exemplary method of use for a UBEGT.

FIG. 52 depicts an exemplary method of use for a UBEGT. The method 5200 begins with aligning 5205 left and right foot supports (e.g., foot supports 140 of NGMs 145 as described at least in relation to FIG. 1) adjacent to each other and locking 5210 the walk mechanism (e.g., walk control module 2025, as described at least in relation to FIG. 25) in position (e.g., as described at least in relation to FIGS. 3A-4C and FIG. 25). The user's feet are engaged 5215 in the corresponding foot supports. If the knees are not aligned 5220 with corresponding knee supports (e.g., knee supports 135 as described at least in relation to FIG. 1), the extension of the foot supports is adjusted 5225 until the knee supports align with the user's knees when the user's feet are engaged in the foot supports (e.g., adjustment of extension arms 1985, as described at least in relation to FIG. 19A and FIGS. 31A-B).

Once the knees are aligned 5220, if a lift module is to be used 5230, a lift support (e.g., lift strap 120, as described at least in relation to FIG. 1) is engaged 5240. Once the lift support is engaged, the lift module is activated 5245 (e.g., by lift module pump handle 130, as described at least in relation to FIG. 1 or power lift module 1005, as described at least in relation to FIGS. 10A-C). If a lift module is not being used 5230, a rear brace (e.g., RBSM 1105, as described at least in relation to FIGS. 11A-D) is engaged 5235 to provide rear support to the user in a standing position.

If the abdominal brace is not aligned 5250 in a desired position (e.g., to properly position the user in the sagittal plane (front to back in relation to the UBEGT) in relation to the NGMs, the extension of the abdominal brace is adjusted 5255. Once the abdominal brace is aligned 5250, the walk mechanism is unlocked 5260 and engaged 5265 (e.g., by operation of walk control module 2025) to transition from a standing mode to a walking mode of the UBEGT. Once the UBEGT is in a walking mode, the user initiates a gait cycle 5270 (e.g., by operation of the UBE 505 and/or by operation of powered drive module 2705, as described at least in relation to FIGS. 27A-28B), and proceeds to operate 5275 the left and right NGMs in a cyclical gait motion. Accordingly, in various embodiments, a UBEGT may advantageously be adjusted to fit a user. The UBEGT may then advantageously be operated by a user at least with lower body deficits for therapy, exercise, enjoyment, or some combination thereof.

Figure 53:
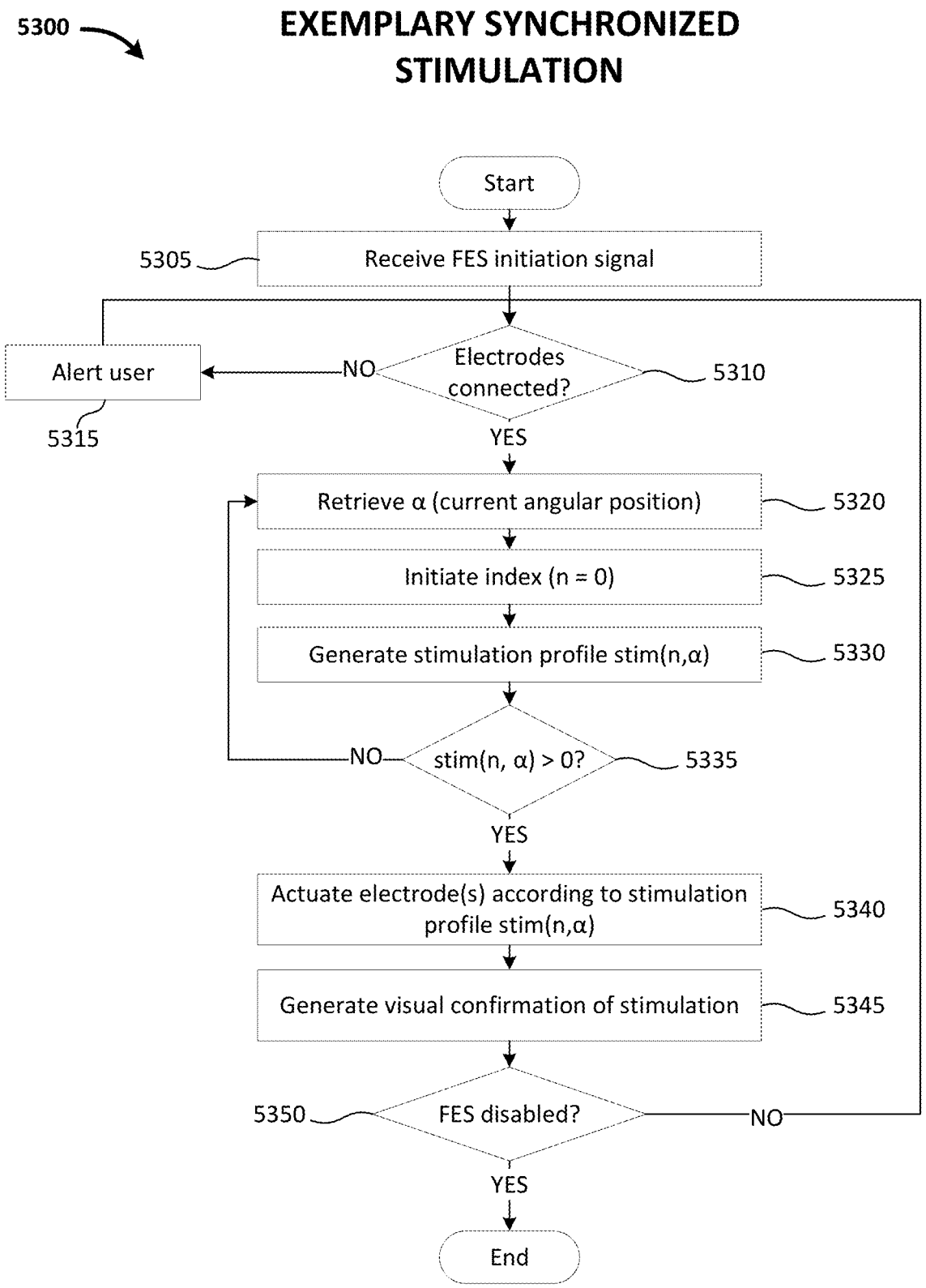
FIG. 53 depicts an exemplary method of synchronized stimulation for an exemplary UBEGT provided with an exemplary FES module and associated electrodes.

FIG. 53 depicts an exemplary method of synchronized stimulation for an exemplary UBEGT provided with an exemplary FES module and associated electrodes. In the depicted method 5300, an FES initiation signal is received 5305. The initiation signal may, for example, be received by a control circuit of the UBEGT and may be generated, by way of example and not limitation, in response to a user command, to a predetermined therapy program, or some combination thereof. The control circuit may, for example, activate a FES module (e.g., as discussed in relation to FIGS. 47A-C, and FES module 4905 discussed at least in relation to FIG. 49). Subsequently, it is determined 5310 if the electrodes are connected such as, for example, by an FES module conducting a communication check operation with one or more FES electrodes. If the electrodes are not connected, the user is alerted 5315.

Once the electrodes are determined 5310 to be connected, a current angular position (a) is retrieved 5320. For example, the control circuit may retrieve the current angular position from one or more sensors (e.g., angular position sensor 4215 discussed at least in relation to FIG. 42). The control circuit may apply one or more predetermined relationships, for example, to correlate the current angular position to a current position of left and right NGMs of the UBEGT in a gait cycle.

Once $\alpha$ is retrieved 5320, at least one index variable is initiated 5325 such as, for example, n=0, where n is an index variable. The index variable may, for example, be incremented every time a predetermined event occurs. The predetermined event may, by way of example and not limitation, be a complete gait cycle. At least one stimulation profile is then generated 5330 according to at least one predetermined stimulation parameter, threshold, relationship, or some combination thereof. The predetermined stimulation profile stim(n, $\alpha$) defines one or more stimulation parameters (e.g., related to timing, intensity, electrode(s) to activate, duration) as a function of the index and the current angular position. The stimulation profile may, by way of example and not limitation, be determined according to previous user settings, current user settings, healthcare personnel settings, predetermined stimulation profiles loaded from a remote data store, or some combination thereof.

The stimulation profile may determine, by way of example and not limitation, electrode activation sequence, frequency, duration, intensity, or some combination thereof. In various embodiments, for example, an electrode sequence may be predefined in terms of phase of a gait cycle (as determined by $\alpha$), by number of repetitions (e.g., n), by speed, by duration, or some combination thereof. In various embodiments, predetermined mappings may be generated and/or retrieve associating at least one a of a particular UBEGT to a phase in a gait cycle. In various embodiments, user settings, healthcare personnel settings, and/or administrator settings may apply weighting factors to various predetermined outputs such as, for example, intensity. For example, a user may provide an input that dynamically reduces or intensifies a stimulation intensity produced by a predetermined stimulation relationship.

Once a current stimulation profile is generated 5330, it is determined whether stimulation is commanded 5335. If stim(n, $\alpha$) is not greater than zero (i.e., no stimulation is commanded), then the method returns to 5320 to retrieve a current $\alpha$. Otherwise, the one or more electrodes defined by the stimulation profile are actuated 5340 according to the parameters defined by the stimulation profile. For example, the control circuit may determine the stimulation profile and then transmit to the FES module a signal(s) corresponding to the stimulation profile (e.g., in a predetermined format). In response to the stimulation profile signal, the FES module may actuate the appropriate electrode(s) according to the parameters received from the control circuit.

In an optional step, visual confirmation of the stimulation is generated 5345 and displayed to the user. For example, the control circuit may generate a visual confirmation (e.g., a light, a graphic, a graphic overlay on a graphic representing a moving user, a graphic corresponding to an actuated electrode(s)) and cause a display panel to display it to a user. If the FES is determined 5350 to be disabled (e.g., disabled by a user, completion of a predetermined therapy session), the method ends. Otherwise, the method returns to step 5310 to check 5310 that the electrodes are connected, and the process repeats. Accordingly, various embodiments may advantageously provide gait-synchronized FES to a user. The gait-synchronized FES may, for example, advantageously stimulate normal muscle activation, promote regenerative remodeling, promote rehabilitation, or some combination thereof.

Figure 54:
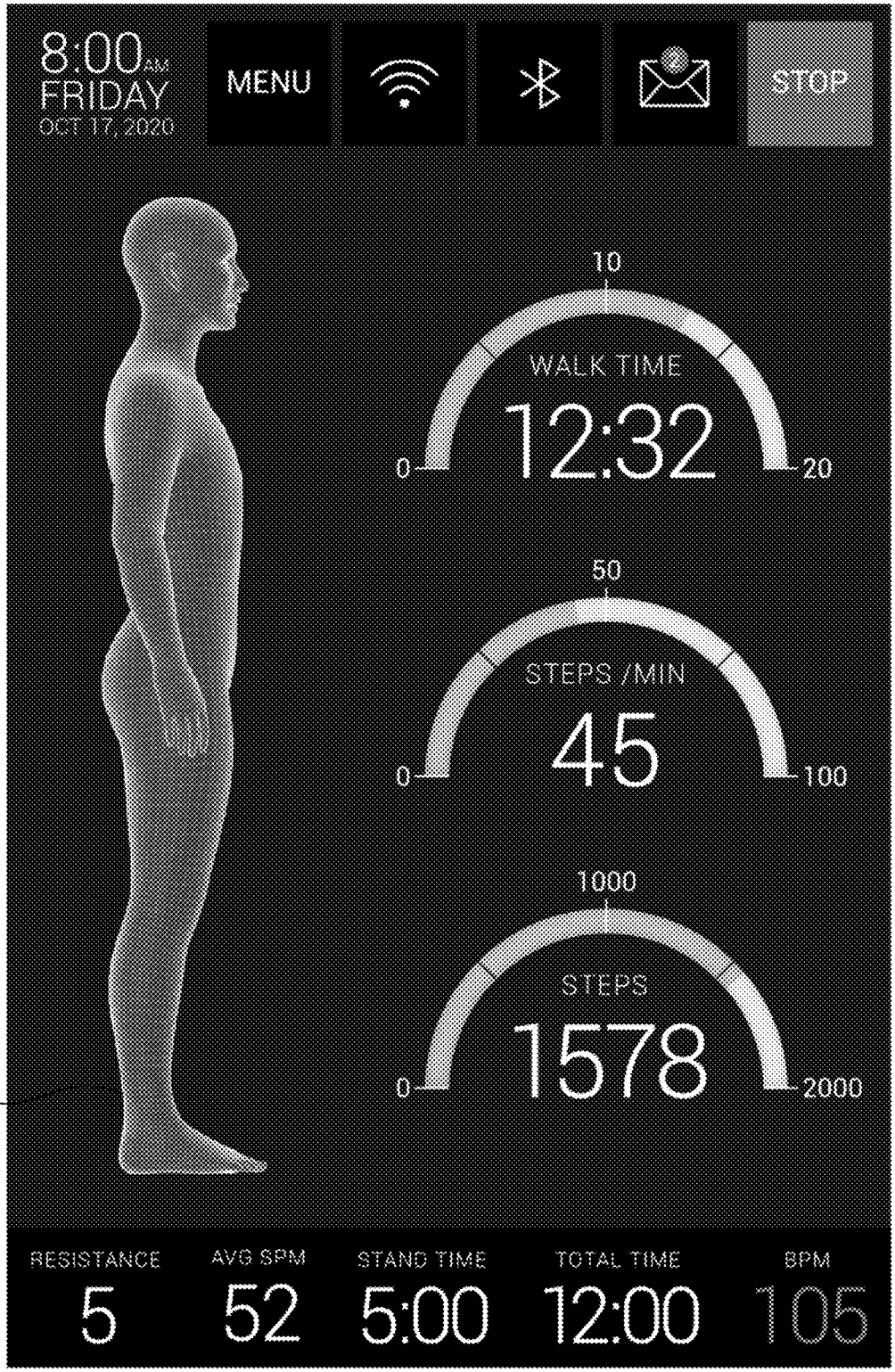
FIG. 54 depicts an exemplary graphical user interface for an exemplary UBEGT.
Figure 55:
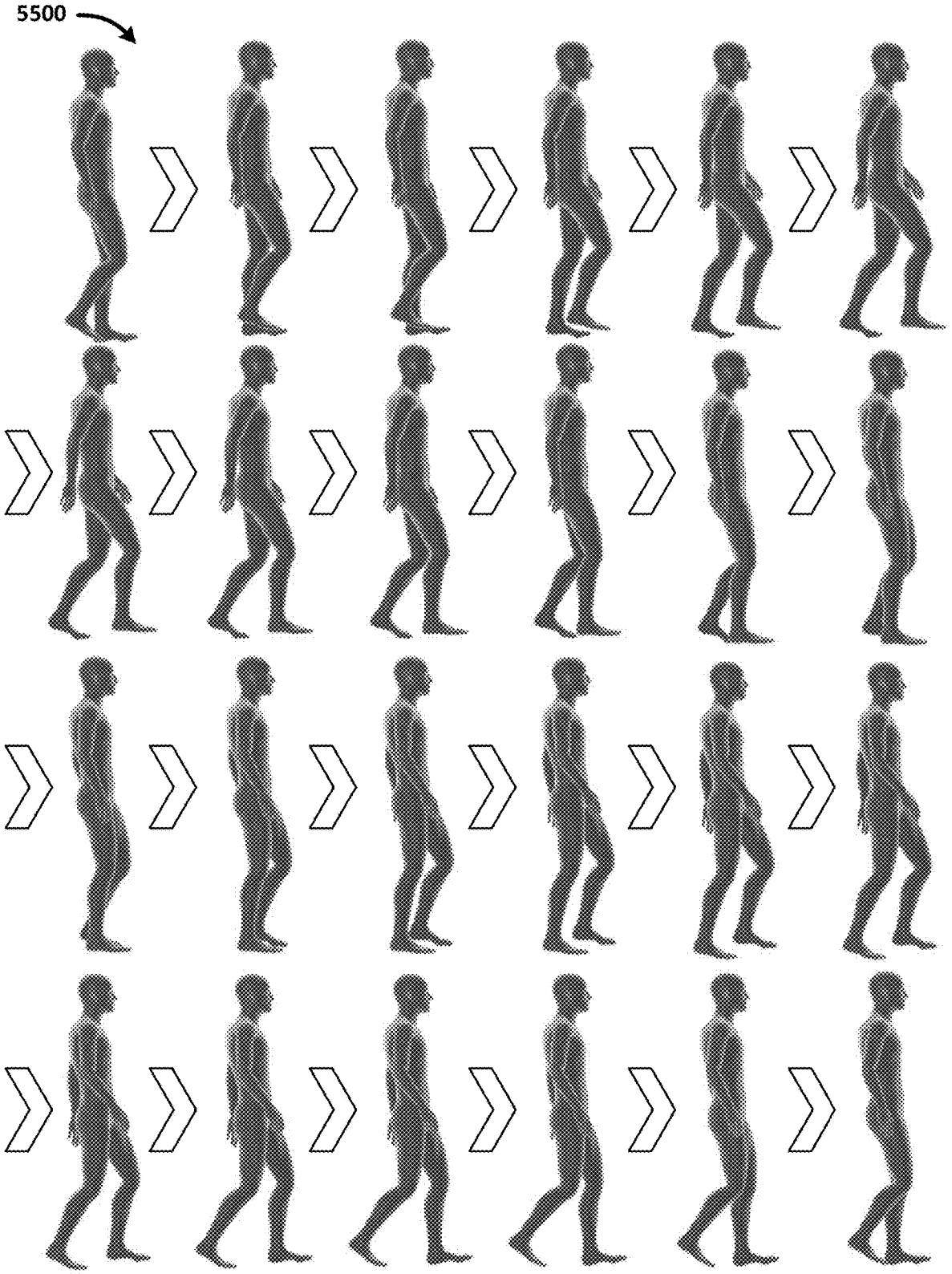
FIG. 55 depicts sequential images of an exemplary element of a graphical user interface depicting a natural gait cycle.

FIG. 54 depicts an exemplary graphical user interface for an exemplary UBEGT. FIG. 55 depicts sequential images of an exemplary element of a graphical user interface depicting a natural gait cycle. The depicted dashboard 5400 may, for example, be generated by one or more control circuits. The dashboard may, for example, reflect information gathered from various modules of the UBEGT (e.g., timer, weight sensors, heart rate sensors, resistance module, walk control module, angular position sensor). The dashboard may, for example, depict various physiological signals (e.g., heart rate as beats-per-minute (BPM)), UBEGT module parameters and/or attributes (e.g., resistance level, speed per minute), session attributes (e.g., average speed per minute, stand time, total time). The dashboard may display a comparison of the session attributes and/or accumulated session attributes over a predetermined time period (e.g., a day, week, month) against predetermined user goal(s) and/or predetermined therapy plan(s). The user may, for example, interact with the dashboard (e.g., via a touchscreen input) to alter goals, view different screens, input commands, or some combination thereof.

The dashboard may, for example, depict a person 5405 in a standing position. The control circuit may be configured to generate an animated depiction of the person 5405. The dashboard may, for example, display the animated depiction of the person 5405 such that it appears to a user as moving. The control circuit may be configured to synchronize the animated depiction of the person 5405 to a current position of the actual user in a gait cycle. For example, a predetermined plurality 5500 of graphics representing a person in various stages (e.g., every 15° or every $\pi/24$ radians) of a bipedal gait cycle may be associated with corresponding stages of a gait cycle on the UBEGT. The control circuit may monitor a current position of the user in a gait cycle and display a predetermined corresponding graphic from the predetermined plurality 5500. The control circuit may animate the graphics from plurality 5500 such that a user perceives an animated walking person 5405 on the dashboard 5400. Accordingly, a user may advantageously view the current phase of the gait cycle they are in, may perceive their speed, intensity, and/or other gait attribute, or some combination thereof, regardless of the user's ability to independently sense a current position of their lower body or some portion thereof.

In various embodiments, the dashboard may further include one or more social interaction display elements and/or screens. For example, the user may access a messaging interface to communicate with other patients, users, healthcare personnel, administrators, or some combination thereof. The user may, for example, interact with other patients by sharing progress, sharing goals, messaging, or some combination thereof. Various display elements and/or full screens may, for example compare a user's progress to progress of various other users. Discovery interfaces may allow a user to discover other users in one or more social networks such as, by way of example and not limitation, an existing social network of the user, geography (e.g., a same facility, neighborhood, city, state, country), entity (e.g., same employer, organization, hospital, clinic), interest, disability, goals, or some combination thereof.

The dashboard may, for example, depict various administration interfaces to the user, and may allow a user to alter, update, or approve UBEGT settings. The dashboard may allow a user to access and input information requested by an insurance provider, by a healthcare provider, or some combination thereof. The dashboard may, for example, allow a user to access and input information for generating predetermined therapy profiles and/or plans, generating predetermined FES stimulation profiles, generating therapy and/or exercise goals, generating health assessments, or some combination thereof. UBEGT control circuit(s) may, for example, generate any of the discussed display elements, screens, session attributes. The control circuit(s) may, for example, interact with various modules and/or cloud service(s) via wired and/or wireless connections. Accordingly, in various embodiments, one or more computer-generated dashboards may advantageously allow a user to interact with the UBEGT, remote users, or some combination thereof.

Figure 56:
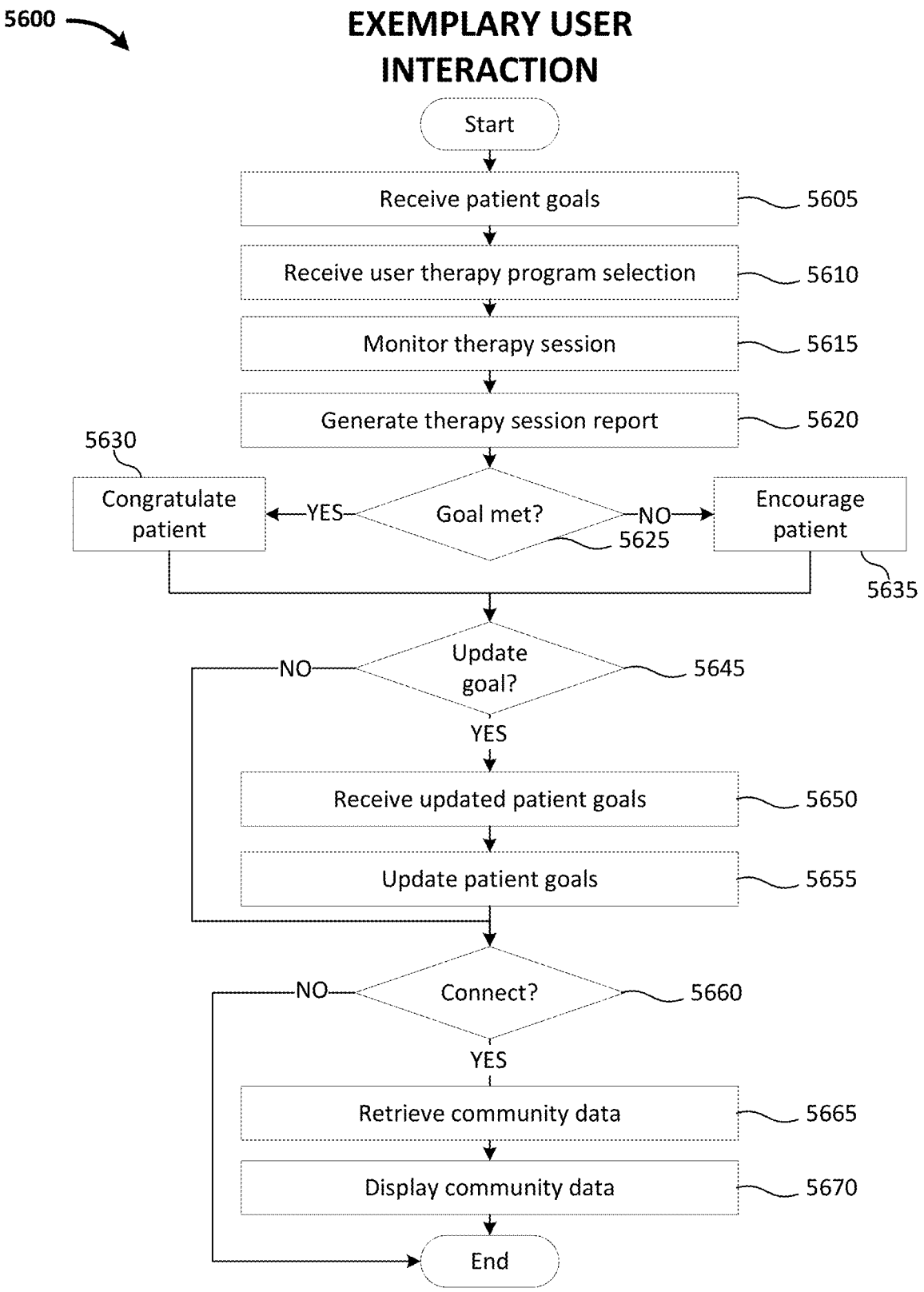
FIG. 56 depicts an exemplary process of an exemplary user interface and control module of an exemplary UBEGT.

FIG. 56 depicts an exemplary process of an exemplary user interface and control module of an exemplary UBEGT. In the method 5600, the patient goals are received 5605. The patient may, for example, be prompted to input goals, prompted to answer questions from which goals are determined, or some combination thereof. Goals may also be retrieved, for example, from a cloud service or third party.

A user therapy program selection is then received 5610. By way of example and not limitation, a control circuit and/or cloud service may, for example, generate at least one recommended therapy (and/or exercise) program as a function at least of the patient's goals received in step 5605. The patient may then select a preferred therapy program. The user may, for example, modify the selected therapy program. A healthcare provider may generate and provide a recommended therapy program for selection by the user. A user may input a custom therapy program by inputting parameters. In some embodiments, therapy program selection 5610 may, for example, be bypassed or omitted, and therapy parameters may be dynamically determined by the user.

Once the therapy program is selected, the therapy session is monitored 5615 as the user progresses through it or otherwise uses the UBEGT. For example, a control circuit(s) of the UBEGT may monitor, for example, speed, gait phase, heart rate, or other appropriate parameters. The data generated therefrom may, for example, be stored locally and/or on one or remote data stores (e.g., on a cloud service, a healthcare provider data store, a user-selected data store). Once the therapy session is terminated, a therapy session report is generated 5620. The therapy session report is compared 5625, if applicable, to a user's predetermined goals. If the user has met or exceeded their goals, a congratulatory message may be displayed 5630. If the user has not yet met their goals, a message of encouragement and/or suggested actions may be displayed 5635.

Subsequently, if the goals are not to be updated the method proceeds to determining whether to initiate social connection steps 5660. If the goals are to be updated 5645 (e.g., automatic updating, or input from a user initiating updating), then updated patient goals are received 5650 and updated 5655 accordingly.

If the user does not permit social connection 5660, the process ends. Otherwise, for example, if the user has initiated social connections, such as with other patients or with healthcare personnel, and the user grants or has granted permission to communicate therapy progress, community data is retrieved 5665. The retrieved community data is then displayed 5670. The community data may include, by way of example and not limitation, patient goals, patient progress, messaging, or some combination thereof. Accordingly, various embodiments may enable a user to advantageously interact with remote users in the context of UBEGT operation and interaction.

Figure 57:
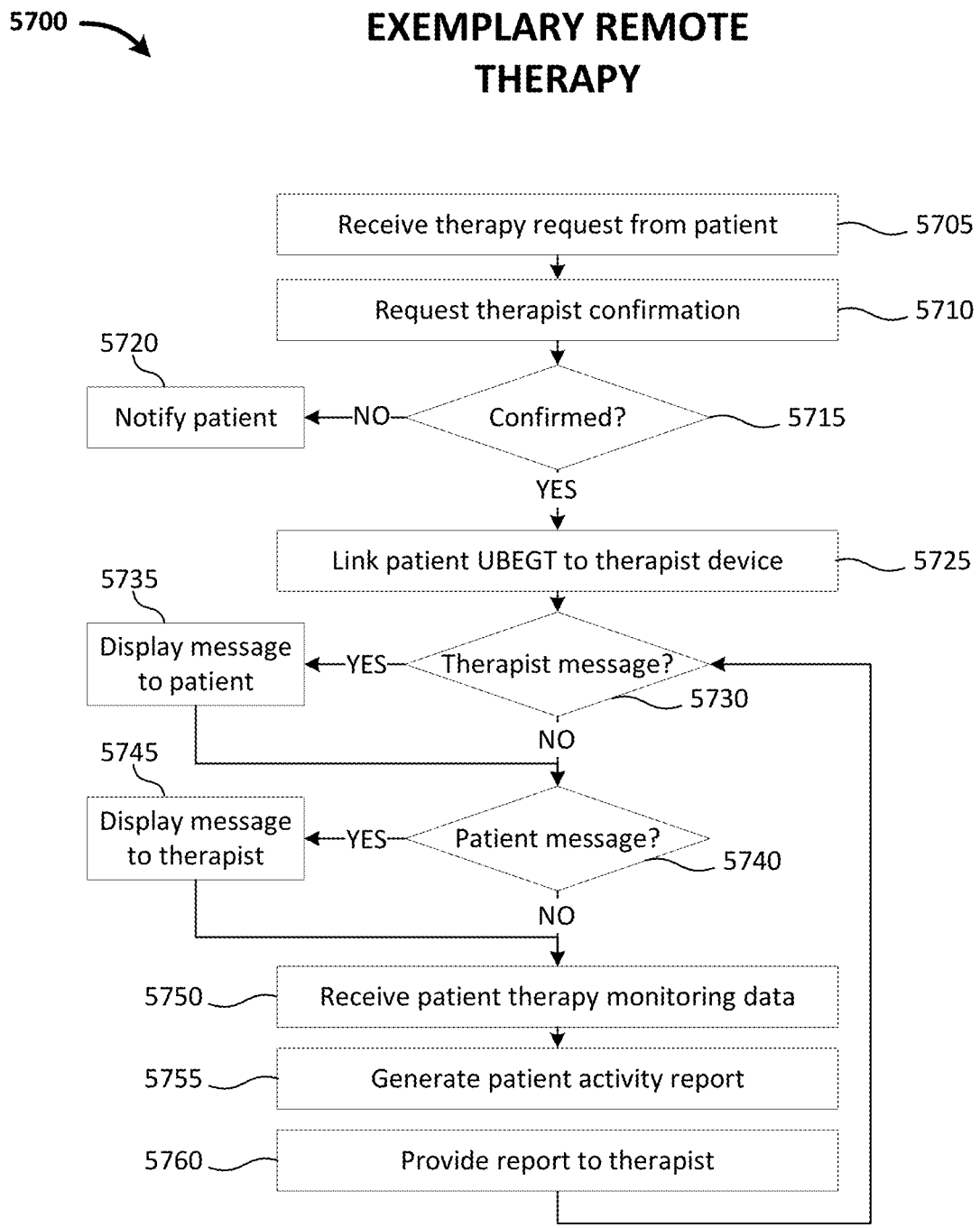
FIG. 57 depicts an exemplary method for an exemplary control module of an exemplary UBEGT to communicate with an exemplary device of a remote.

FIG. 57 depicts an exemplary method for an exemplary control module of an exemplary UBEGT to communicate with an exemplary device of a remote. Method 5700 begins by receiving 5705 a therapy request from a patient. The request may be received, for example, by a control circuit of the UBEGT. Although discussed in relation to the UBEGT control circuit, the method 5700 may, by way of example and not limitation, be implemented by a computing device such as, for example, a cloud service(s), a remote server, a UBEGT control circuit(s), a therapist device, or some combination thereof. For example, a patient may remotely initiate a therapy request from an interface on their UBEGT via, for example, the cloud service(s). The therapy request may be then transmitted to one or more therapists for confirmation 5710. For example, the patient may request a particular therapist (e.g., a therapist the user is currently working with), may search for a therapist, may be automatically matched with a therapist(s), or some combination thereof. In various embodiments, a therapist may, by way of example and not limitation, be a physical therapist, a physician, a nurse, a coach, an occupational therapist, or some combination thereof.

If the control circuit determines that the therapist did not confirm 5715 the therapy request from the patient, the patient is notified 5720. Otherwise, the patients UBEGT is linked 5725 to the therapist's device such as, for example, by a cloud service. In various embodiments, the link may be dynamic such that, for example, a therapist can login to a remote system and communicate with linked patients from any of a plurality of devices such as, for example, a computer, tablet, smartphone, or other computing device. If the control circuit receives a message 5730 from the therapist for the user, the message is displayed to the patient 5735. Otherwise, if the patient sends a message to the therapist 5740, the message is transmitted for display 5745 to the therapist.

The control circuit receives patient therapy monitoring data such as, by way of example and not limitation, as discussed in relation to step 5615 of FIG. 56. From the monitoring data, the control circuit generates a patient activity report 5755. In various embodiments, the data may be, for example, collected by the UBEGT control circuit and transmitted for remote generation of the patient activity report (e.g., cloud service, therapist device). Once the report is generated, it is provided to the therapist. The method then returns to determine if the therapist sends a message to the patient 5730. For example, the therapist may communicate with the patient regarding progress, advice, and/or encouragement. The therapist may send a message containing therapy settings for the UBEGT such as, for example, a predetermined therapy plan (e.g., as discussed in relation to step 5610 of FIG. 56), FES-related settings (e.g., as discussed in relation to FIG. 53), goal modifications, or some combination thereof. Accordingly, various embodiments may advantageously permit remote support of a patient by a therapist.

Figure 58:
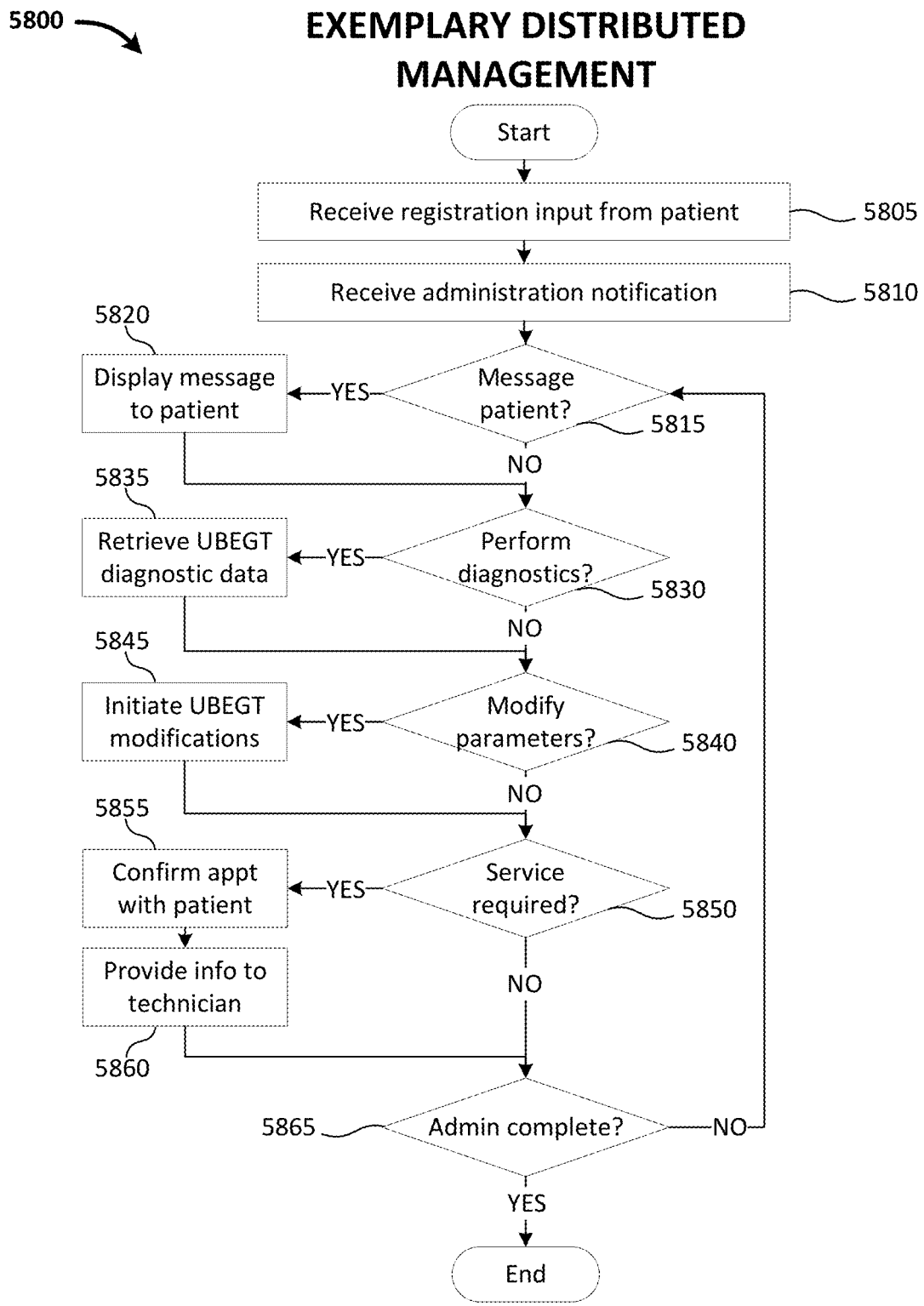
FIG. 58 depicts an exemplary method of distributed management for a plurality of exemplary UBEGTs.

FIG. 58 depicts an exemplary method of distributed management for a plurality of exemplary UBEGTs. The depicted method 5800 begins by receiving registration input from a patient 5805. The request may be received, for example, by an administration system from a control circuit of a UBEGT. Although discussed in relation to the administration system, the method 5800 may, by way of example and not limitation, be implemented by one or more computing device such as, for example, a cloud service(s), a remote server, a UBEGT control circuit(s), an administrator's device, or some combination thereof. An administrator device then receives an administration notification 5810 which may be displayed, for example, to an administrator in an administrative dashboard.

If an administrator messages the patient 5815, the message is transmitted to a patient device for display 5820 to the patient. If the administrator initiates diagnostics 5830, diagnostics are executed remotely on the patients to retrieve 5835 appropriate diagnostic data. If the administrator modifies parameters 5840 for one or more UBEGTs, the modifications are remotely initiated 5845 on the selected UBEGTs. If service is required 5850 (e.g., requiring in-person assistance and/or repair), an administrator may, for example, remotely confirm 5855 an appointment time with the patient via the patient's UBEGT interface. The administrator may, for example, provide information to a technician such as device information and/or user address retrieved during, for example, diagnostics and/or registration. If the administration tasks are complete 5865 the process ends, otherwise, the process returns to determining if a patient is messaged 5815 and repeats. Accordingly, various embodiments may advantageously enable remote administration and support of a plurality of UBEGTs.

Although various embodiments have been described with reference to the figures, other embodiments are possible. For example, various embodiments may achieve one or more advantages. Various embodiments may advantageously be used independently by a paralyzed individual who can transfer without assistance from their wheelchair. Embodiments may be accessible from a wheelchair. Various embodiments may provide easy and simple adjustments for users of varying sizes. Embodiments may provide self-operated lift and support systems to help a user to a standing position. Embodiments may provide self-operated leg transfer systems to move legs to a walk position. Various embodiments may provide accurate walking geometry with proper skeletal positioning. Various embodiments may provide users the ability to move their legs in a walking motion using upper body in a smooth and easy motion. Various embodiments may provide full support of a user during walking so the user will not fall and feels safe. Various embodiments may minimize shear and pressure and body contact points during a walk cycle.

Various embodiments may be advantageously designed for home use. Embodiments may provide a compact shipping size adapted to be shipped by readily available residential parcel services. Various embodiments may be quickly and easily assembly such as, for example, unpacked and deployed in under 20 min by an average person. Various embodiments may advantageously be configured with a small footprint. Various embodiments may fit through a nominal 32-inch-wide door. Various embodiments may be provided with large transport wheels and may easily be moved into a user's home. Various embodiments may be provided in an aesthetically pleasing design suitable for a living room. Various embodiments advantageously be used in a small space. Various embodiments may be provided with safety guards and may improve safety around small children, elderly persons, and/or disabled persons. Various embodiments may be configured to require no electric power source. Such embodiments may, for example, advantageously be placed regardless of power accessibility and may advantageously eliminate tripping hazards from cords.

Various embodiments may advantageously provide economical exercise and/or therapy options for restricted income users. Various embodiments may advantageously be responsive, connected, and improve user motivation. Various embodiments may provide real time leg position feedback. Various embodiments may provide a fun, engaging and/or motivating walk therapy app. Various embodiments may enable measurement of therapy outcomes and/or logging of therapy progress. Various embodiments may provide connection to the internet. Various embodiments may provide access to cloud storage. Various embodiments may provide access by user and therapists.

Various embodiments may provide social media connection to users. Various embodiments may provide therapy resource connection. Various embodiments may provide telehealth connection. Various embodiments may provide customer connection to administrators for service needs.

Various embodiments may provide supported standing for either a person who uses a device to assist walking or a person who uses a wheelchair. Various embodiments may advantageously provide a modular design that is both cost effective and adaptable for a large population of mobility challenged people. Various embodiments may provide a UBEGT accessible for a person using a cane, walker, or other walking assist device to step on low to ground foot supports, into knee supports and activate a back (buttocks) support mechanism or attach a strap option. The user may be fully supported in a standing position. The UBEGT may also be used by a paralyzed individual confined to a wheelchair, such as in various embodiments provided with a hydraulic or powered lift mechanism that will lift the individual from the wheelchair to a fully supported standing position. Various embodiments may advantageously lift someone from a wheelchair safely and effectively while operating in a compact space while avoiding interference of the lifting mechanism with walking. In various embodiments, the lifting mechanism may be easily removable for people who do not need it.

In various embodiments, once a user is supported in the UBEGT, the user's legs may be advantageously transferred from a standing position to a walking position naturally, safely, and easily. One lever may either locks the legs together and rigid for getting in and out of the device or may position the legs for walking. As a user rotates a UBE, the leg transfer transmission may self-locate and locks for the selected standing or walking leg position. Various embodiments may advantageously make such transfer easily and safely with only one lever required by the user and/or without a motor.

When the user is supported in the standing position, the user may then transfer their leg to a walking position with the leg transfer mechanism. The self-locating leg transfer mechanism may lock the user's legs in a standing or walking position and may be operated by the upper body ergometer. The leg transfer mechanism moves legs in a natural motion to either the standing or walking position while fully supporting the individual, so the user remains stable. The user may rotate the UBE and move their legs in a walking motion, or the user can simply walk if they are able to move their legs.

In various embodiments, a rotating gait drive mechanism (e.g., NGMs) may advantageously enable a user to independently perform gait training with the rotational movement of the upper body ergometer. Accordingly, such embodiments may advantageously provide paralyzed users the ability to move their legs with their arms. The rotational drive may provide a constant drive force for a smooth and easy walking motion. Individuals with leg function may walk without using their arms, and/or move their arms with their leg motion. Various embodiments may provide resistance which may be added for increasing stamina. Various embodiments may advantageously facilitate a user moving their legs while supported from a standing to a walking position. Various embodiments may fully supports a person at their feet, knees, buttocks, abdomen throughout the walking cycle.

In various embodiments, FES stimulation may be provided. In various embodiments, a user at least partially controls the stimulation by walking speed. Various such embodiments may advantageously promote improved mind-body connection. In various embodiments, the user may apply FES to help restore muscle or nerve function and help reverse or prevent muscle atrophy. Various embodiments may be provided with a 360-degree rotary position sensor that determines the position of the user's legs in the gait cycle. The FES may be programed to send an eccentric or concentric electrical impulse activating the walking leg muscles at correct time(s) during gait cycle. The user may control the amount of stimulation. Also, the user may control when the muscles are activated by the speed they are walking.

In various embodiments, an on-board computer (e.g., a tablet) and custom software app may advantageously perform several key functions. For example, various embodiments may be provided with a "screen in a screen" which may advantageously provide a user with key therapy data while the user is in therapy and viewing other information. In various embodiments, the app may advantageously help make the therapy session motivating, and/or easy to use and view for older people. The app may, for example, calculate a therapy score as a function of the user's time and speed walking. Various embodiments may provide a series of transparent walking model images that scan the body and visualize for a user key body systems including, by way of example and not limitation, skeletal, muscular, heart, lungs, digestive track, renal functions, spinal cord and brain on an image of a walking model that moves in real time as the user moves. In various embodiments, the app may provide quick access to a library that users can access for resources such as but not limited to therapy motivation and how-to videos and/or PDF's about gait therapy, studies, and wellness information.

In various embodiments, an app may periodically ask the user a series of questions evaluating their health, function, and ability to stay independent. The information, along with therapy sessions information, may, for example, be securely transferred to a HIPAA compliant cloud storage provider and can be accessed by the user and/or authorized medical professionals. In various embodiments, an app may provide users a platform to connect and acknowledge each other's accomplishments. By way of example and not limitation, users may join specific groups such as: Seniors, Spinal Cord Injury, Stroke, Multiple Sclerosis, Parkinson's, or other appropriate groups. In various embodiments, users may, for example, be visible or invisible. In various embodiments, users may see, for example, at any time how many people are doing therapy in the world. In various embodiments, an app may provide a HIPAA compliant platform that connects a user real time with their doctor or therapist. Various embodiments may further provide a companion therapist app which may advantageously provide easy communication with the user app. Various embodiments may provide integration with third party apps such as but not limited to blood pressure, oxygen level, pulse rate, weight, and other health related measurements and notifications.

In various embodiments, some bypass circuits implementations may be controlled in response to signals from analog or digital components, which may be discrete, integrated, or a combination of each. Some embodiments may include programmed and/or programmable devices (e.g., PLAs, PLDs, ASICs, microcontroller, microprocessor), and may include one or more data stores (e.g., cell, register, block, page) that provide single or multi-level digital data storage capability, and which may be volatile and/or non-volatile. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

Although an exemplary system has been described with reference to various figures, other implementations may be deployed in other industrial, scientific, medical, commercial, and/or residential applications.

Temporary auxiliary energy inputs may be received, for example, from chargeable or single use batteries, which may enable use in portable or remote applications. Some embodiments may operate with other DC voltage sources, such as batteries, for example. Alternating current (AC) inputs, which maybe provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Although an example of a system, which may be portable, has been described with reference to the above figures, other implementations may be deployed in other processing applications, such as desktop and networked environments.

Although particular features of an architecture have been described, other features may be incorporated to improve performance. For example, caching (e.g., L1, L2, . . . ) techniques may be used. Random access memory may be included, for example, to provide scratch pad memory and or to load executable code or parameter information stored for use during runtime operations. Other hardware and software may be provided to perform operations, such as network or other communications using one or more protocols, wireless (e.g., infrared) communications, stored operational energy and power supplies (e.g., batteries), switching and/or linear power supply circuits, software maintenance (e.g., self-test, upgrades), and the like. One or more communication interfaces may be provided in support of data storage and related operations.

Some systems may be implemented as a computer system that can be used with various implementations. For example, various implementations may include digital and/or analog circuitry, computer hardware, firmware, software, or combinations thereof. Apparatus can be implemented in a computer program product tangibly embodied in an information carrier, e.g., in a machine-readable storage device, for execution by a programmable processor; and methods can be performed by a programmable processor executing a program of instructions to perform various functions by operating on input data and generating an output. Various embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, which may include a single processor or one of multiple processors of any kind of computer. Generally, a processor will receive instructions and data from a read-only memory or a random-access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and CD-ROM and DVD-ROM disks. The processor and the memory can be supplemented by, or incorporated in, ASICs (application-specific integrated circuits).

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. Various embodiments may be implemented in a computer system that includes a graphical user interface and/or an Internet browser. To provide for interaction with a user, some implementations may be implemented on a computer having a display device, such as a CRT (cathode ray tube) or LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits and/or other modules. In various examples, the modules may include analog and/or digital logic, discrete components, traces and/or memory circuits fabricated on a silicon substrate including various integrated circuits (e.g., FPGAs, ASICs). In some embodiments, the module(s) may involve execution of preprogrammed instructions and/or software executed by a processor. For example, various modules may involve both hardware and software.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A natural gait trainer comprising:

a support frame;

a first gait module suspended in the support frame, the first gait module comprising:

an articulating leg support suspended from the support frame, the articulating leg support comprising:

an upper arm rotatably connected at a proximal end to the support frame;

a lower arm connected at a proximal end to a distal end of the upper arm by a first pivot joint; and, a foot support coupled to a distal end of the lower arm, wherein the first pivot joint is configured to align with a knee of a first leg of a user when the user is standing with a corresponding foot supported in the foot support;

a rocker arm rotatably coupled to the lower arm and coupled to the support frame; and, a pivot arm rotatably coupled to the rocker arm and to a drive module, wherein the pivot arm, the rocker arm, and the support frame constrain a rotation of a first longitudinal axis of the lower arm between a first angle and a second angle, the first angle and the second angle each being relative to a second longitudinal axis of the upper arm, such that, in a walk mode, the foot support and the first pivot joint guide the first leg of the user in a natural gait cycle while preventing overextension of the first knee.

2. The natural gait trainer of claim 1, further comprising:

a second gait module suspended in the support frame and configured to guide a second leg of the user in the natural gait cycle; and, the drive module rotatably coupling the first gait module to the second gait module to maintain a predetermined relationship between a first phase in the natural gait cycle of the first gait module with a second phase in the natural gait cycle of the second gait module such that the first phase is offset from the second phase by a predetermined phase angle.

3. The natural gait trainer of claim 2, wherein, in a stand mode, the predetermined phase angle is zero.

4. The natural gait trainer of claim 2, wherein in the walk mode, an absolute value of the predetermined phase angle is greater than zero.

5. The natural gait trainer of claim 1, further comprising an upper body ergometer (UBE) rotatably coupled to a front of the support frame and configured to rotate a shaft rotatably connected to the pivot arm of the first gait module when a hand crank is rotated.

6. The natural gait trainer of claim 1, further comprising a rear support module comprising:

a back support element rotatably coupled to a side of the support frame; and, an actuation element configured to, when activated, rotate the back support element between an engaged position and a disengaged position.

* * * * *